US009260228B2

(12) United States Patent
Buck

(10) Patent No.: US 9,260,228 B2
(45) Date of Patent: Feb. 16, 2016

(54) LID WITH INTEGRATED CONTAINER

(71) Applicant: Top-That! LLC, Encinitas, CA (US)

(72) Inventor: Ronald Mark Buck, Encinitas, CA (US)

(73) Assignee: Snacktops, Inc., Encinitas, CA (US)

( * ) Notice: Subject to any disclaimer, the term of this patent is extended or adjusted under 35 U.S.C. 154(b) by 0 days.

(21) Appl. No.: 14/263,993

(22) Filed: Apr. 28, 2014

(65) Prior Publication Data

US 2014/0231436 A1 Aug. 21, 2014

Related U.S. Application Data

(60) Division of application No. 13/605,967, filed on Sep. 6, 2012, now Pat. No. 8,708,181, which is a continuation-in-part of application No. 13/360,707, filed on Jan. 28, 2012, now Pat. No. 8,381,935, which is a continuation-in-part of application No. 13/226,346, filed on Sep. 6, 2011, now Pat. No. 8,596,491.

(51) Int. Cl.
*A47G 19/22* (2006.01)
*B65D 51/28* (2006.01)
(Continued)

(52) U.S. Cl.
CPC ..... *B65D 51/24* (2013.01); *A47G 19/065* (2013.01); *A47G 19/2222* (2013.01); *A47G 19/2266* (2013.01); *B65D 51/28* (2013.01); *B65D 2203/00* (2013.01); *B65D 2231/022* (2013.01)

(58) Field of Classification Search
CPC ..... A47G 19/065; A47G 19/2222; A47G 19/2226; A47G 19/226; B65D 51/28; B65D 51/24; B65D 51/246; B65D 231/022; B65D 2203/00
USPC ..... 220/4.23, 23.4, 254.3, 495.03, 729, 220/831, 840, 709, 523
See application file for complete search history.

(56) References Cited

U.S. PATENT DOCUMENTS

| | | | |
|---|---|---|---|
| 1,665,289 | A | 4/1928 | Weaver |
| 3,288,344 | A | 11/1966 | Woollen |

(Continued)

FOREIGN PATENT DOCUMENTS

| | | |
|---|---|---|
| EP | 1397986 | 3/2004 |
| RU | 2118281 C1 | 8/1998 |
| WO | 2012033472 | 3/2012 |

OTHER PUBLICATIONS

International Search Report and Written Opinion issued for PCT Appl. No. PCT/US2014/010181, dated Apr. 24, 2014, 7 pages.

(Continued)

*Primary Examiner* — Fenn Mathew
*Assistant Examiner* — James N Smalley
(74) *Attorney, Agent, or Firm* — Manuel de la Cerra

(57) ABSTRACT

Lid with integrated container(s) that couples with the top of a cup/can. The lid and cup/can form at least two containment volumes. Embodiments enable easy containment, inclusion of fresh food, transportation and access of solids or liquids in the container and cup/can without disengagement of the lid from the cup/can. Contents of the lid container may be accessed, partially consumed, replaced in the container and resealed at any time as desired by the user. Additionally, an independent drop-in container within the lid cavity may be resealed and removed from the lid cavity and taken to other locations such as home, work, or car. Simplifies eating and drinking from one unified container and cup in a theater or stadium having seats that, for example, provide one cup holder per seat. Provides one free hand to hold a child's hand for safety while in stadiums and amusement parks.

27 Claims, 56 Drawing Sheets

(51) Int. Cl.
*B65D 51/24* (2006.01)
*A47G 19/02* (2006.01)

(56) References Cited

U.S. PATENT DOCUMENTS

| | | | | |
|---|---|---|---|---|
| 3,323,706 | A | 6/1967 | Gereke | |
| 3,413,128 | A | 11/1968 | Steinbarth et al. | |
| 3,421,654 | A | 1/1969 | Gunter | |
| 3,616,897 | A | 11/1971 | Vrana | |
| 3,679,089 | A | 7/1972 | Swett et al. | |
| 3,817,419 | A | 6/1974 | Moller et al. | |
| 4,054,205 | A | 10/1977 | Blow, Jr. et al. | |
| 4,074,827 | A | 2/1978 | Labe | |
| 4,091,953 | A | 5/1978 | Daenen | |
| 4,349,120 | A * | 9/1982 | DiNardo | 220/840 |
| 4,627,537 | A | 12/1986 | Rogers | |
| 4,699,299 | A | 10/1987 | Gach | |
| 5,145,646 | A | 9/1992 | Tyranski | |
| 5,180,079 | A | 1/1993 | Jeng | |
| 5,283,140 | A | 2/1994 | Netz et al. | |
| 5,310,072 | A | 5/1994 | Matusovsky et al. | |
| 5,318,787 | A | 6/1994 | Brauner | |
| 5,402,903 | A | 4/1995 | Mann | |
| 5,503,858 | A | 4/1996 | Reskow | |
| 5,573,131 | A | 11/1996 | Berjis | |
| 5,624,053 | A | 4/1997 | Freek et al. | |
| 5,720,555 | A | 2/1998 | Elele | |
| 5,743,423 | A | 4/1998 | Franco | |
| D397,911 | S | 9/1998 | Waldmann | |
| 5,954,195 | A | 9/1999 | Krueger et al. | |
| 6,003,671 | A | 12/1999 | McDonough et al. | |
| 6,079,586 | A | 6/2000 | Hanneman | |
| 6,085,919 | A | 7/2000 | Singer | |
| 6,119,884 | A | 9/2000 | Lowry | |
| 6,164,485 | A | 12/2000 | Hilton | |
| 6,209,748 | B1 | 4/2001 | Dunbar | |
| 6,299,014 | B1 | 10/2001 | Nava et al. | |
| 6,314,866 | B1 | 11/2001 | Melton | |
| 6,338,417 | B1 | 1/2002 | Ferraro | |
| 6,412,526 | B2 | 7/2002 | Castillo | |
| 6,425,480 | B1 | 7/2002 | Krueger et al. | |
| 6,427,864 | B1 | 8/2002 | Asselin | |
| 6,528,105 | B1 | 3/2003 | Gerhart et al. | |
| 6,557,698 | B2 | 5/2003 | Gordon | |
| 6,641,854 | B2 | 11/2003 | Gerhart | |
| 6,706,297 | B1 | 3/2004 | Toth et al. | |
| 6,708,735 | B1 | 3/2004 | Kenihan | |
| 6,793,075 | B1 | 9/2004 | Jeter | |
| 6,932,231 | B2 | 8/2005 | Haynes | |
| 7,063,229 | B2 | 6/2006 | Westerhof et al. | |
| 7,111,748 | B2 | 9/2006 | Cha | |
| 7,159,732 | B2 | 1/2007 | Smith et al. | |
| 7,217,434 | B1 * | 5/2007 | Loh et al. | 426/115 |
| 7,387,063 | B2 | 6/2008 | Vu et al. | |
| D590,662 | S | 4/2009 | Cheng | |
| 7,588,275 | B2 | 9/2009 | Borg | |
| 7,594,584 | B2 | 9/2009 | Durdon et al. | |
| 7,721,911 | B2 | 5/2010 | Chou | |
| D635,855 | S | 4/2011 | Smith et al. | |
| D637,079 | S | 5/2011 | Brown et al. | |
| 8,006,854 | B2 | 8/2011 | Waugh | |
| 2001/0035417 | A1 | 11/2001 | Kantor | |
| 2003/0089714 | A1 | 5/2003 | Dart et al. | |
| 2003/0178433 | A1 | 9/2003 | Adams | |
| 2004/0050724 | A1 | 3/2004 | Grul et al. | |
| 2004/0050847 | A1 | 3/2004 | Yoon | |
| 2004/0084452 | A1 | 5/2004 | Hsieh | |
| 2004/0089662 | A1 | 5/2004 | Smith et al. | |
| 2004/0149755 | A1 | 8/2004 | Olivar | |
| 2004/0182862 | A1 | 9/2004 | Scott | |
| 2004/0199639 | A1 | 10/2004 | Harris | |
| 2005/0035011 | A1 | 2/2005 | McRobbie | |
| 2005/0115845 | A1 | 6/2005 | Cho | |
| 2005/0178677 | A1 | 8/2005 | Morrow | |
| 2005/0178688 | A1 | 8/2005 | Hasson | |
| 2005/0205437 | A1 | 9/2005 | Huffman et al. | |
| 2005/0242105 | A1 * | 11/2005 | Homann | 220/840 |
| 2005/0269328 | A1 | 12/2005 | Crider et al. | |
| 2006/0060589 | A1 | 3/2006 | Lee | |
| 2006/0096983 | A1 | 5/2006 | Patterson | |
| 2007/0029322 | A1 | 2/2007 | Durdon et al. | |
| 2007/0278122 | A1 | 12/2007 | McCumber | |
| 2008/0023503 | A1 | 1/2008 | Freeman | |
| 2008/0099481 | A1 | 5/2008 | D'Amato | |
| 2008/0230541 | A1 | 9/2008 | Bayss et al. | |
| 2009/0065377 | A1 | 3/2009 | Olomi et al. | |
| 2009/0206089 | A1 | 8/2009 | Mueller | |
| 2009/0250479 | A1 | 10/2009 | Kaufman et al. | |
| 2009/0272390 | A1 * | 11/2009 | Blondeel | 131/231 |
| 2011/0114643 | A1 | 5/2011 | Bogdziewicz | |
| 2011/0168719 | A1 | 7/2011 | Lotterhos | |
| 2011/0198351 | A1 | 8/2011 | D'Amato | |
| 2011/0198355 | A1 | 8/2011 | Mullen | |
| 2011/0210126 | A1 * | 9/2011 | Vovan | 220/574 |
| 2011/0248033 | A1 | 10/2011 | Mehrvijeh | |
| 2011/0266295 | A1 | 11/2011 | Yacktman | |
| 2011/0284537 | A1 | 11/2011 | Cerasani | |
| 2011/0309093 | A1 | 12/2011 | Buck | |

OTHER PUBLICATIONS

International Search Report Dated Mar. 19, 2013, 14 pages.

International Preliminary Report on Patentability and Written Opinion received for PCT Application No. PCT/US2012/054032, dated Mar. 20, 2014, 10 pages.

International Search Report and Written Opinion issued for PCT Appl. No. PCT/US2013/070630, dated Mar. 13, 2014, 6 pages.

International Search Report and Written Opinion issued for PCT Appl. No. PCT/US2013/070632, dated Mar. 13, 2014, 6 pages.

International Preliminary Report on Patentability mailed Sep. 18, 2014 in PCT/US20131029188 (6 pages).

International Preliminary Report on Patentability mailed Mar. 20, 2014 in PCT/US2012/054032 (10 pages).

International Preliminary Report on Patentability mailed May 28, 2015 in PCT/US2013/070630 (12 pages).

International Preliminary Report on Patentability mailed May 28, 2015 in PCT/US2013/070632 (12 pages).

International Preliminary Report on Patentability mailed Jul. 16, 2015 in PCT/US2014/010181 (6 pages).

International Search Report and Written Opinion mailed Jul. 11, 2013 in PCT/US2013/029188 (7 pages).

Prodekspo- 2012: TM "Zelenaya Soya"—razdelnaya upakovka dlya napitkov, Feb. 16, 2012, [online], [retrieved on Nov. 6, 2013). Retrieved from the Internet <URL: http://news.unipack.ru/38718/#comments.

* cited by examiner

FIGURE 2A
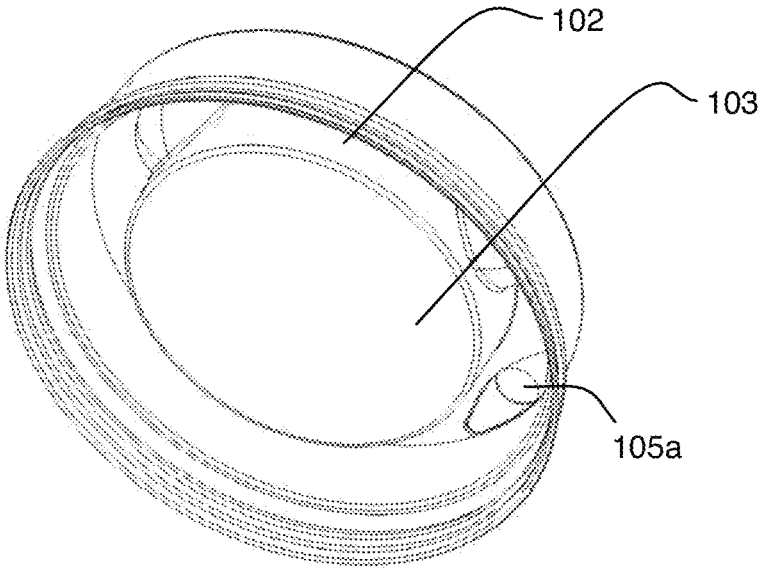
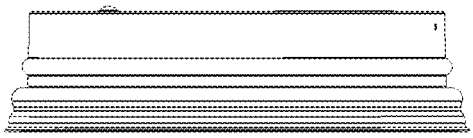
FIGURE 2B
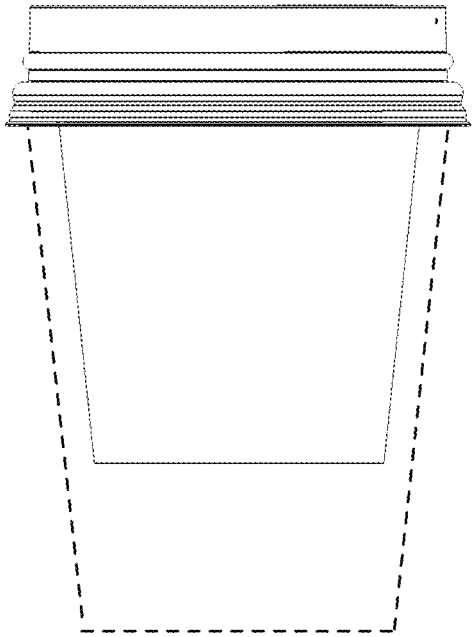
FIGURE 2C

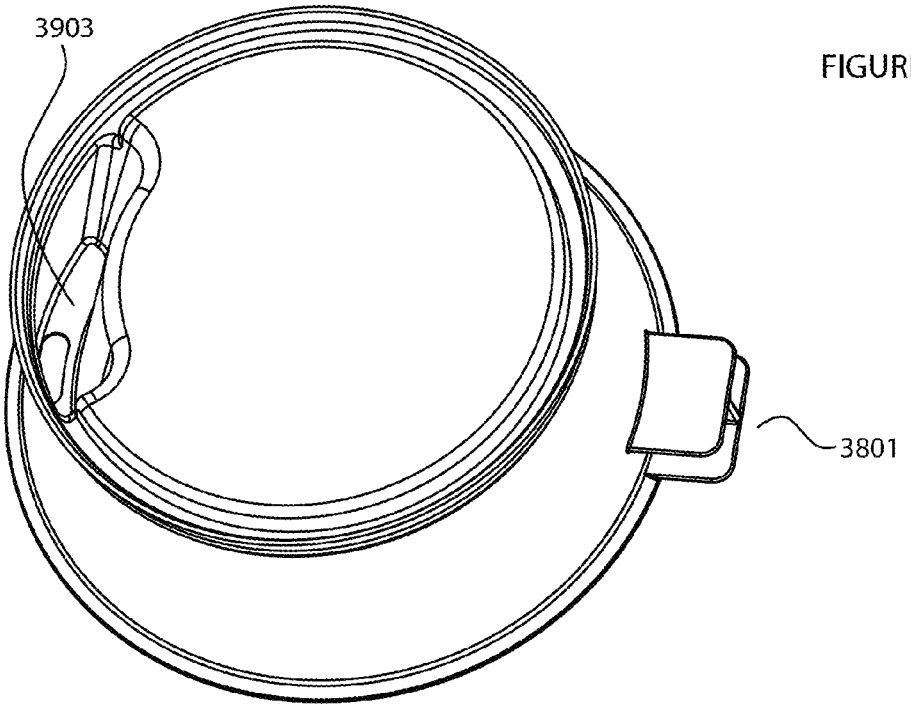
FIGURE 39
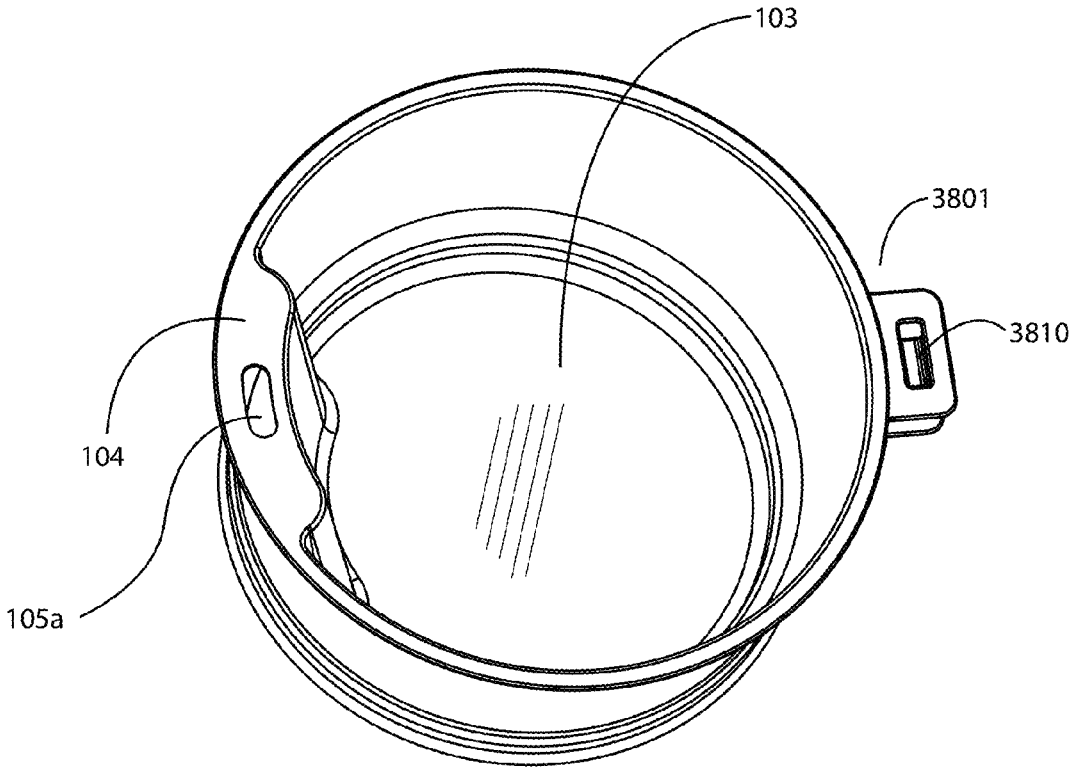

LID WITH INTEGRATED CONTAINER

This application is a divisional of U.S. Pat. No. 8,708,181, filed 6 Sep. 2012, which is a continuation in part of U.S. Pat. No. 8,381,935, filed 28 Jan. 2012, which is a continuation in part of U.S. Pat. No. 8,596,491, filed 6 Sep. 2011, the specifications of which are hereby incorporated herein by reference.

BACKGROUND OF THE INVENTION

1. Field of the Invention

One or more embodiments of the invention are related to the field of containers. More particularly, but not by way of limitation, one or more embodiments of the invention enable a cup lid or can lid with integrated container that enables, for example, simultaneous or intermittent access to the contents of the container and attached cup without disengagement of the cup lid from the cup or can. Additionally, an independent drop-in container may reside within the cup or can lid cavity such that, after partially consuming the contents of the independent drop-in container, it may be resealed with an additional lid, removed from the lid cavity and transported to another location such as a car or home.

2. Description of the Related Art

Standard cup lids are simple covers that do not include an integrated container. Rather, known lids cover the contents of a cup which forms a closed container in combination with the cup itself. Known containers that couple with cups include food containers that fit onto the top of yogurt cups, for example. Known containers have to be removed from the yogurt cup and then flipped over and opened before the contents of the container and cup may be accessed. It is generally not possible to access the contents of the cup while also accessing the contents of the container without first disengaging the container from the cup. Additionally, food containers that attach to yogurt cups in an upside-down position have a limited food-volume capacity. In such cases, as the yogurt example shows, the food-container walls narrow as they proceed upward toward the bottom of the upside-down container. Other known devices having a container or shelf combined with a lid have limitations, which make these devices impractical to use. One category of devices includes a container combined with a cup, but utilizes a hole in the middle of the lid. This makes it impossible to store in the container relatively circular items, i.e., non-ring or non-annular items having no central hole, such as hamburgers, cookies or muffins, for example. Another category of device includes a container combined with a lid, but does not allow for simultaneous access of the contents of the cup and the container at the same time, and does not allow for the container to be resealed or for a drop-in container to be removed from the container. Other devices that include drop-in functionality require removal of the container before accessing the contents of the cup. Yet these devices do not contemplate a drop-in container that is configured to fit into the armrest of a movie theater seat. Other devices have relatively small peel containers for pills such as mints and are not suitable for larger food items. Another category of devices utilizes dividers in the cup with access on each side of the cup. None of the known devices enable a container to be disengaged from the lid of the cup while retaining the lower lid on the cup. No known devices have a non-permanent or male/female bottom-oriented coupling system for coupling a container with the lid. Furthermore, there are no known rotational covers that enable or disable access to the liquid and/or solid in the cup or can as desired by the user while still allowing the user to access the first solid or liquid in the lid container.

Known containers that couple with bottles include gift containers that fit onto the top of bottles, for example. It is generally not possible to access the contents of the bottle while also accessing the contents of the gift container without disengaging the gift container from the bottle and then disengaging the lid of the bottle.

Thus simultaneous or intermittent access to the contents of known cups, bottles or cans and to the contents of an attached container is not practical for at least the reasons listed above. This makes for difficult drinking/eating of coffee, soda, snacks, popcorn, etc., in malls, fast food restaurants, theaters, amusement parks, sports stadiums or in any other venue. For example, this makes it difficult to eat and drink food in a theater or stadium with one cup holder per seat.

For at least the limitations described above, there is a need for a lid with an integrated container.

BRIEF SUMMARY OF THE INVENTION

One or more embodiments described in the specification are related to a lid with an integrated container, for use on cans or cups. Embodiments of the cup lid generally provide a cavity, compartment or closed space, wherein the cup lid is configured to couple with the top of a cup. One or more embodiments may include volumes that extend to, into, out of, or both into and out of the plane defined by the circular top of the cup. In this manner, the cup and lid form at least two containment volumes, one volume formed by the bottommost portion of the cup lid and the inner walls of the cup, and another volume within the upper cup lid itself. In relation to the volume within the lid, the contents within this volume may be accessed, partially consumed, replaced (such as a cookie), and resealed within the volume through various secondary lid configurations, and this may be done at any time as desired by the user. Embodiments of the invention enable easy containment, inclusion of fresh foods, transportation and simultaneous or intermittent access to a solid or liquid in the container with a solid or liquid held in the cup, without requiring disengagement of the cup lid from the cup. Additionally, a separate and independent drop-in/removable pre-sealed container may reside within the cup lid cavity such that after removing the pre-sealed cover and partially eating from a movie theater cup, for example, the user can then reseal the independent container and remove it from the lid cavity and take it to another location such as a car or home. Can embodiments generally do not extend downward into the plane defined by the circular top of the can, but may extend straight up or outward at any diameter or slope as desired. Embodiments of the invention may be utilized on either cans or cups as desired, and example embodiments illustrated herein may be utilized on either a can or cup, as one skilled in the art will recognize, even though a particular embodiment may be described with respect to a can or cup.

Embodiments of the invention may be made to fit any cup or can size, for example, a paper coffee cup, and may be quickly attached and removed from the cup or can. Embodiments may be constructed from vacuum, thermal or injection-molding techniques or in any other manner as desired. An injection-molded container generally provides more volume than a thermoformed container due to the fact that, with a thermoformed container, the sidewalls of the container generally must draft inward as they proceed upward toward the top edge of the lid/container (a typical requirement for releasing from a mold). In contrast, use of injection-molding enables the sidewalls to draft outward as they proceed upward toward the top edge, therefore providing a larger circular diameter of the top edge of the container, which translates to a larger food or liquid volume capacity within the top container that attaches to the cup. Any type of material may be utilized in the construction of one or more embodiments of the invention, for example, plastic or polymer. One such plastic may be clear or opaque or any level of translucency. Materials may be chosen for strength and function as required. Common thermosetting polymers include epoxy and phenolic materials. Thermoplastic materials that may be utilized include polypropylene, nylon, polyethylene and polystyrene, for example. Alternatively, additional configurations may utilize paper, hard-molded plastic, ceramic, metal (for example, stainless steel), and silicon. Coffee cup lids are generally white or black while most soda or drink cup lids are clear. Any colors or color combinations may be used. One or more embodiments may utilize components of different translucent values, for example, a bottom compartment of the container may be white, while the seal-on/peel-off cover or press-on friction cover portion of the container may be clear so that the contents of the container may be viewed without opening the container. The cavity may contain a thermal liner, for example, Styrofoam for cold items such as ice cream or frozen yogurt or alternatively for hot items such as sliders, hamburgers, chili or soup. The cavity may contain a paper liner with an optional ruffled edge to act as a barrier between a cookie, for example, and the plastic which forms the inner wall of the lid cavity. The cavity may include a single or double wall for extra insulative effect or for any other reason. Thermal sensitive plastics, for example thermochromics, may also be utilized to show how hot or cold the item in the container is. These types of plastics change color, for example, based on their temperature. Graphic symbols, for example bar codes, arrows and/or letters or any other informative element that, for example, read "Caution Contents Hot", may be displayed, for example, when the thermochromic is hot, for example in red, wherein the letters would not be shown otherwise, or would be shown in blue, for example, if the contents of the container were not hot. These colors are exemplary and any color including transparent may be chosen to represent hot and cold in any embodiment of the invention. For embodiments that do not utilize thermochromic materials, any graphical symbols or lettering may be utilized to warn or inform a potential user. Graphical symbols and/or lettering may be placed on the cover or sides, or inside of the container or in any other area that may be viewed or touched, including but not limited to the cover, for example. Graphical symbols and/or lettering may include logos, advertisements, bar codes, puzzles, promotions, trivia or any other type of information that is viewable, and may include tactile information including Braille.

The vertical dimension of the cavity may vary from a low, for example, about a half an inch when the container is configured to hold a cookie, to a medium, for example, about one and a half inches when the container is configured to hold a doughnut, or high, for example, up to or more than four inches when the container is configured to hold frozen yogurt, ice cream, a hamburger, French fries, or a sandwich. As one skilled in the art will appreciate, any desired dimension of the container may be utilized as desired for the particular application. The horizontal dimension of the container may be of a width less than, equal to, or greater than the diameter of the cup measured across the plane formed by the top of the cup opening. When the horizontal dimension of the container is less than the diameter of the cup opening, then the vertical offset of the dimension may extend downward into the main volume of the cup. Other embodiments enable containers having a horizontal dimension less than, equal to, or greater than the diameter of the cup opening to reside on top of the plane defined by the cup opening. Other embodiments of the container may include portions having a smaller horizontal dimension to extend into the main volume of the cup and a portion of the container that is smaller, equal to, or larger that also extends above the plane defined by the cup opening. Embodiments may be constructed from one or more parts. In the case of an embodiment having a container that extends above, and in some instances below, the horizontal plane of the cup top, two elements may be fused or permanently bonded together, for example, or molded or formed as a single unit, or may be two separate units that clip or lock together, e.g., through mating parts, or in any other manner. The shape of the container may be of any type; circular, oval, triangular, square or a polygon of any number of sides, or any other shape.

One or more embodiments of the invention may optionally include indented cutouts to facilitate lifting of the item or items from within the cavity. For example, an embodiment with at least one indented cutout allows for a finger to be inserted into the cavity in order to provide a lifting force to the item in the cavity. More than one indented cutout, for example, may be included so that opposing locations in the cavity may be employed to lift the item from the cavity as desired. Indented cutouts can also be integrated such that uniform or level stacking may be achieved for ease of storage. Embodiments having three indented cutouts, for example, stack evenly regardless of initial positioning; however, this is merely an exemplary embodiment, as other embodiments may be formed to readily stack as desired.

One or more embodiments of the invention may employ a hole such as a sip/gulp hole or straw hole, for example, so that liquid in the cup may be accessed without removing the container. Any shape of hole or any shape straw, i.e., oblong from a cross-sectional view, for any purpose, may be utilized as desired. Embodiments employing a hole may make use of a hole in the horizontal top surface of the container, or at the base of the container in the horizontal surface adjacent to the outer perimeter of the cup lid, when the container bottom is sufficiently smaller than the diameter of the cup rim, or on a vertical wall of the container, for example, so that oversize containers may be utilized that, for example, have a larger diameter than the diameter of the cup rim. For example, one embodiment of an oversize container allows for a hamburger or French fries to be placed on top of a soda or beer cup. In this latter configuration, a tri-bend straw is provided to effectively follow the contour of a larger container, located directly above, before heading diagonally upward toward the user.

Although the top container may be heat fused or permanently bonded to the cup lid, or made from a single molded or thermal-formed unit, for example, in the case of the large container configuration where the straw exits the vertical side wall, the large container may clip or couple to the cup lid below via a bottom oriented male/female coupling system or a vertical wall male/female ridge coupling system. Such clip, ridge or coupling systems as mentioned here provide for removal and reattachment of the top container to the cup lid, as desired by the user.

Embodiments of the invention may utilize a lid to cover the container, wherein in effect, a cup that is coupled with an embodiment of the invention effectively has two lids, one for the container and one formed by the container with the cup. To avoid confusion, "cover" as utilized herein refers to the lid for the container. Embodiments of covers include seal-on/peel-off, press-on, i.e., external and/or internal wall friction, press-on friction dome, rotational, hinge, clamshell, or swivel types of covers. Seal-on/peel-off covers may be configured using a thermal bonding process of similar or compatible materials (foil is an example of one option, and if a plastic or plastic composite, i.e., more than one layer, is utilized, any opacity or transparent or translucent characteristic may be utilized as desired), or may utilize an adhesive that allows the cover to be removed permanently or temporarily (cover may be resealed to the cup lid with cavity or the independent drop-in/removable container as desired), depending on the adhesive, to access the cavity. Seal-on/peel-off covers may be optionally scored such that only a specific portion of the entire lid is removed when pulling or lifting the removal tab. Press-on friction covers are generally plastic covers that may be removed and placed back on the cavity, for example, when placing fresh foods such as cookies within the cavity, or if the contents of the container have not all been removed. Seal-on/peel-off and press-on friction covers may be utilized in combination, so that after the press-on friction cover and seal-on/peel-off covers are removed, exposing the contents of the container, then the press-on friction cover may be placed over the container again to enclose the contents of the container, for example. Press-on friction dome covers, for example, may also include a hole on top that enables a spoon, fork or other utensil such as chopsticks or any other utensil to access food, such as frozen yogurt or fruit, within the container. Press-on friction covers may also include an adjustable open/close sip-hole or straw hole. Press-on external and/or internal wall friction covers may engage or couple in any manner that utilizes friction for the coupling. Press-on friction-type covers may be implemented with a flat portion that is hinged at any peripheral location of the container that allows the lid to flex open in a clamshell fashion, exposing the contents of the container, while retaining the cover such that it remains attached to the exterior wall of the container. Lids or covers that act to contain the contents of the lid container/cavity are optional, such that the contents may reside within the lid container/cavity without a cover as to enable immediate access to the contents.

Items suitable for placement within the container include solids or liquids. For example, items may include any combination of one or more solid and/or liquid alone or in combination. Example items include one or more cookies, doughnuts, chocolates, chips, crackers, nuts, popcorn, candies, ice cream, frozen ice, ice coffee, frozen yogurt, cream, water, soda or coffee, fruit pieces, burgers, French fries, sandwiches, or any other solid or liquid. Items that may be sealed in and stored for use or purchase may be refrigerated after sealing if necessary, or items that are selectively prepared or fresh can be placed into the container and may utilize the press-on friction cover embodiment if desired based on the particular application.

Embodiments of the invention allow for one-handed transportation and simultaneous or intermittent access to the contents of the cup and container without disengaging the cup lid from the cup. As specified here in, a clip-on male/female coupling system of engagement of the container to the lid below may be utilized, which allows the user to remove or reattach the top container as desired. Additionally, the contents of the lid container may be accessed, and partially consumed, then replaced within the container (a cookie, for example) and resealed through various secondary lid configurations at any time as desired by the user. A movie-theater configuration enables an independent drop-in container to reside within the cup lid cavity such that after partially consuming the contents of the independent drop-in container, it may be resealed with an additional lid and removed from the cup lid cavity and transported to another location such as a car or home. Independent drop-in pre-sealed cup style containers are extremely efficient and compatible with various configurations described herein, due to the fact that after automated machinery (such as Oyster machinery) fills and seals these containers, they can be easily transported to any location and then simply dropped into the lid cavity as specified per configuration as set forth herein. Various embodiments allow for ease of carrying and drinking/eating coffee, soda, cookies, snacks, etc., in malls, fast food restaurants, theaters, amusement parks, and sport stadiums or in any other venue. For example, this allows a parent in an amusement park to carry food and beverages with one hand, while at the same time providing one hand free to hold the hand of a child for safety. In addition, embodiments of the invention simplify eating and drinking by combining these processes into one container and cup, which is significantly more convenient in theaters or stadiums having seats which, for example, provide a single cup holder per seat.

BRIEF DESCRIPTION OF THE DRAWINGS

The above and other aspects, features and advantages of the invention will be more apparent from the following more particular description thereof, presented in conjunction with the following drawings wherein:

FIG. 2A illustrates a bottom perspective view of an embodiment of the invention, FIG. 2B shows a side view of an embodiment of the invention having a vertical dimension that extends to the plane of the cup opening, and FIG. 2C shows a side view of an embodiment of the invention having a vertical dimension that extends down into the plane of the cup opening.

FIG. 39 illustrates a top and bottom perspective view of the lid/container embodiment of FIG. 37.

DETAILED DESCRIPTION OF THE INVENTION

A lid with integrated container will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
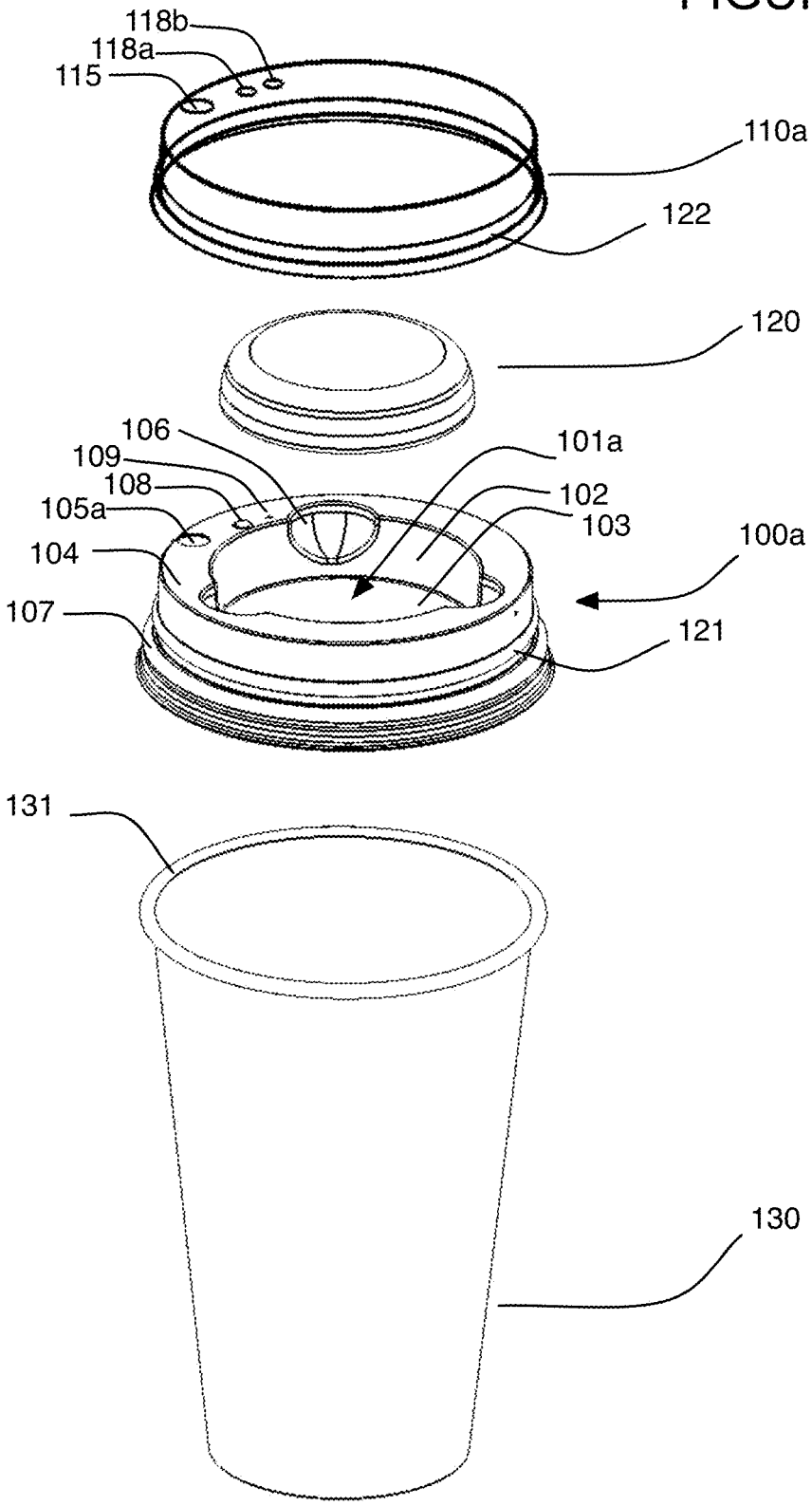
FIG. 1 illustrates an exploded view of an embodiment of the cup lid with integrated container above a cup, along with a food item and a cover.

FIG. 1 illustrates an exploded view of an embodiment of cup lid 100*a* with integrated container or cavity 101*a* shown above cup 130, along with any solid/liquid 120 or food item such as a cookie, for example, that fits in cavity 101*a*, and cover 110*a* that covers the food item while the food item is in container 101*a*. Cup lid 100*a* includes coupling element 107 that allows the cup lid to couple with the cup.

Cup lid 100*a* includes at least one wall 102, for example, that leads to container bottom 103, which, for example, may also be considered part of wall 102. As used herein, the term "wall" is not limited to a surface of any shape, but rather refers to the separation between container 101*a* and the contents of cup 130. Specifically, embodiments of the invention include at least one wall that defines container 101*a* that is configured to store a first solid or a liquid separate from a second solid or liquid stored in cup 130 wherein cup 130 generally includes an annular opening that lies in a plane on top of the cup. The cup as shown also includes a rolled rim 131 that coupling element 107 is configured to couple with to hold cup lid 100*a* onto cup 130. Specifically, coupling element 107 is configured to couple at least one wall to the annular opening on top of said cup, for example by stretching over the smaller diameter portion of the coupling element to allow the rolled edge of the cup to fit into the slightly larger diameter portion of the cup lid. Coupling element 107 is an exemplary form of attachment and any form of attachment may be utilized to couple cup lid 100*a* to cup 130, as one skilled in the art will appreciate, including, for example, a coupling element that includes a more difficult type of coupling to remove, or even a permanent coupling. Container cover 110*a* is optionally configured to couple via coupling element 122 to coupling element 121 of cup lid 100*a*. An alternative is to extend the vertical sidewall of 110*a* such that coupling element 122 is configured to couple to coupling element 107 of cup lid 100*a*, for example.

Horizontal area 104 includes hole 105*a*, for example, for a straw or sip hole, and optional indented cutouts 106. Optional elements include rotation indexer 108 and air hole 109. Rotation indexer 108 is described below with respect to its relation to cover 110*a*. Other optional elements may include optional indicators not shown for brevity, for example, configured to press in to show whether the contents of cup 130 are, for example, diet/regular soda or caffeinated/decaffeinated, or to show any other information in a tactile or visible manner.

At least one wall is configured to enable access to the first solid or liquid and the second solid or liquid without disengagement of the coupling element. For example, the contents of both integrated container 101*a* and cup 130 are accessible without removing the cup lid. This greatly simplifies eating and drinking in cars, theaters and sport stadiums, for example, that are equipped with one cup-holder per seat.

Cover 110*a* as shown is configured as an external wall friction press-on cover, but may also be configured as a seal-on/peel-off, press-on friction dome, press-on friction dome with hole, internal and external wall friction press-on, internal wall friction press-on, hinge or rotational cover, so long as the cover is configured to at least partially enclose the container and retain the contents of the container when the cover is coupled with corresponding version of the cup lid. As shown, cover 110*a* includes hole 115 to allow access to hole 105*a* when cover 110*a* is coupled with cup lid 100*a*, and cover 110*a* may also include holes 118*a* and 118*b* that provide discrete rotation values for cover 110*a* when one or the other hole is rotated over the top of rotation indexer 108 on cup lid 100*a*. In one angular rotation, hole 105*a* is open for access and in the other angular rotation, hole 105*a* is thus closed by cover 110*a*. When open, i.e., when hole 105*a* is exposed through cover hole 115, air hole 109 is exposed via hole 118*b* and when closed, air hole 109 is also closed by cover 110*a*.

FIG. 2A illustrates a bottom view of an embodiment of the invention. At least one wall 102 includes a vertical dimension that extends to, into, out of, or both into and out of the plane defined by the annular opening of the cup. Even though FIGS. 1 and 2A-B show a limited depth container 101*a*, it is noted that this depth may be large enough to hold a typical amount of popcorn in the container while the cup holds a typical amount of soda in the cup as is shown in FIG. 2C. FIG. 2B shows a side view of an embodiment of the invention having a vertical dimension that extends down to the plane of the cup opening. This embodiment, for example, may be utilized to hold a cookie while cup 130 holds a cappuccino. FIG. 2C shows a side view of an embodiment of the lid container with a cup shown in dashed lines, having a vertical dimension that extends into the plane of the cup opening. This vertical dimension may be of any size and can be increased such that the embodiment, for example, may be utilized to hold popcorn while cup 130 holds soda. Furthermore, at least one wall 102 includes a horizontal dimension, for example, across the diameter of the container, having a width less than, equal to, or greater than a width measured across the annular opening of the cup. See also FIG. 12-D for embodiments wider than the opening of the cup, for example. The embodiment shown in FIG. 2C may itself hold popcorn and fit into a standard popcorn cup that is then utilized for soda, and/or may fit into a cup that has a narrower or stepped configuration on the bottom half of the cup so as to fit into a standard stadium or movie theater seat cup holder, for example. Any type of cup that allows for an embodiment of the invention to be utilized in conjunction with a cup holder for an automobile, or stadium seat, movie theater seat or any other type of cup holder is in keeping with the spirit of the invention.

Figure 3:
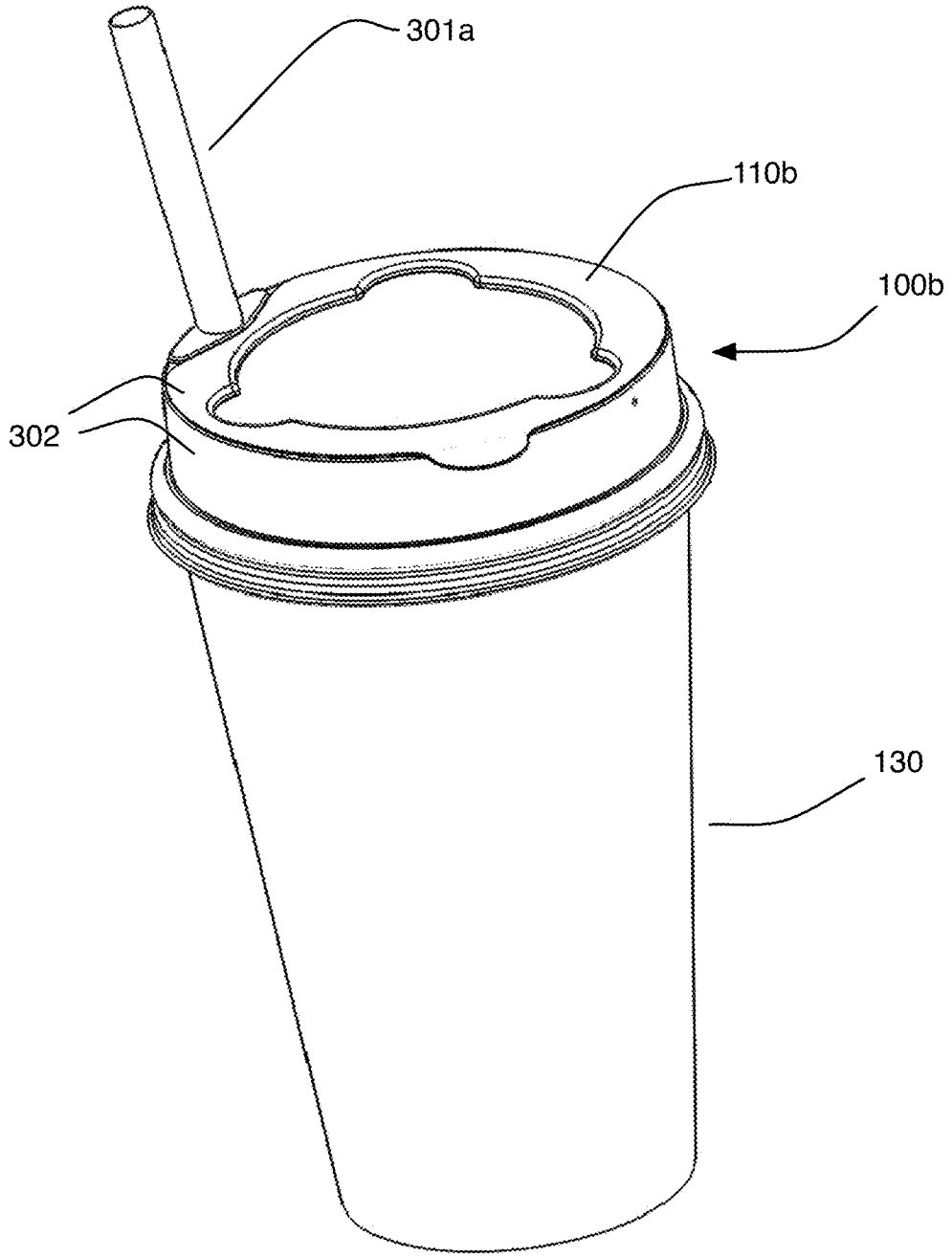
FIG. 3 illustrates a perspective view of an embodiment of the invention coupled with a cup, a seal-on/peel-off cover and configured to allow access to the contents of the cup via a straw.

FIG. 3 illustrates a perspective view of an embodiment of the invention 100*b* coupled with cup 130, seal-on/peel-off cover 110*b* and configured to allow access to the contents of the cup via straw 301*a*. The straw configuration is shown as one embodiment, although another embodiment may provide a sip hole or gulp hole, for example. Area 302 may include graphic symbols or lettering or both graphic symbols and lettering of visual or tactile form, or logos, advertisements, bar codes, puzzles, promotions, trivia or information or any combination of any information, including thermochromic materials that show different information based on temperature.

Figure 4:
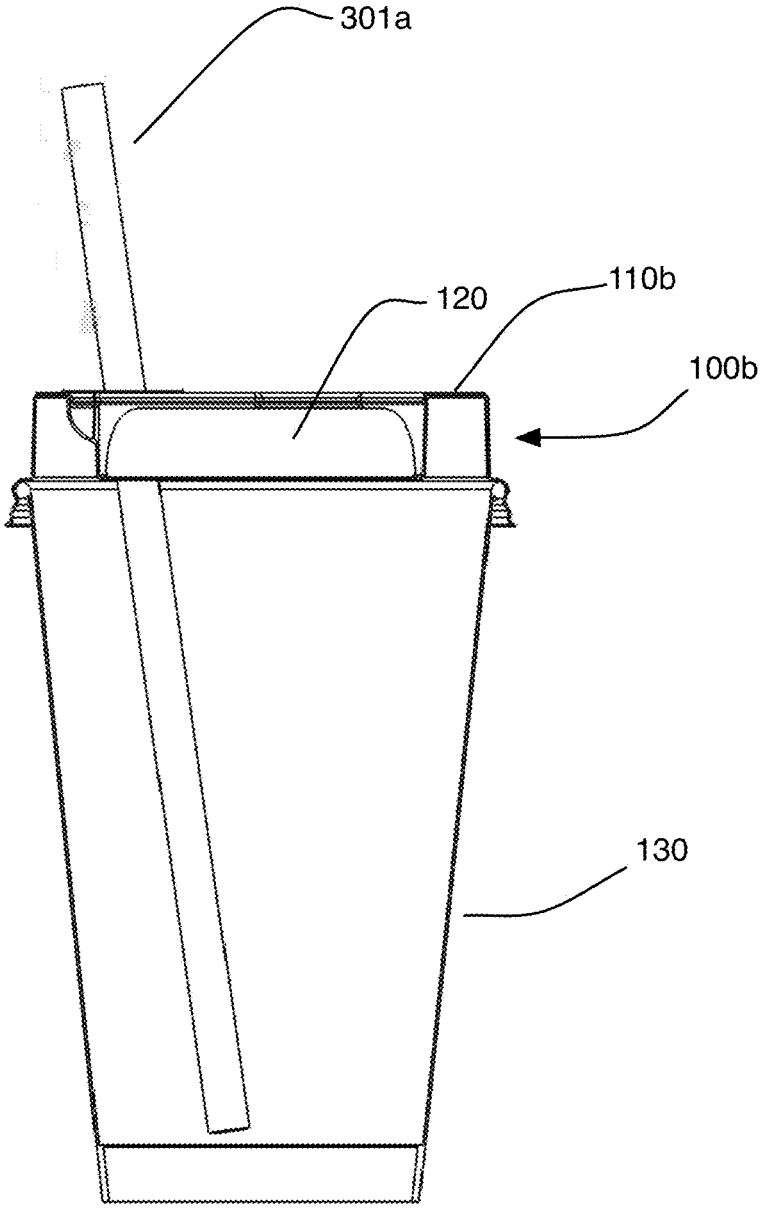
FIG. 4 illustrates a cross sectional view of FIG. 3.

FIG. 4 illustrates a cross sectional view of FIG. 3. As shown, the cup may be a soda, lemonade, coffee, or beer cup, for example, and is not limited to cups with a rolled rim, which are shown herein in an exemplary manner. One or more areas or walls may include a thermochromic plastic configured to change color based on a temperature of the first solid or liquid in the container. A first solid or liquid 120 may include any combination of one or more cookies, chocolates, chips, crackers, nuts, popcorn, candies, ice cream, frozen yogurt, fruit pieces, burgers, French fries, sandwiches, milk, cream or any other item. A second liquid or solid in cup 130 may include any combination of ice cream, milk shake, frozen ice, ice coffee, milk, lemonade, water, soda, coffee, beer, mixed alcoholic beverage, frozen ice, ice coffee, or any other item.

Figure 5:
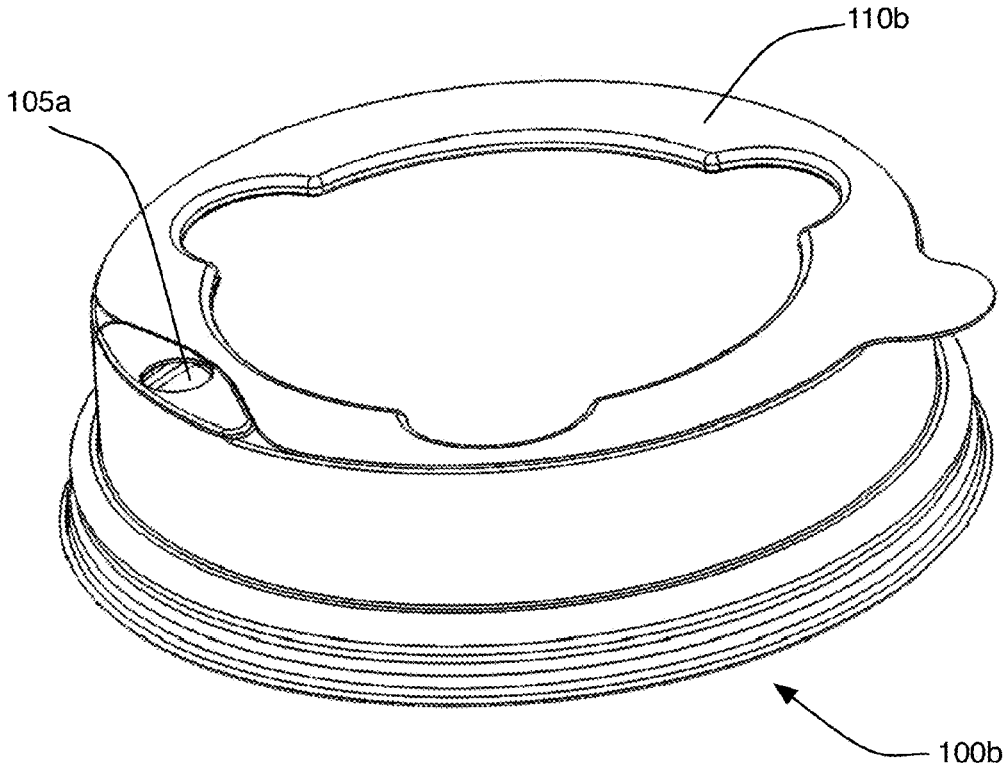
FIG. 5 illustrates a top perspective view of the embodiment shown in FIG. 3.

FIG. 5 illustrates a top perspective view of the embodiment of the invention shown in FIG. 3. The horizontal area on top of the embodiment shown includes hole 105*a* to allow access to the second liquid or solid, i.e., the contents of the cup. Without removing the cup lid, a person may also access the contents of the container on top of the cup. An optional vertical raised area surrounding the sip hole 105*a* is provided to elevate the sip hole area such that the user's lips do not come into contact with the potentially sharp edge of the container cover. The cover may optionally include any type of hole or cut out area such as a half oval, for example, that allows for hole 105*a* in the cup lid to be accessed. This is shown as a crescent indentation of cover 110*b* towards the centerline of the cup lid near hole 105*a*. Cover 110*b* is shown as vertically indented slightly downward to match the three finger indented cutouts in the cup lid. Vertically indenting the cover acts to locate the cover in a desired position; however this is not required, and cover 110*b* may be implemented in any shape including flat or planar embodiments as desired.

Figure 6:
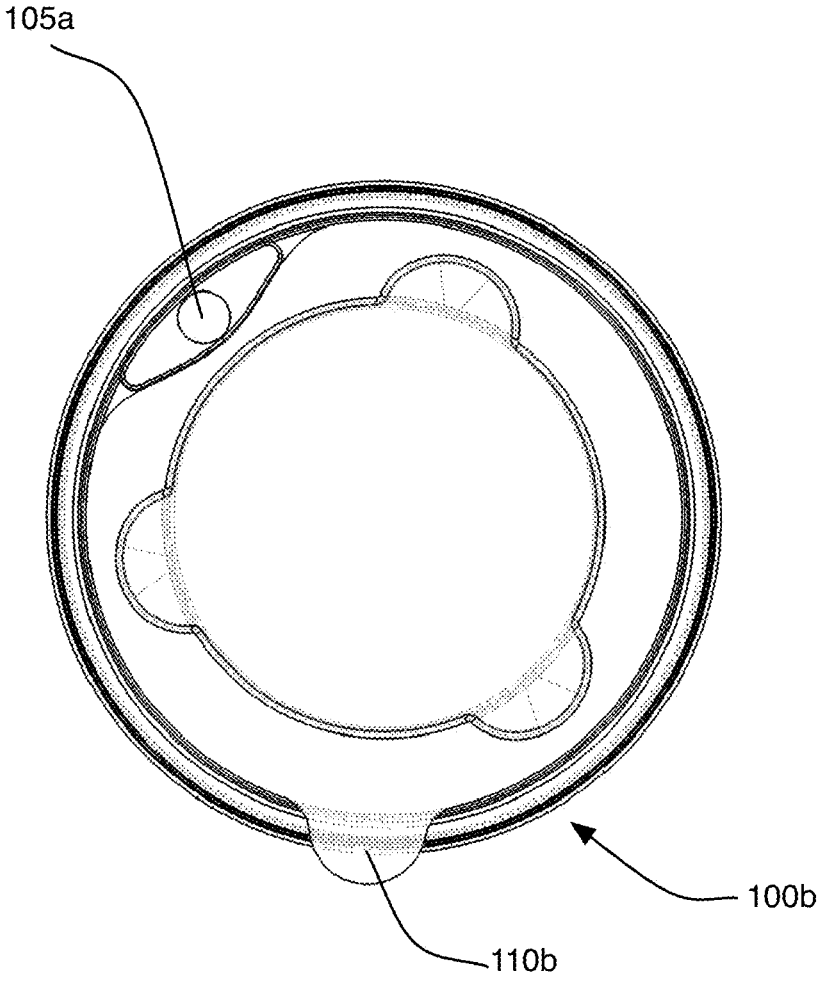
FIG. 6 illustrates a top view of the embodiment of the invention shown in FIG. 3.

FIG. 6 illustrates a top view of the embodiment of the invention shown in FIG. 3. The peel-off tab is shown at the bottom of the figure and allows for the seal-on/peel-off type cover 110*b* to be removed from the cup lid with cavity.

Figure 7A:
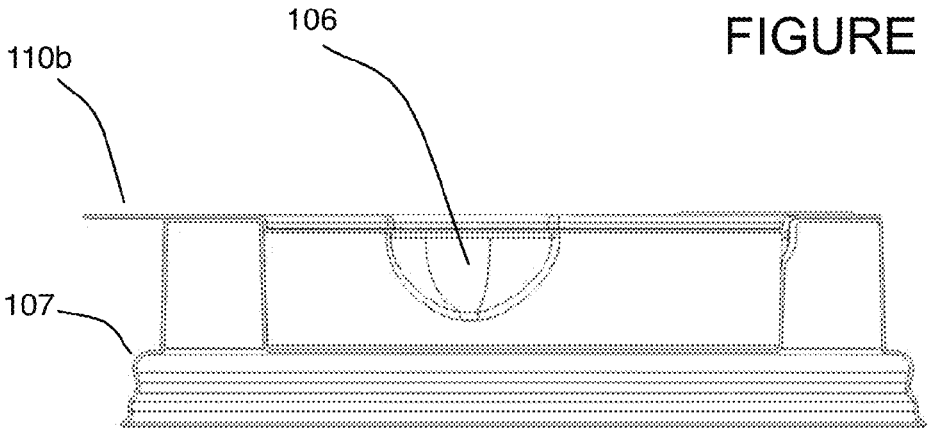
FIG. 7A illustrates a side cross-sectional view of the embodiment of the invention shown in FIG. 3.

FIG. 7A illustrates a side cross-sectional view of the embodiment of the invention shown in FIG. 3. Indented, cutouts 106 are configured to facilitate removal of items from within the container. The indented cutouts are not required as some types of items to be stored in the container may not need cutouts for finger access, e.g., ice cream. As shown the walls include two lines which may indicate a particular thickness of one wall or may indicated two or more walls to enable for more insulative embodiments.

Figure 7B:
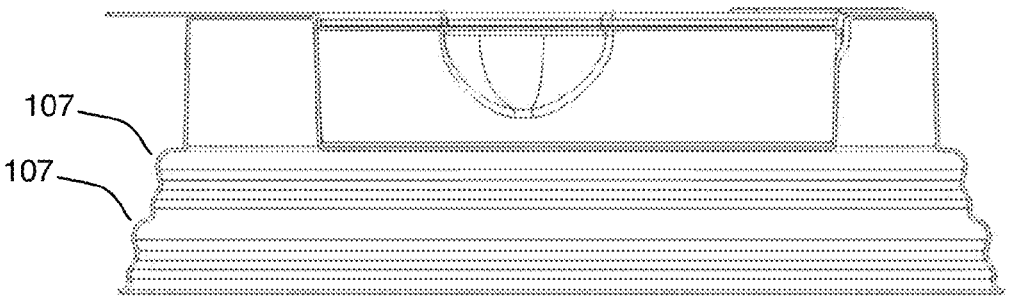
FIG. 7B illustrates a side cross-sectional view of the embodiment of the invention shown having two or more coupling elements configured to couple with cups of different sizes.

FIG. 7B illustrates a side cross-sectional view of the embodiment of the invention shown having two or more coupling elements configured to couple with cups of different sizes. In this figure, more than one coupling element, here 107, having different diameters are employed so that embodiments of the invention may fit different sized cups. For example, the embodiment shown in FIG. 7B may be sized to couple with large or small coffee cups or large or small soda cups. In addition, three or more coupling elements 107 may also be employed having three or more differing diameters, so that embodiments of the invention may couple with small, medium and large cups, as one skilled in the art will appreciate. In this manner, only one size of cup lid, albeit with as many diameter coupling elements as desired, may be utilized to accommodate the different sized cups utilized. Although the embodiment shown has vertically-offset coupling elements, other embodiments may utilize coupling elements that are horizontally offset without a vertical offset, as one skilled in the art will appreciate.

Figure 7C:
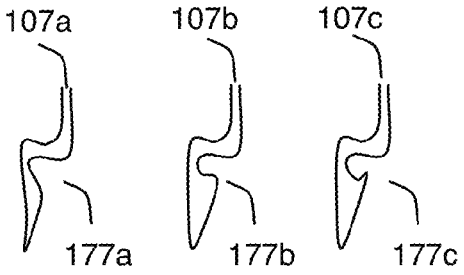
FIG. 7C illustrates different embodiments of coupling elements that may be utilized to attach the top container to the cup rim.

FIG. 7C illustrates different embodiments of coupling elements that may be utilized with embodiments of the cup lid. The cross section of coupling element 107*a* is similar to that of coupling element 107, and makes it easier to decouple from the cup lid based on the large angle at bend 177*a*. The cross section of coupling element 107*b* makes it harder-to-remove version of coupling element 107 based on the smaller angle at bend 177*b*, which requires more force to remove from the rolled edge of a cup, for example. The cross section of coupling element 107*c* shows a semi-permanent or permanent coupling element based on the hook-like sharp angle at bend 177*c*. Depending on the stiffness of the material utilized in construction of the cup lid, the sharp angle at bend 177*c* may allow for the entire cup, even if full of liquid, to be lifted by the cup lid. This prevents spills by keeping the cup lid and cup attached even with large forces involved. As one skilled in the art will appreciate, multiple-diameter coupling elements (as shown in FIG. 7B) on one cup lid may utilize any combination of the coupling elements 107*a*, 107*b* or 107*c* in any embodiment of the invention. For example, in one embodiment, the smallest diameter coupling element on the top portion of FIG. 7B may utilize coupling element 107*a* or 107*b* while the lower coupling element on the bottom portion of FIG. 7B may utilize coupling element 107*b* or 107*c*, for example, to allow for more strength for large cups that may weigh more. Any number of different diameters may be utilized with any embodiment of the coupling element and any other coupling element known in the art may be utilized if desired and based on the application, as one skilled in the art will appreciate.

Figure 8:
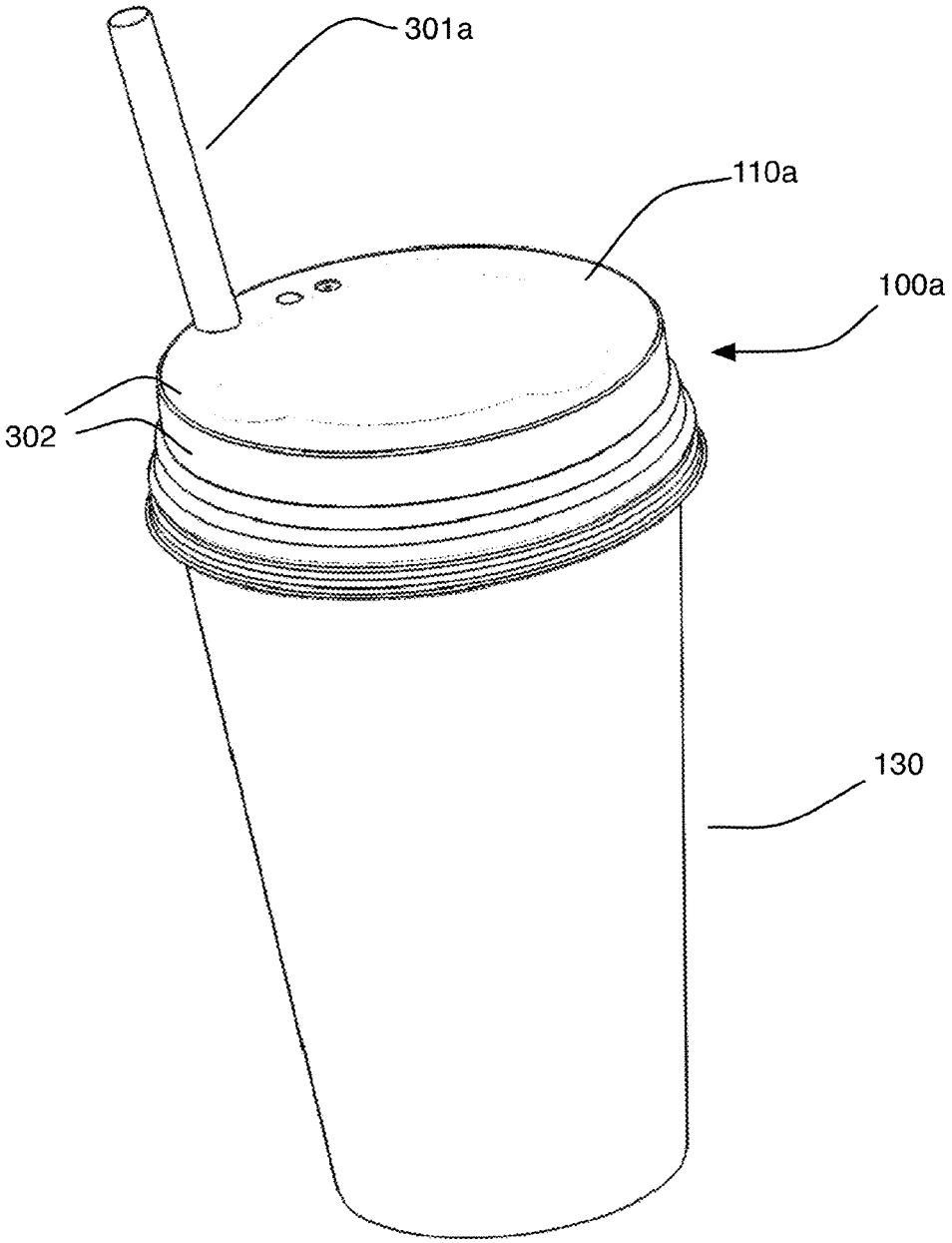
FIG. 8 illustrates a perspective view of an embodiment of the invention coupled with a cup, a press-on friction cover and configured to allow access to the contents of the cup via a straw.

FIG. 8 illustrates a perspective view of an embodiment of the invention 100*a* coupled with cup 130, press-on friction cover 110*a* and configured to allow access to the contents of the cup via straw 301*a*.

Figure 9:
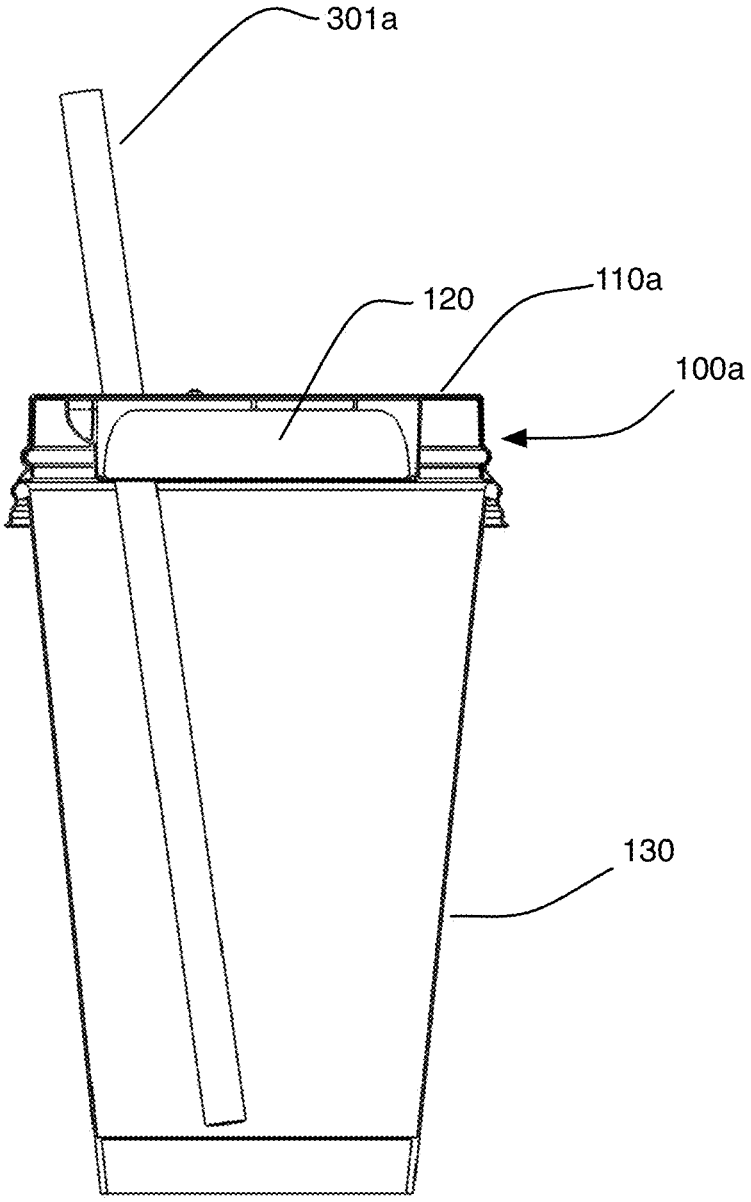
FIG. 9 illustrates a cross-sectional view of FIG. 8.

FIG. 9 illustrates a cross sectional view of FIG. 8. Press-on friction cover 110*a* extends down the sides of the cup lid to couple with the cup lid as is described in more detail below with respect to FIG. 10.

Figure 10:
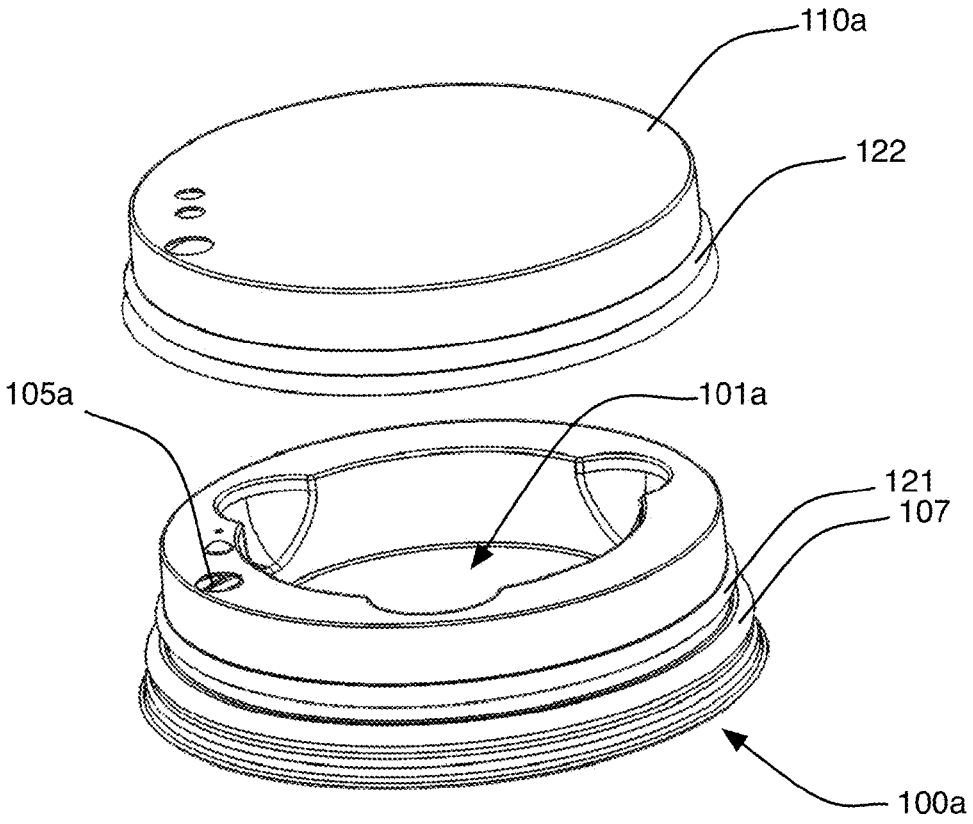
FIG. 10 illustrates a top perspective view of the embodiment of the invention shown in FIG. 8 along with an embodiment of a press-on friction cover.

FIG. 10 illustrates a top perspective view of the embodiment of the invention shown in FIG. 8 along with an embodiment of a press-on friction cover. As shown, cover coupling element 121 on embodiment 100*a* is optionally configured to couple with cover coupling element 122 on cover 110*a*. This allows for cover 110*a* to press onto cup lid 100*a* in a non-permanent manner that allows for cover 110*a* to be removed by pulling cover 110*a* vertically, as shown, with enough force to move cover coupling element 122 away from cover coupling element 121. An alternative is to extend the vertical sidewall of 110*a* such that coupling element 122 is able to couple to coupling element 107 on cup lid 100*a*.

Figure 11:
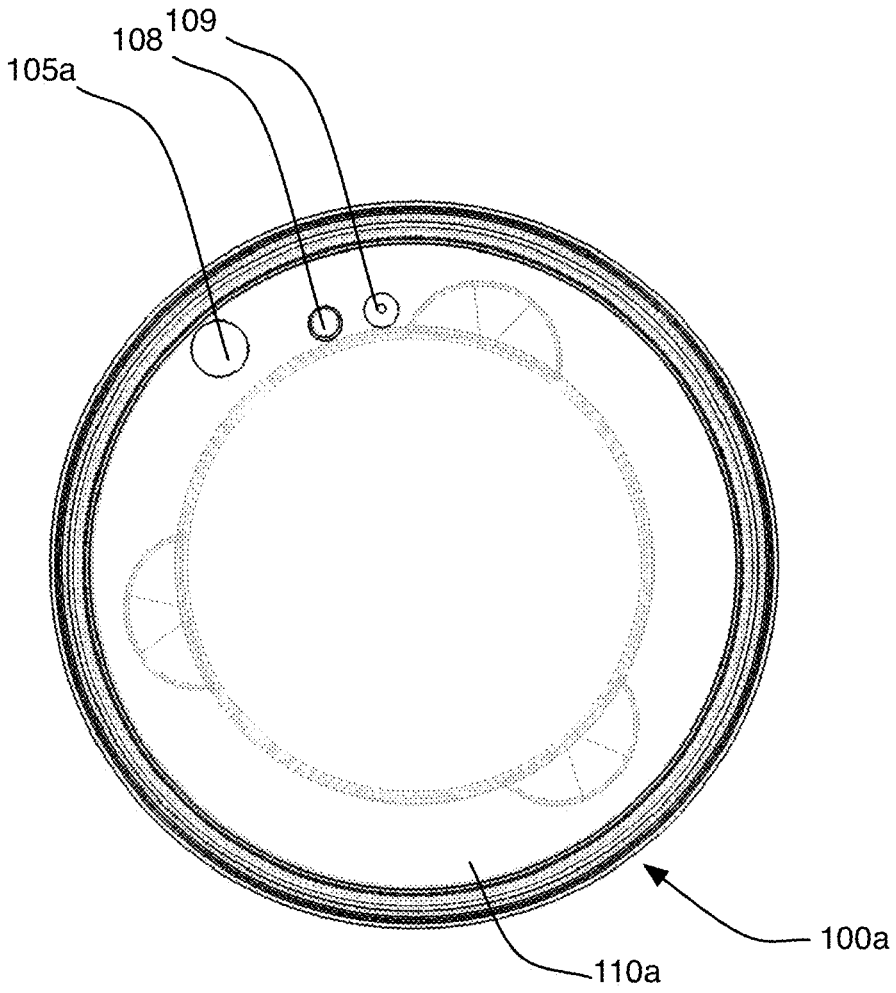
FIG. 11 illustrates a top view of the embodiment of the invention shown in FIG. 8 along with the open/close positioning holes for sealing off or providing access to the sip hole or straw hole.

FIG. 11 illustrates a top view of the embodiment of the invention shown in FIG. 8, depicting sip hole open/close rotation index 108, of which there are two in the embodiment shown, of which one is called out with reference number 108, the other of which is not called out for brevity, vacuum release pin hole 109 and hole 105*a*. Optional indicators may also be utilized on the top of cover 110*a* (not shown for brevity), which may be tactile or visual indicators of any information, including information as to whether the contents of the container or cup are of a certain type, e.g., chocolate/vanilla, caffeinated/decaffeinated, diet/regular, or any other information.

Figure 12A:
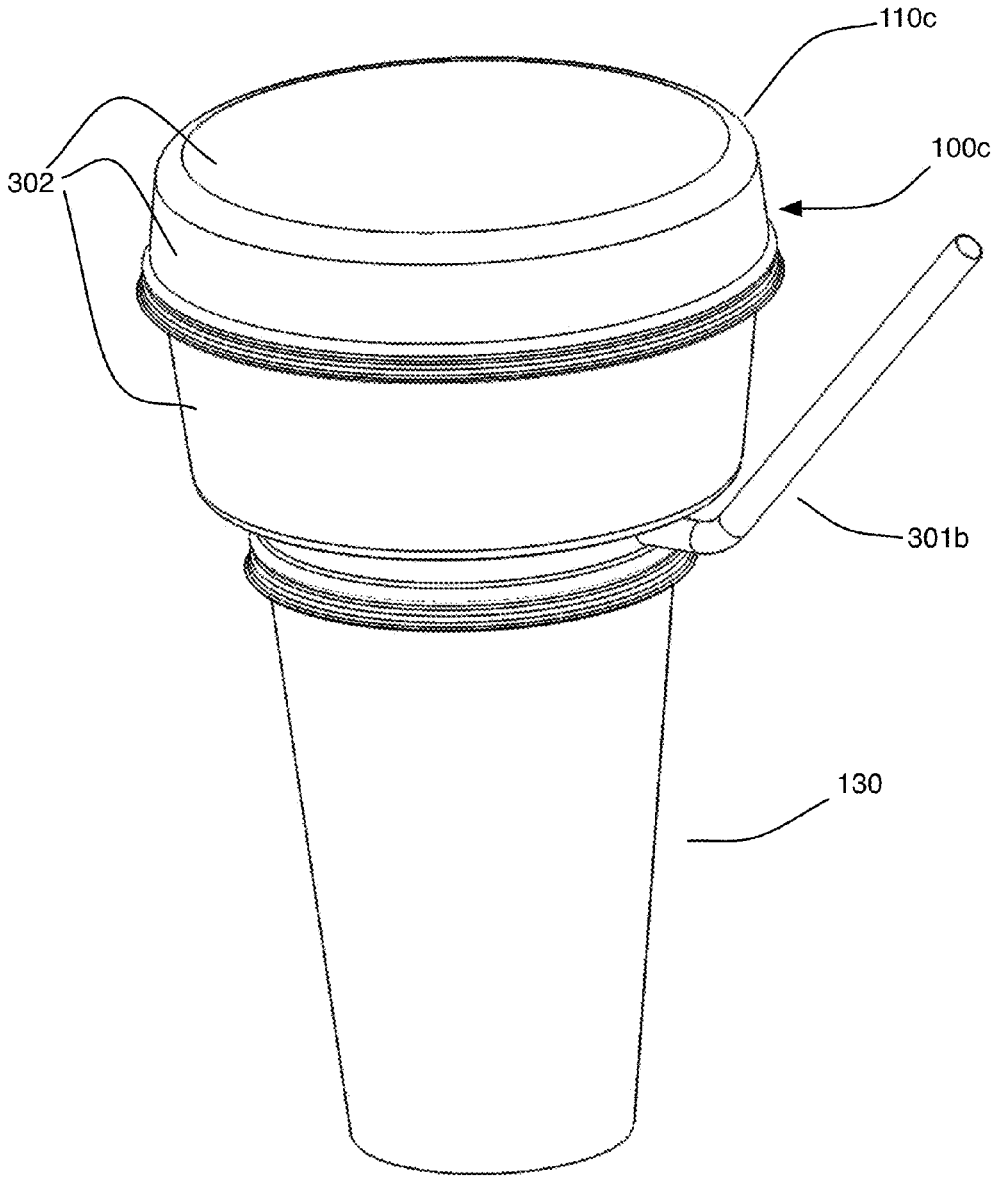
FIG. 12A illustrates a perspective view of an embodiment of the invention coupled with a cup, a container with an optional upper press-on friction dome-style cover and configured to allow access to the contents of the cup through a hole in a vertical sidewall in the bottom cup lid, via a straw.
Figure 12B:
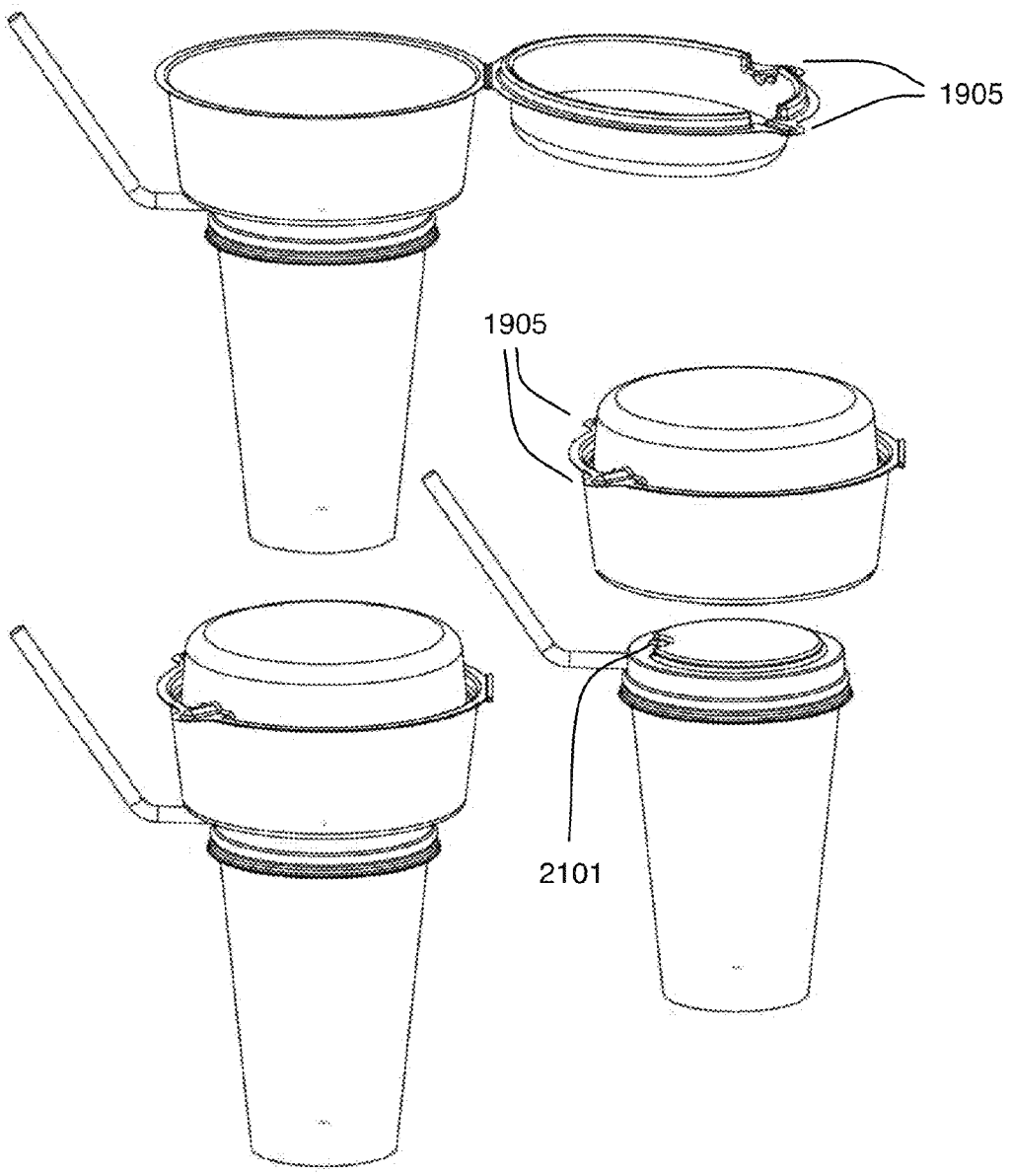
FIG. 12B illustrates a rotationally-aligned embodiment of the container of FIG. 12A employing a clamshell-style cover, to form a clamshell hinge container, with tabs for easy opening and wherein the clamshell-style cover is configured to open away from the straw and wherein the contents of the cup are accessed via a hole in a vertical sidewall of the bottom cup lid via the straw. In one or more embodiments, tabs include strengthening ribs that project relatively orthogonal to the plane of the tabs to provide for a stronger tab and/or enable use of thinner plastic or both. As shown.
Figure 12C:
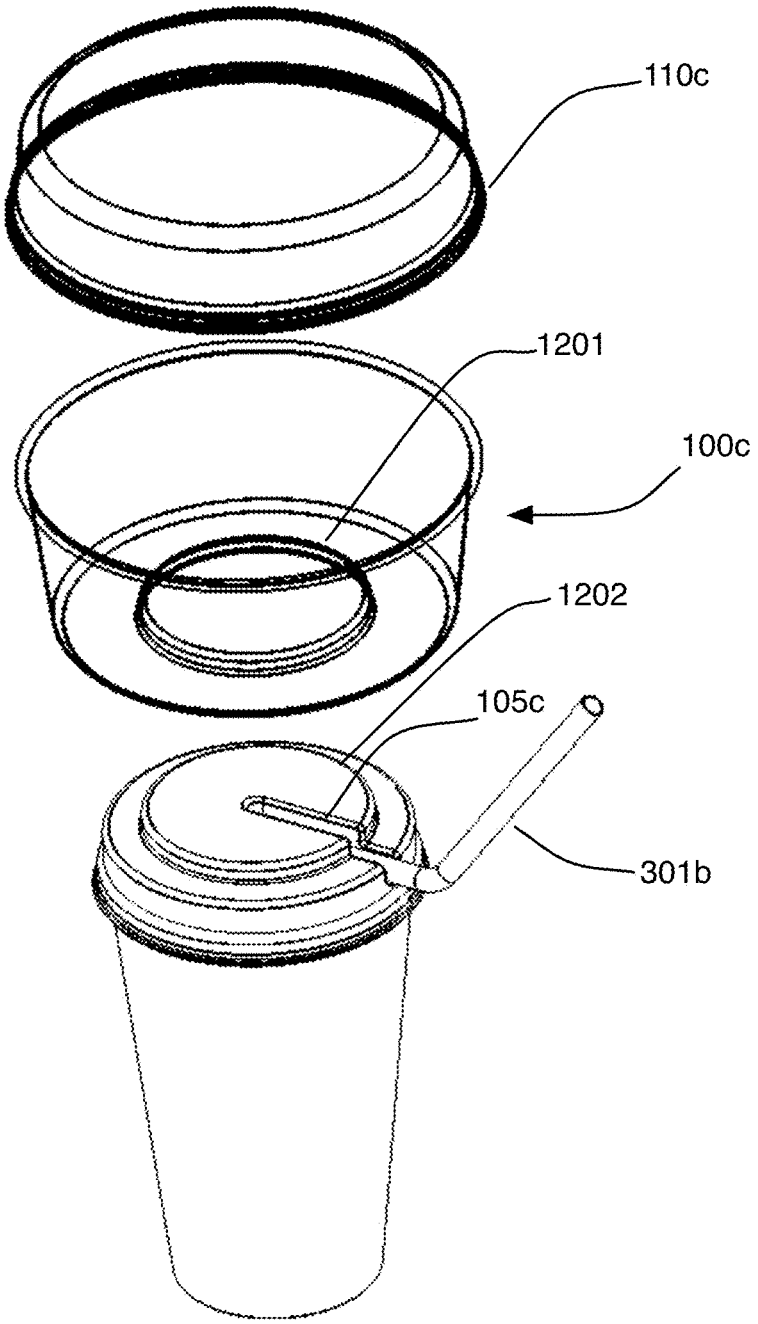
FIG. 12C illustrates an exploded view of a different embodiment of the base portion of the cup lid having a channel for the straw to travel up and out of the cup lid and a raised circular friction male/female coupling system that allows for the disengagement/reattachment of the top container to the cup lid below.
Figure 12D:
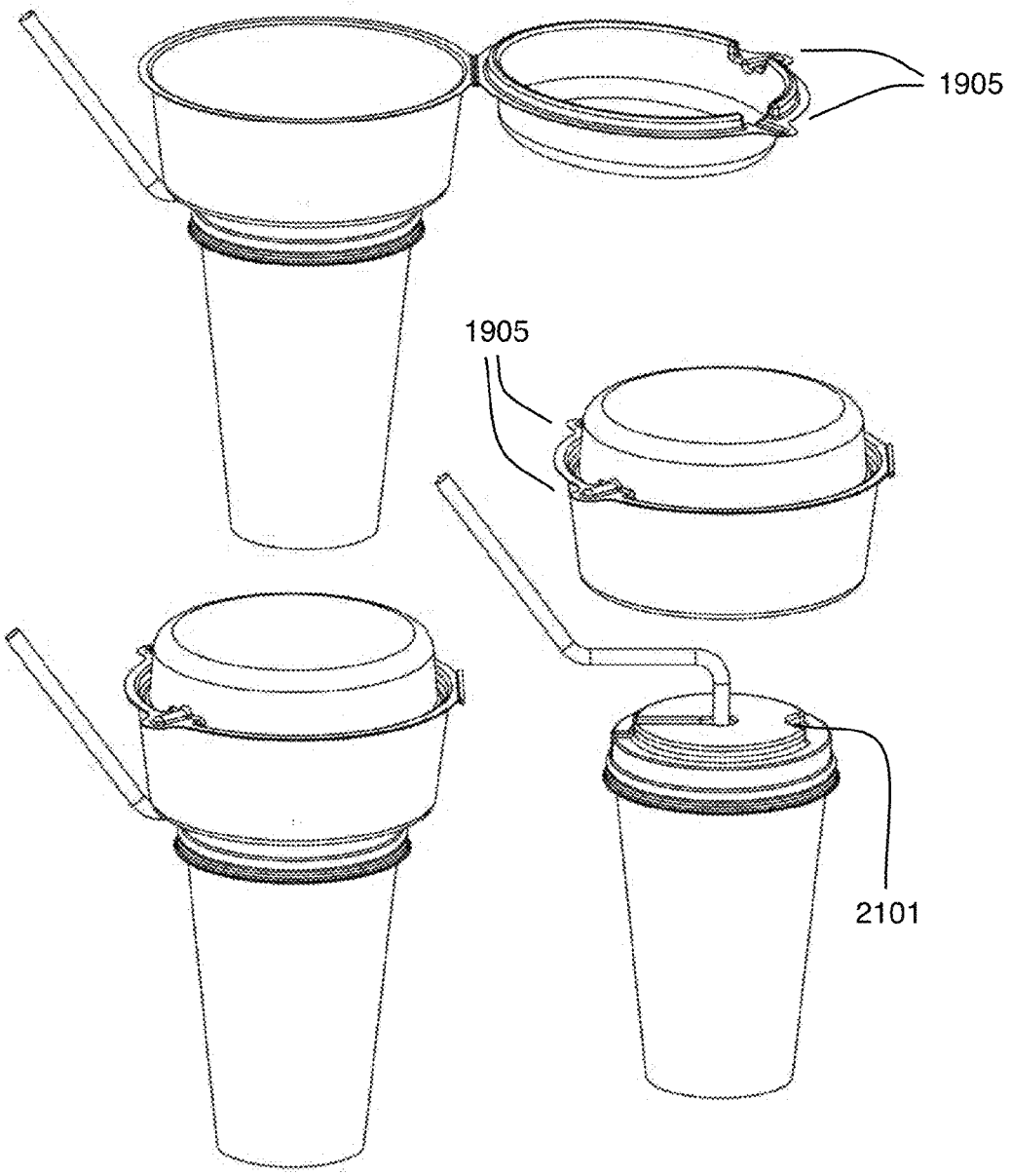
FIG. 12D illustrates a rotationally-aligned embodiment of the container of FIG. 12C that utilizes a clamshell-style cover with tabs for easy opening and wherein the clamshell-style cover is configured to open away from the straw, wherein the contents of the cup are accessed via a channel in a vertical sidewall of the bottom cup lid via the straw, and wherein the base portion of the cup lid utilizes the channel and coupling system of FIG. 12C.
Figure 19:
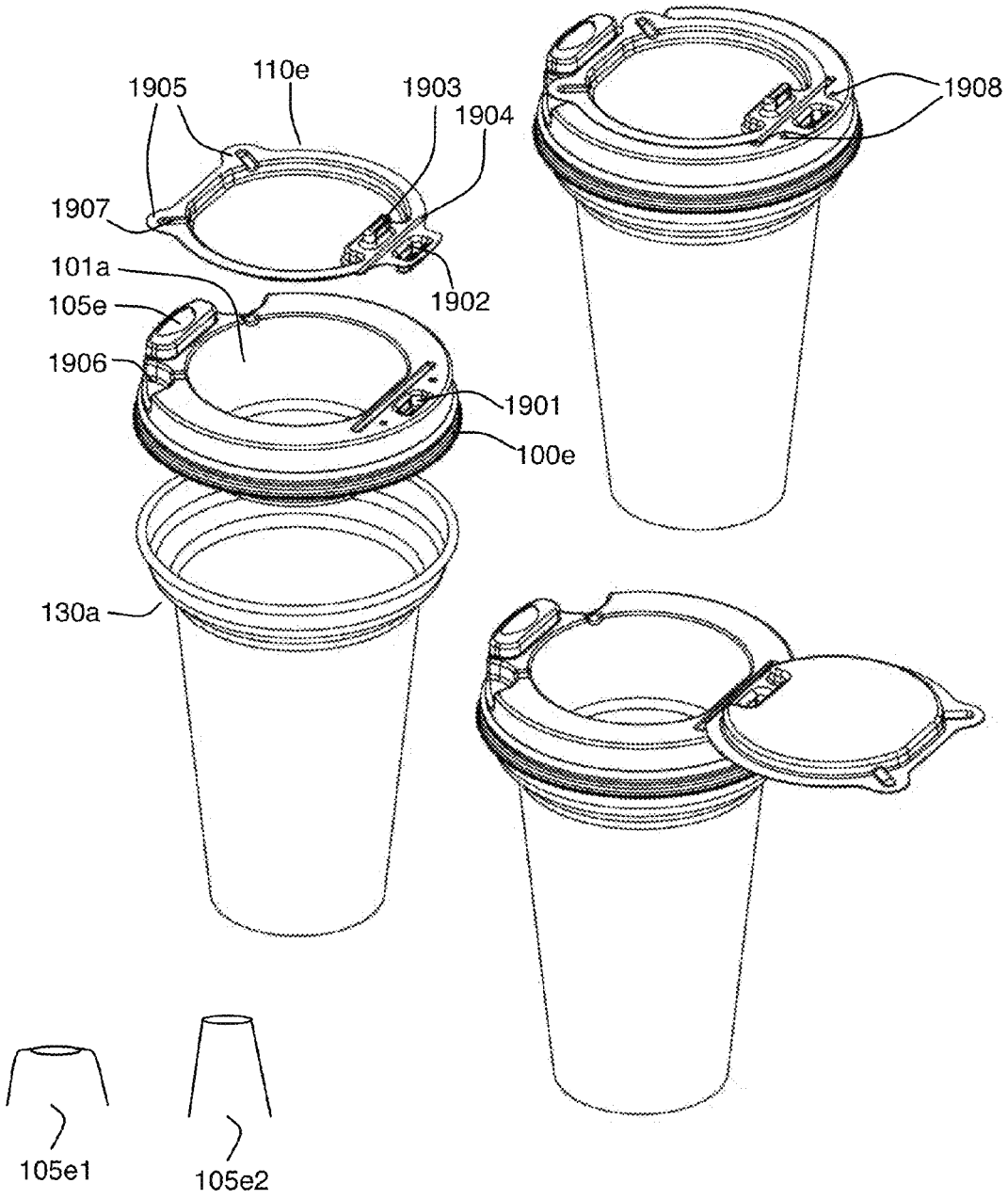
FIG. 19 illustrates an embodiment of the invention that employs a hinge lid/cover.

FIG. 12A illustrates a perspective view of an embodiment of the invention 100*c* with a container with an optional upper press-on friction dome style cover 110*c* coupled with cup 130, and configured to allow access to the contents of the cup via straw 301*b*. An alternative to using a press-on friction dome cover is to use an optional clamshell hinge cover, which may be selected depending upon the shape and height (hamburger, for example) of the food item that is chosen to reside within the container, is shown in FIG. 12B. In addition, FIG. 12B illustrates a rotationally aligned embodiment of the container of FIG. 12A with tabs 1905 for easy opening of the cover and wherein the clamshell style cover is align in one orientation so as to open away from the straw and wherein the contents of the cup are accessed via a hole in a vertical sidewall of the bottom cup lid via the straw. In one or more embodiments, tabs include strengthening ribs that project relatively orthogonal to the plane of the tabs to provide for a stronger tab and/or enable use of thinner plastic or both. The strengthening ribs are also shown in FIG. 19 as downward indentations that provide strength for the tabs. Clamshell hinge containers that may be utilized may have covers that may be upwardly contoured (in any shape), domed, or flat. Clamshell hinge containers may be molded and die cut from one piece of material where the upper and bottom parts are connected by a bridge of material that has a perpendicular hinge trough (single or double trough) located at the halfway point of the bridge that connects the two halves. The clamshell hinge cover may optionally include a hole through the top for a fork or a spoon. To keep the clamshell hinge container closed while transporting food from one location to another, the top and bottom of the container may be held together by any type of friction element(s). An example of a friction system that may be utilized is one in which the top lid inserts slightly downward into the bottom container at the edge where the two meet, i.e., internal wall friction press-on lid or cover. Another friction system that may be employed is male and female indentations of any shape or size that mate together and are located in the horizontal surface of the lip edge that surrounds the top lid and bottom container at the point where the two meet. Any of the embodiments of the cup lid may include a separate or integrated thermal or paper liner configured to reside within the container and configured to hold hot or cold items as one skilled in the art will appreciate. Alternatively, or in combination, at least one wall may be a double wall having, for example, an air gap that provides additional insulation between the temperatures in the container versus the cup, as one skilled in the art will appreciate. FIG. 12C shows channel 105*c* with a hole in the inner portion of the base of the cup lid for straw 301*b* to exit from the cup. The upper portion of cup lid 100*c* may attach in any manner such as via a circular male/female coupling element 1201 to the lower portion of the cup lid that couples with the cup at 1202, as shown in the figure surrounding the straw channel. In one or more embodiments of the invention, the bottom portion of cup lid 100*c*, i.e., the lower portion of the container, may include a non-permanent, semi-permanent or permanent coupling element to attach with the lower portion of the cup lid shown attached to the top of the cup. In this manner, the container portion of cup lid 100*c* may be disengaged from the lower portion of the cup lid that then remains on the cup. The coupling element between the upper portion of cup lid 100*c* and lower portion of the container may be of any type in relation coupling elements. See, for example, the vertical wall coupling element that couples with the cup itself, shown in FIG. 7A, coupling element 107. A screw type of coupling, or adhesive, or one-way coupling element may also be utilized as desired to provide for non-permanent, semi-permanent or permanent coupling types. In addition to a male/female coupling system, there may be male/female alignment elements (female element 2101 shown while male counterparts not visible on the bottom of the container) as shown in FIG. 12B that align the top clamshell container and lid below, such that, for example, as the top clamshell container opens, it faces the straw location and user. This has the advantage of a frontward-oriented configuration in relation to the user for opening the clamshell container. Frontward-oriented opening is ergonomic, logical, and user friendly. This is also shown in FIG. 12D, albeit with the female indentation shown on the opposing side of the straw with respect to the embodiment of FIG. 12B. There is no requirement for the male/female alignment elements to be in any shape or quantity so long as the top and bottom portion of the container may be rotationally aligned at a desired orientation to keep the clamshell opening away from the straw, for example. Alternatively, in the absence of male/female coupling systems, the bottom horizontal surface of the lower portion of the container may be permanently bonded to the upper horizontal surface of the cup lid that attaches to the cup rim via heat or thermo-bonding, sonic bonding or welding, spot welding or fusing, epoxy bond, hot melt glue bond, transfer adhesive bond, or double-sided tape bond.

Figure 13:
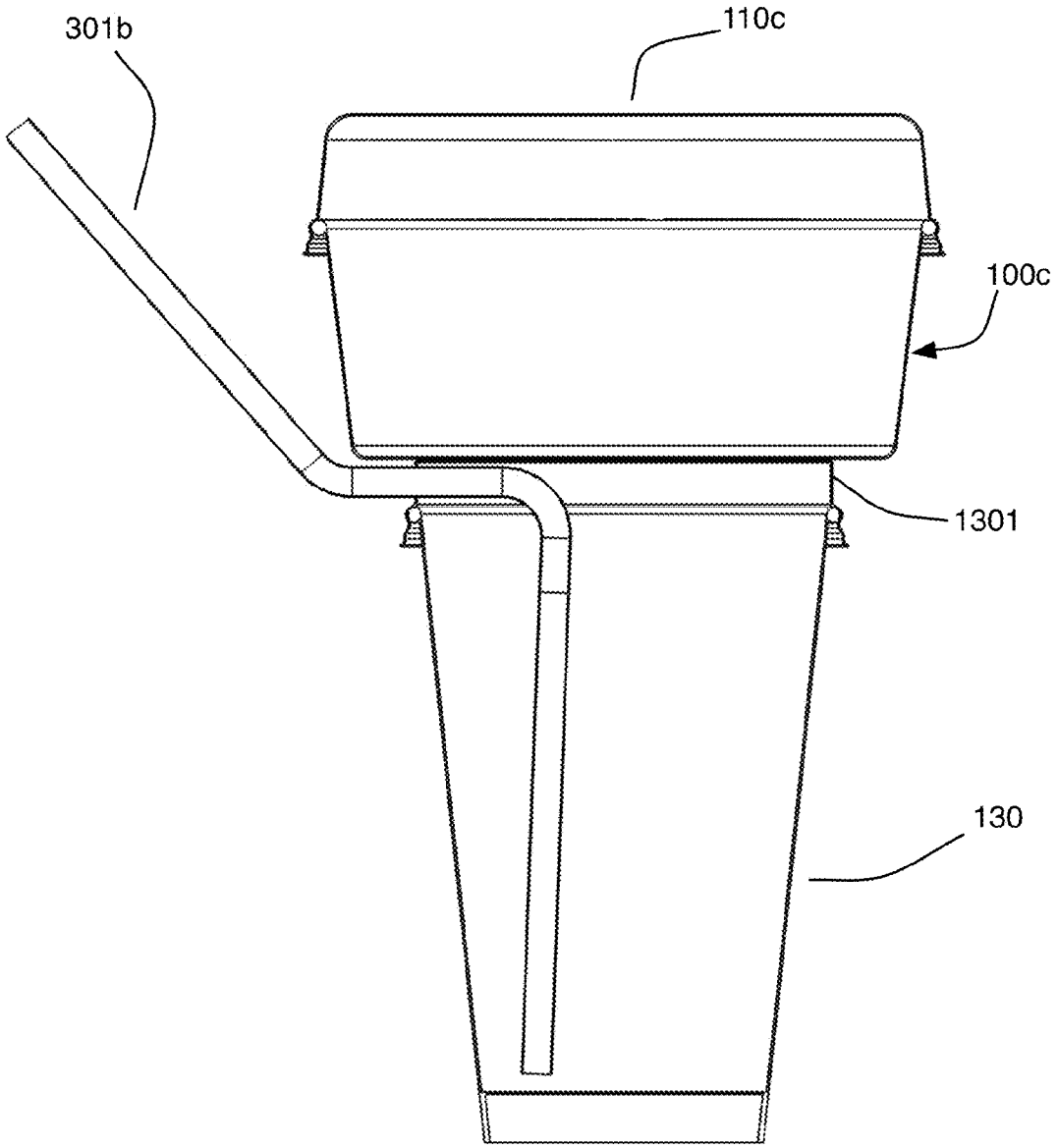
FIG. 13 illustrates a cross-sectional view of FIG. 12, along with a tri-bend straw configuration.

FIG. 13 illustrates a cross sectional view of FIG. 12A showing straw 301*b* exiting from a vertical wall 1301 of embodiment 100*c*. A straw with more than one bend, for example, may be utilized with this embodiment. Having the straw hole and straw exit through the vertical side wall is advantageous, in that the straw resides outside of the adjacent food container, which means that the straw never interferes with the food that is in the container.

Figure 14:
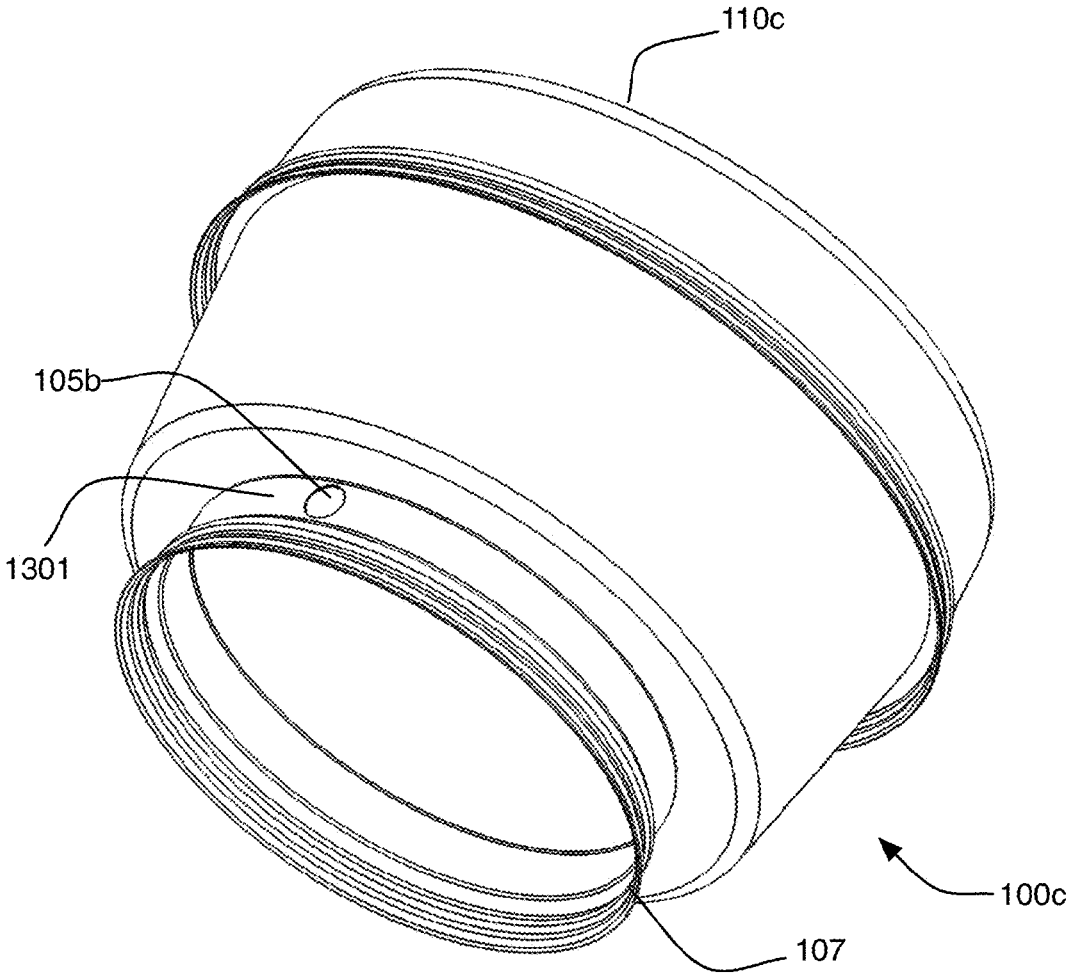
FIG. 14 illustrates a bottom perspective view of the embodiment of the invention shown in FIG. 12A along with an embodiment of the press-on friction dome cover and a straw hole located in the vertical wall of the cup lid.

FIG. 14 illustrates a bottom perspective view of the embodiment of the invention shown in FIG. 12A, showing hole 105*b* along with embodiment that includes the optional press-on friction dome cover 110*c*. The top horizontal area of the lower cup lid that couples with the cup via coupling element 107 may be bonded to the upper container in any manner or may be formed as part of the upper container as desired. Cover 110*c* may couple with container 100*c* in any manner desired, as one skilled in the art will appreciate. Cover 110*c* may be optionally attached to 100*c* via a clamshell-style hinge. When 110*c* and 100*c* are attached, they are made from a single-piece construction in one or more embodiments.

Figure 15:
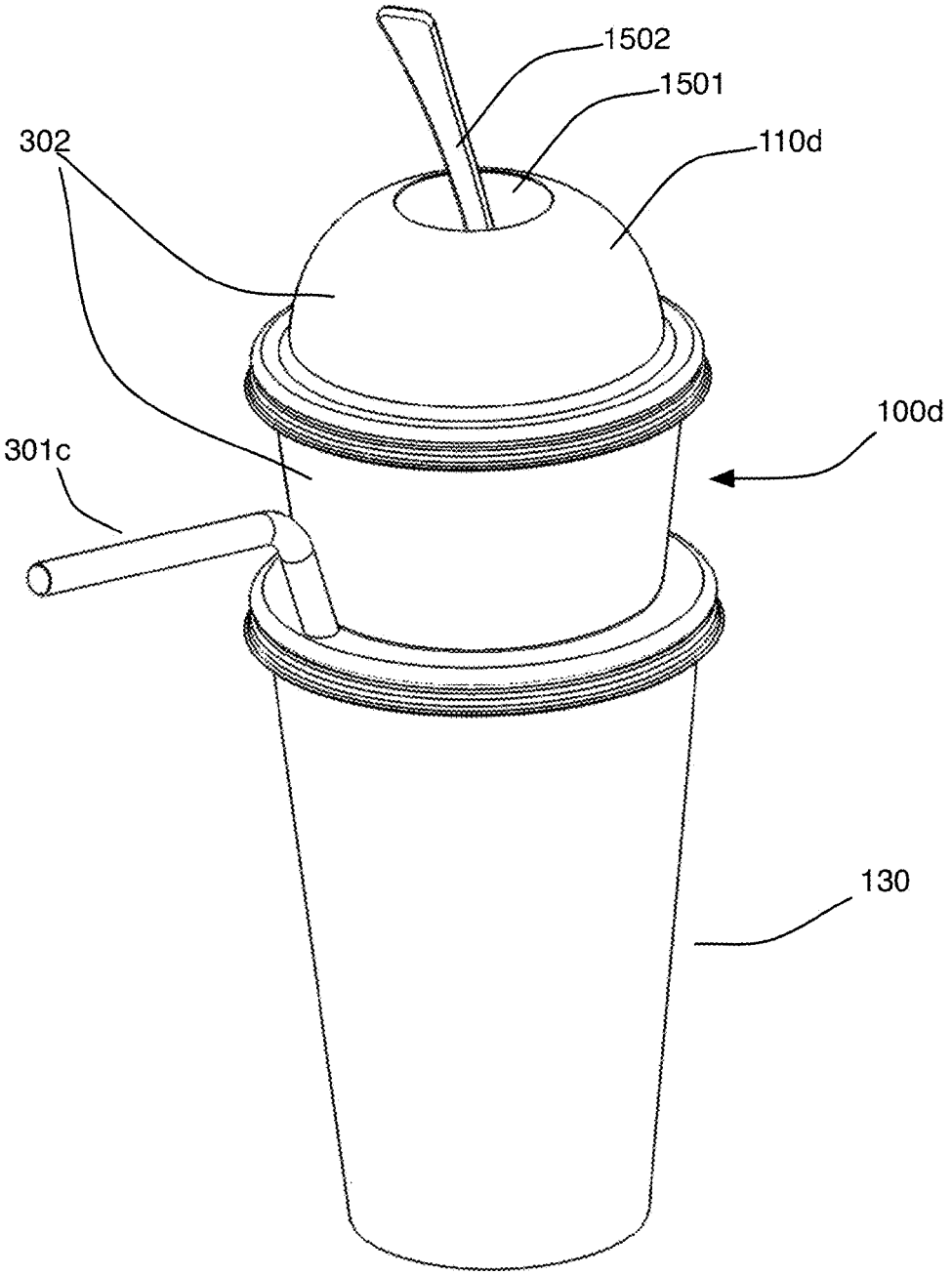
FIG. 15 illustrates a perspective view of an embodiment of the invention coupled with a cup, an optional press-on friction dome cover with a hole for a spoon/fork or any other eating utensil and configured to allow access to the contents of the cup via a straw.
Figure 15A:
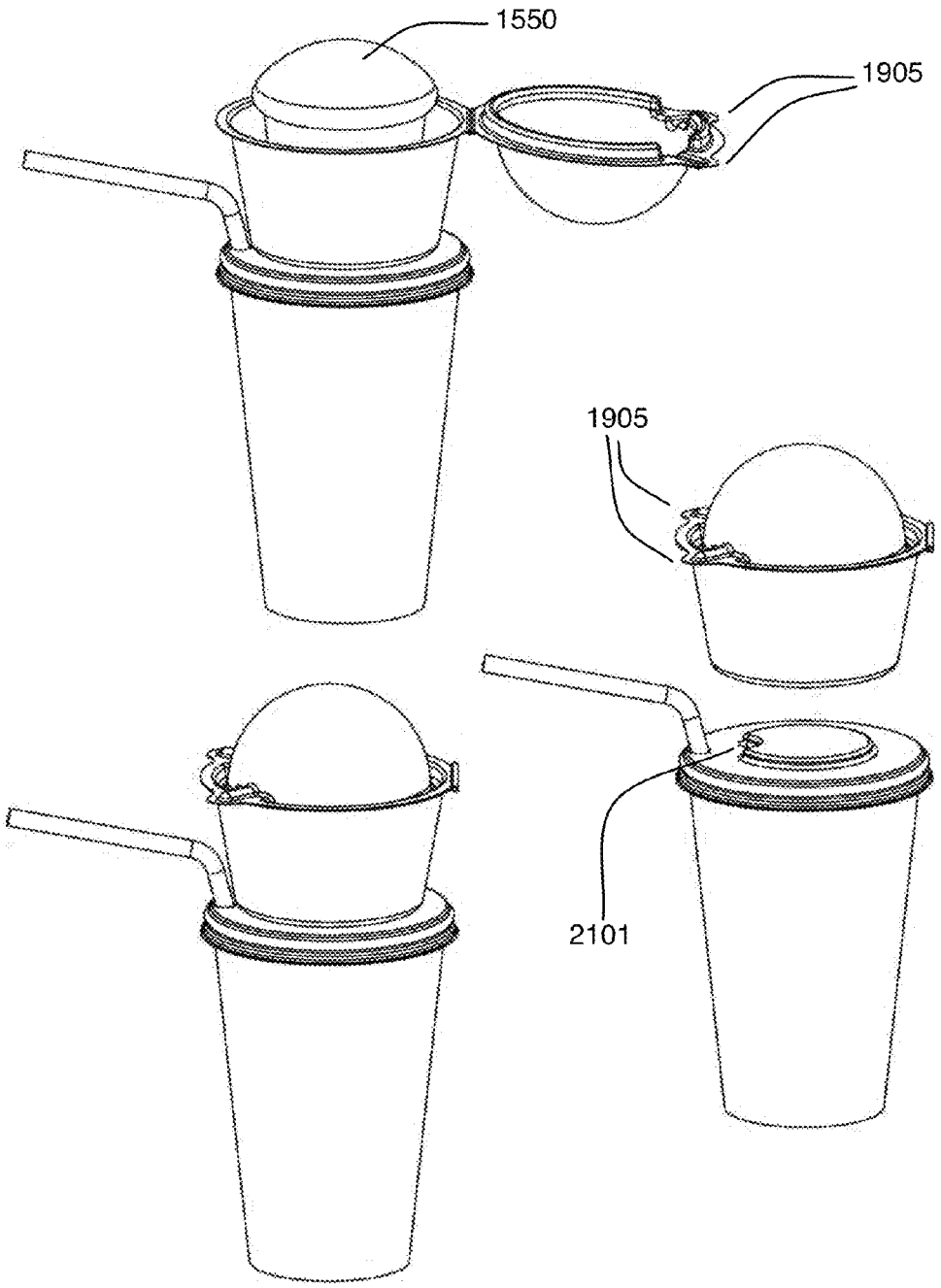
FIG. 15A illustrates an alternate embodiment shown in FIG. 15 that is rotationally aligned and wherein the container includes a hinged lid with an internal friction press-on element, wherein the hinged lid opens away from the straw via easy open tabs with strength ribs.

FIG. 15 illustrates a perspective view of an embodiment of the invention 100*d* coupled with a cup, an optional press-on friction dome cover 110*d* with hole 1501, for example, for access to the contents of the top container via spoon 1502 and configured to allow access to the contents of the cup via a straw via a hole in a horizontal portion of cup lid 100*d*. This embodiment has a horizontal dimension of the bottom of the container that is less than the diameter of the opening of the cup, as opposed to the embodiment shown in FIGS. 12A-D for example. The smaller diameter of the bottom of the top food container is advantageous in that it allows room for a straw hole and straw to reside within the horizontal surface of the cup lid, such that the liquid in the bottom cup may be accessed. Locating the straw hole and straw adjacent to the top food container means that the straw is located next to, or to the side of, the food container, which is advantageous, as the straw does not interfere with the container or the food that resides within the container. An alternative to using a press-on friction dome cover is to use an optional clamshell hinge cover, which may be selected depending upon the shape and height (for example muffin 1550, see FIG. 15A) of the food item that is chosen to reside within the container. This is shown in FIG. 15A as an embodiment with easy opening tabs 1905. The advantage of easy opening tabs is that as they overhang past the top lip edge of the bottom container, they are unobstructed by any plastic from the bottom container lip edge. Access to the unobstructed overhang tabs is from the underside where it is easy to lift them with a thumb and/or fingers. Clamshell hinge containers that may be utilized may have covers that may be upwardly contoured (in any shape), domed, or flat. Clamshell hinge containers may be molded and die cut from one piece of material where the upper and bottom parts are connected by a bridge of material that has a perpendicular hinge trough located at the halfway point of the bridge that connects the two halves. The clamshell hinge cover may optionally include a hole through the top for a fork or a spoon. To keep the clamshell hinge container closed while transporting food from one location to another, the top and bottom of the container may be held together by any type of friction element(s). An example of a friction system that may be utilized is one in which the top lid inserts slightly downward into the bottom container at the edge where the two meet, i.e., internal wall friction press-on lid or cover. Another friction system that may be employed is male and female indentations of any shape or size that mate together and are located in the horizontal surface of the lip edge that surrounds the top lid and bottom container at the point where the two meet. Other lids or covers that may be optionally utilized are seal-on/peel-off covers, which may be used with fruit containers, for example, to seal in the fruit and keep it fresh, while additionally the container may couple via male and female elements to the cup lid attached to the cup. A male/female coupling system may be utilized to couple the bottom horizontal surface of the container to the top horizontal surface of the lid that attaches to the rim of the cup, or alternatively, these surfaces may be permanently attached or bonded to each other via heat or thermo-bonding, sonic bonding or welding, spot welding or fusing, epoxy bond, hot melt glue bond, transfer adhesive bond, or double-sided tape bond. In addition to a male/female coupling system, there may be male/female alignment elements (female element 2101 shown while male counterparts not visible on the bottom of the container) that align the top clamshell container and lid below, such that, for example, as the top clamshell container opens, it faces the straw location and user, which is advantageous as a frontward-oriented configuration in relation to the user is ergonomic, logical, and user friendly.

Figure 16:
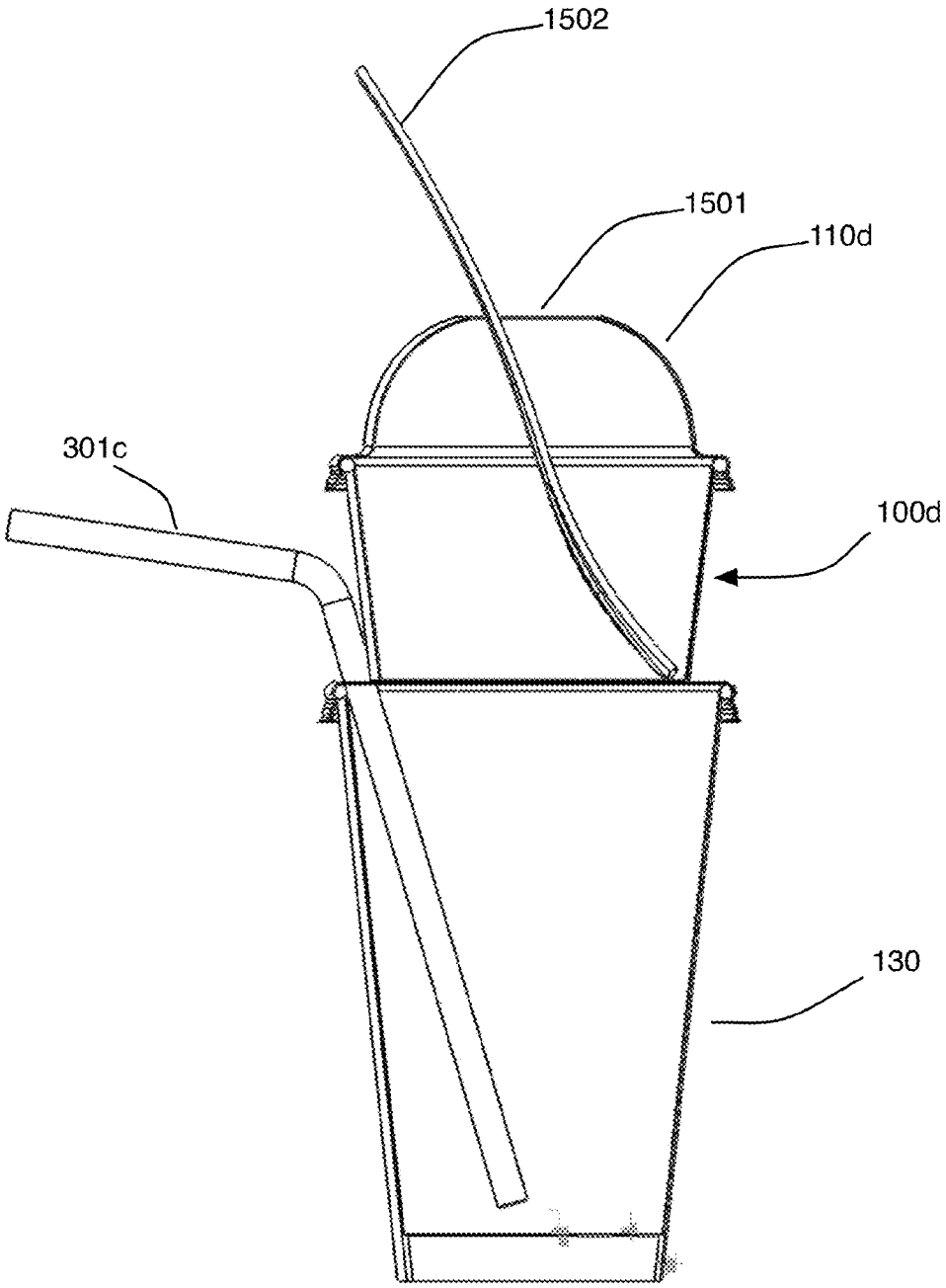
FIG. 16 illustrates a cross-sectional view of FIG. 15.

FIG. 16 illustrates a cross-sectional view of FIG. 15. Although the vertical dimension of the container has a depth that is at the plane of the opening of the cup, this is not required and may be of any depth into or out of the plane defined by the opening of the cup as desired, based, for example, on the type of solid or liquid to be placed in the container and also in the cup.

Figure 17:
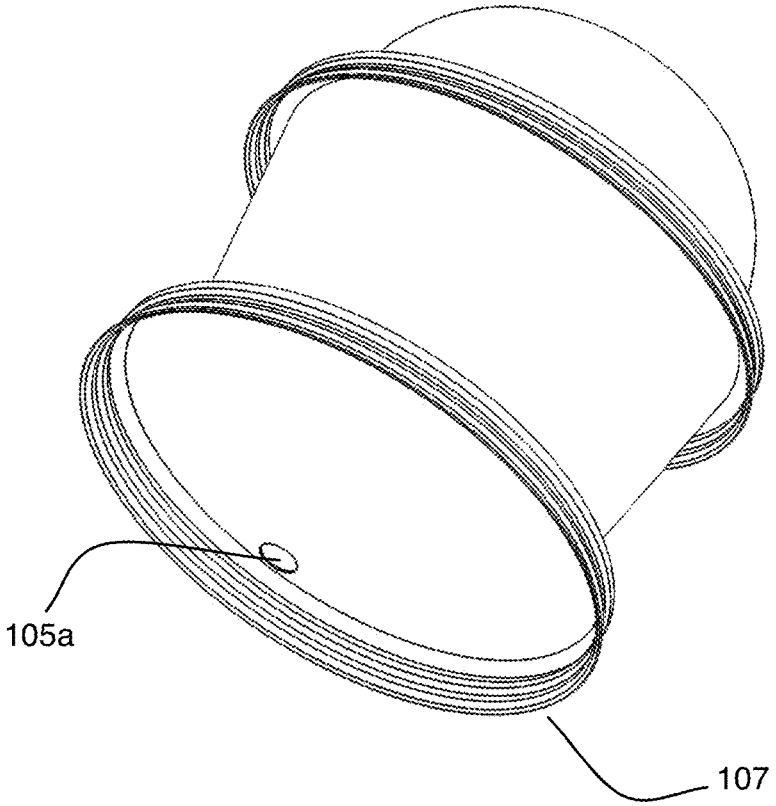
FIG. 17 illustrates a bottom perspective view of the embodiment of the invention shown in FIG. 15 along with an embodiment of a press-on friction dome cover and a straw hole located in the horizontal wall of the cup lid.

FIG. 17 illustrates a bottom perspective view of the embodiment of the invention shown in FIG. 15 along with an embodiment of the optional press-on friction dome cover with a hole. As shown, hole 105*a* is located in a horizontal plane of the cup lid, as opposed to the embodiment shown in FIG. 13, where the straw hole is located in the vertical portion or wall of the cup lid based on the diameter of the container in that embodiment, which has an overall horizontal dimension including the bottom of the container that is greater than the diameter of the opening of the cup, for example.

Figure 18:
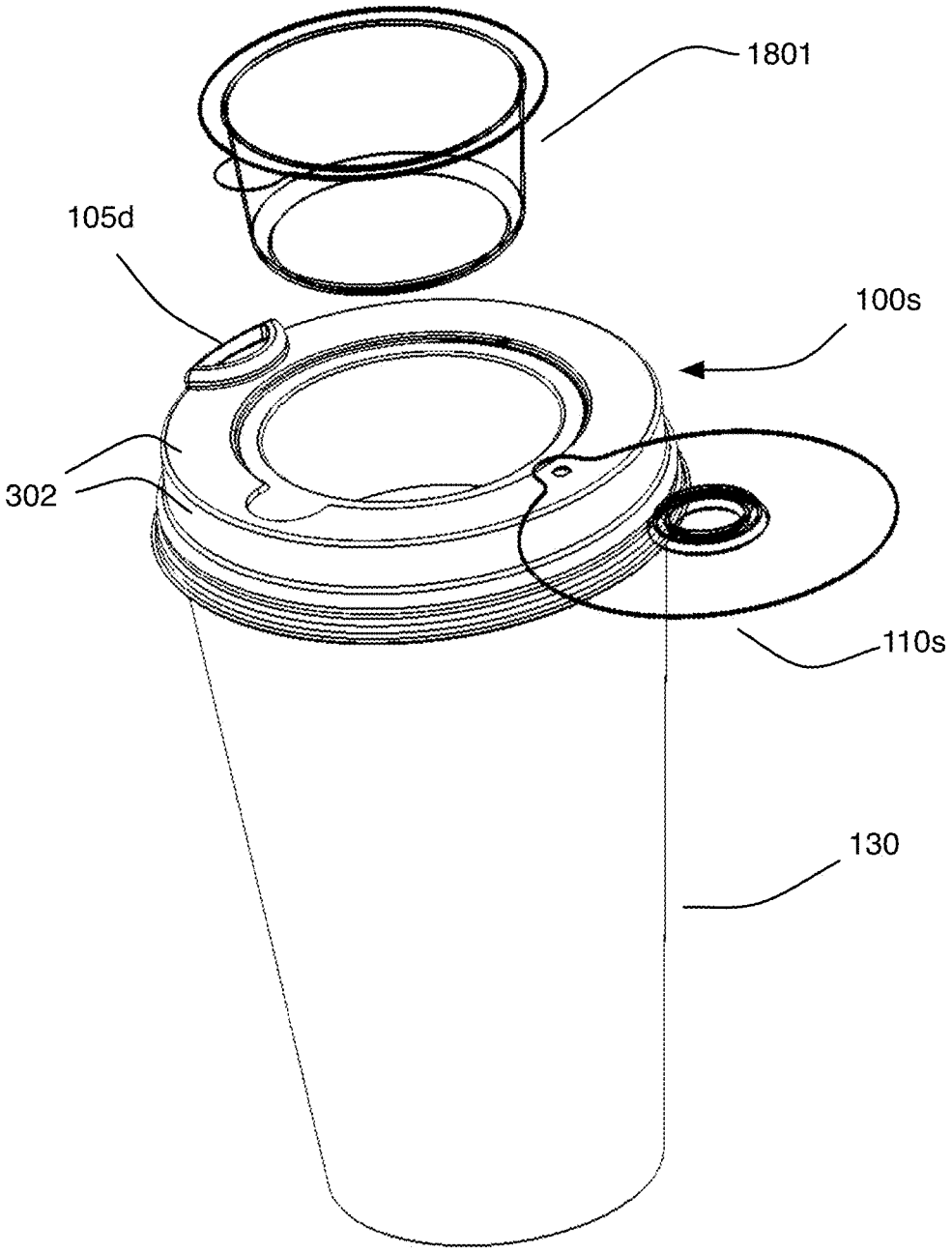
FIG. 18 illustrates an embodiment of the invention with a swivel cover and independent drop-in/removable container.

FIG. 18 illustrates an embodiment of the invention with swivel cover 110*s* and independent drop-in removable container 1801. As shown, cup lid 100*s* includes a sip hole/straw or gulp-size hole/straw 105*d* shown on the left side of the figure, although optionally a straw of any shape or size may be utilized in conjunction with this hole. The sidewalls of sip hole/straw 105*d* may optionally be of any height with respect to the top of cup lid 100*s*, and, if tall enough, may be utilized in place of a straw. In addition, this embodiment includes swivel cover 110*s* that may be opaque or transparent or any level of translucency as desired. In one or more embodiments, although not shown in FIG. 18 for brevity, the axis of rotation of the swivel cover may be around the sip hole, straw hole or gulp hole or located anywhere else on the cup lid. The swivel cover 110*s* is swiveled shut to close off or contain the contents of the independent drop-in/removable container after the seal-on/peel-off cover is removed and discarded. In one or more embodiments, the swivel cover is closed to contain loose contents such as nuts prior to lifting and tilting the cup in order to gulp or sip liquids such as beer. Spilling loose contents from the top container is not an inherent issue when using straw configurations. Independent drop-in/removable container 1801 may utilize a clamshell-type lid that is attached to the upper top edge of the container at any location. In this clamshell embodiment, the independent container 1801 and the press-on friction lid, for example, may be made as a one-piece construction. Although not shown within FIG. 18 for brevity, the independent drop-in/removable container may clip or fasten via various coupling elements and/or systems within the lid cavity in any manner. As one skilled in the art will appreciate, more than one independent drop-in/removable cups or containers may be placed in the lid cavity or cavities, for example cream and sugar. One such clip-on or coupling system that may be utilized is previously shown in FIG. 12B, where 100*c* is configured to clip on or couple, via a horizontal wall bottom-oriented system, to the cup lid that is positioned directly below. Vertical wall ridge-based coupling systems may also be utilized to attach the independent drop-in/removable container to the lid cavity. An example of an independent drop-in/removable container that may use a bottom-oriented coupling system within the lid cavity is a low-profile, single-cookie container with a seal-on/peel-off cover that clips within the lid cavity of a coffee cup. An additional example is an independent drop-in/removable container with a seal-on/peel-off cover that holds beer nuts that couples within the lid cavity of a plastic beer cup. Additionally, a coupling system may have been used in this latter embodiment, where a circular ridge based coupling system is located in the vertical wall area of the independent drop-in/removable container and cup lid cavity. This additional vertical wall location, where a circular ridge-based coupling system may occur, applies to fixing a low-profile cookie container to a coffee-cup lid cavity, or fixing a medium-deep, i.e., proceeds vertically downward into the cup volume, salty-sweet nut container to a beer-cup lid cavity, or a high-profile hamburger or French-fry container to a beer, soda, or milk shake lid cavity.

FIG. 19 illustrates an embodiment of the invention, namely hinge lid/cover 110*e* that couples with cup lid 100*e*. As shown, cup lid 100*e* is oriented above cup 130*a* and then coupled to cup 130*a* either before or after hinge lid/cover 110*e* is coupled with cup lid 100*e*. Cup 130*a* in this embodiment may include a widened portion, shown just beneath the rim of cup 130*a*, which may be utilized as a fill line, for example. The fill line shows how much liquid may be placed into cup 130*a* so that when cup lid 100*e* is coupled with the cup, the liquid does not spill out of the cup. In other words, container 101*a* may extend down into cup 130*a* (depending on the height of the vertical side walls of cup lid 100*e*), and the fill line shows the safe level of liquid that may be displaced by container 101*a* without liquid, for example, exiting hole/straw 105*e*. The side walls of sip hole, gulp hole, or straw 105*e* may be of any height with respect to the top of cup lid 100*e*, e.g., embodiment 105*e*1 shown in the left portion of the lower two side views in the bottom left of the figure, and as shown having a horizontal portion at the top edge of the hole/straw in the perspective view. If tall enough, the hole may be utilized in place of a straw, e.g., embodiment 105*e*2 shown in the right portion of the lower two side views in the bottom left of the figure. In either embodiment, the top portion of the sip hole or gulp hole 105*e* may optionally include a horizontal area having a hole or alternatively include no horizontal surface, such as a rounded surface, for example. Straight cups, such as cup 130 shown in FIG. 1, may also be utilized with this embodiment of the cup lid and may or may not include a fill line that is indented or drawn on the inside or outside of the cup to show how much liquid may be placed in the cup for a given depth of container 101*a* and/or vertical wall height of cup lid 100*e*. Alternatively, multiple fill lines, either physically shaped as shown in cup 130*a*, or with slight indentations or markings or colors, may be utilized. Any other type of fill line may optionally be utilized in keeping with the spirit of the invention. Cup 130*a* may be made from paper, plastic, hard-molded plastic (with or without double wall construction), ceramic or metal, such as stainless steel, for example.

Hinge lid/cover 110*e* may be permanently or non-permanently coupled with cup lid 100*e*. Hinge lid/cover 110*e* and cup lid 100*e* may be made from two separate pieces or may be formed as one piece, such as a typical clamshell construction. Hinge lid/cover 110*e* may attach to cup lid 100*e* through various methods of attachment other than male and female parts that mate or interlock. In the absence of male and female parts, for example, two flat surfaces may be attached to each other via thermo-bonding, sonic bonding or welding, spot welding or attached with adhesive or any other permanent or non-permanent bonding mechanism. Hinge 1904 may be formed with any type of mechanism that allows hinge lid/cover 110*e* to make the contents of container 101*a* available, including an axle, tooth and hook, pivot, trough, score line, double score lines or any other mechanism. As shown, female indent 1901 couples cup lid 100*e* with male extension 1902 on hinge lid/cover 110*e* to enable hinge lid/cover 110*e* to open by pivoting or folding at trough 1904. Optional second male extension 1903 may snap into second female indentation 1902 to hold hinge lid/cover 110*e* open. All female and/or male indentations or extensions respectively may include narrowing areas or bumps that enable the male and female parts to snap together to hold the parts together. Alternatively, hinge lid/cover 110*e* may be welded or permanently attached in any other manner to cup lid 100*e*. Trough 1904 may be implemented as shown or alternatively may utilize a double score line, i.e., two closely spaced indentations that enable hinge lid/cover 110*e* to bend at those two locations to enable a full 180 degree rotation or pivot of hinge lid/cover 110*e* about an axis parallel to the two score lines.

Tabs or grasp tabs 1905 and tab indents or grasp tab indents 1906 enable opening of hinge lid/cover 110*e* while hole/straw 105*e* enables access of the contents of cup 130*a* directly or via a straw. The grasp tabs may optionally include strength ribs 1907 as shown. The contents of container 101*a* may be accessed, and then hinge lid/cover 110*e* may be closed against cup lid 100*e* and then re-opened again when desired. Thus, intermittent access to the contents of cavity 101*a* and re-closure of cavity 101*a* is provided through hinge lid/cover 110*e*. The access of liquid may occur while the hinge lid/cover 110*e* is in either the open or closed position. Embodiments of the cup lid cavity 101*a* (also see FIG. 1) may optionally include a paper liner or ruffled paper liner or any other type of liner that separates the cup lid from the food item placed inside the cup lid. Embodiments of the cup lid may optionally include one or more vacuum release air holes 1908. As one skilled in the art will recognize, hole/straw 105*e* may be made to fit a straw or may be of any other size. Embodiments of the invention may also utilize indented cutouts 106 placed in the top horizontal wall adjacent to (as shown in FIG. 1) the container area to enable easier access to cookies or other food items, for example.

Figure 19A:
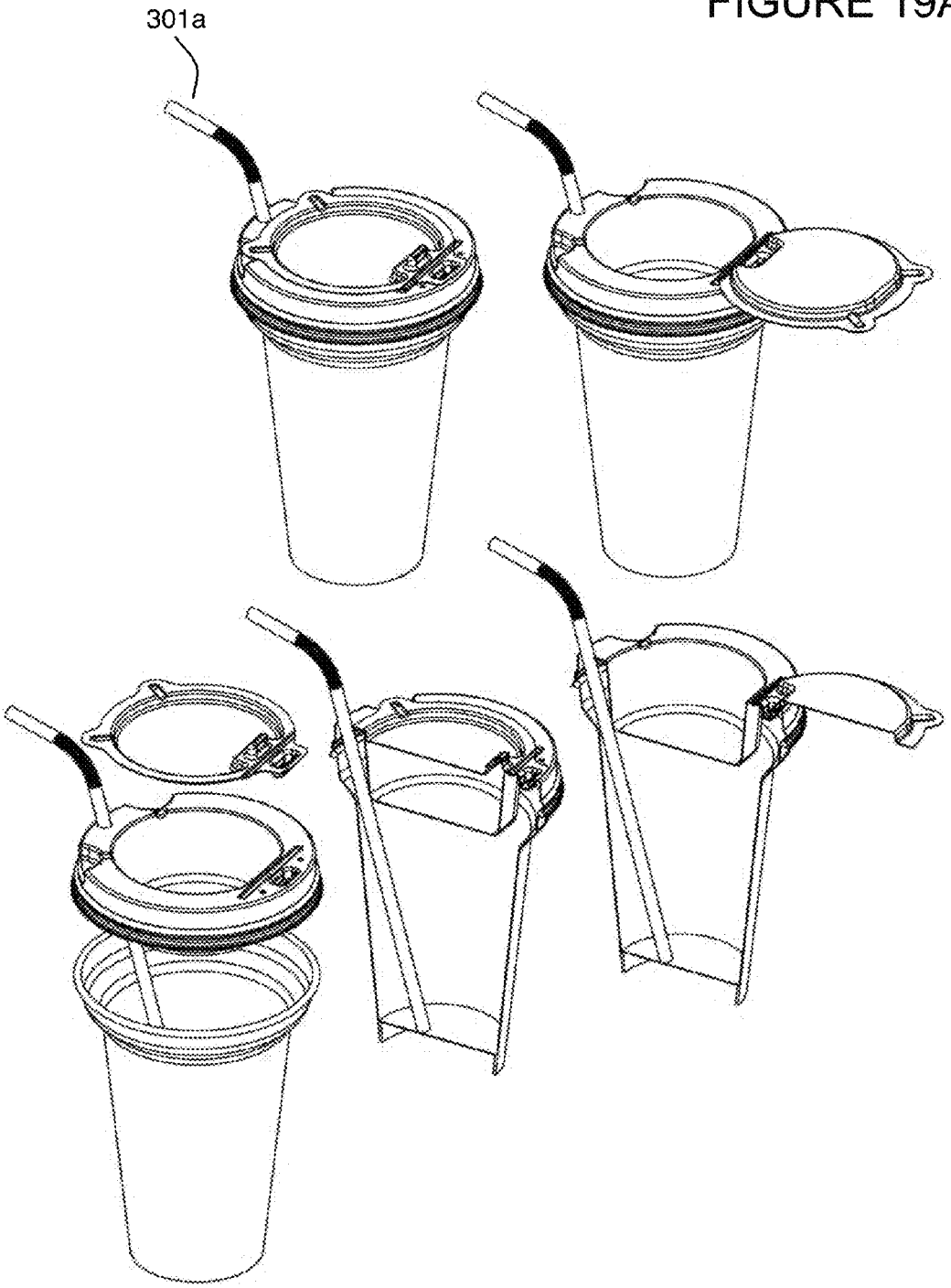
FIG. 19A shows embodiments of FIG. 19 configured for use with a straw.

FIG. 19A shows embodiments of FIG. 19 configured for use with straw 301*a*. One or more embodiments include a straw hole instead of the raised gulp-sized hole as shown in FIG. 19, for example. Embodiments as shown in FIG. 19A may be utilized for stadium cold drink embodiments, for example, or for any other scenario where a straw and hinged lid/cover and container are desired.

Figure 20:
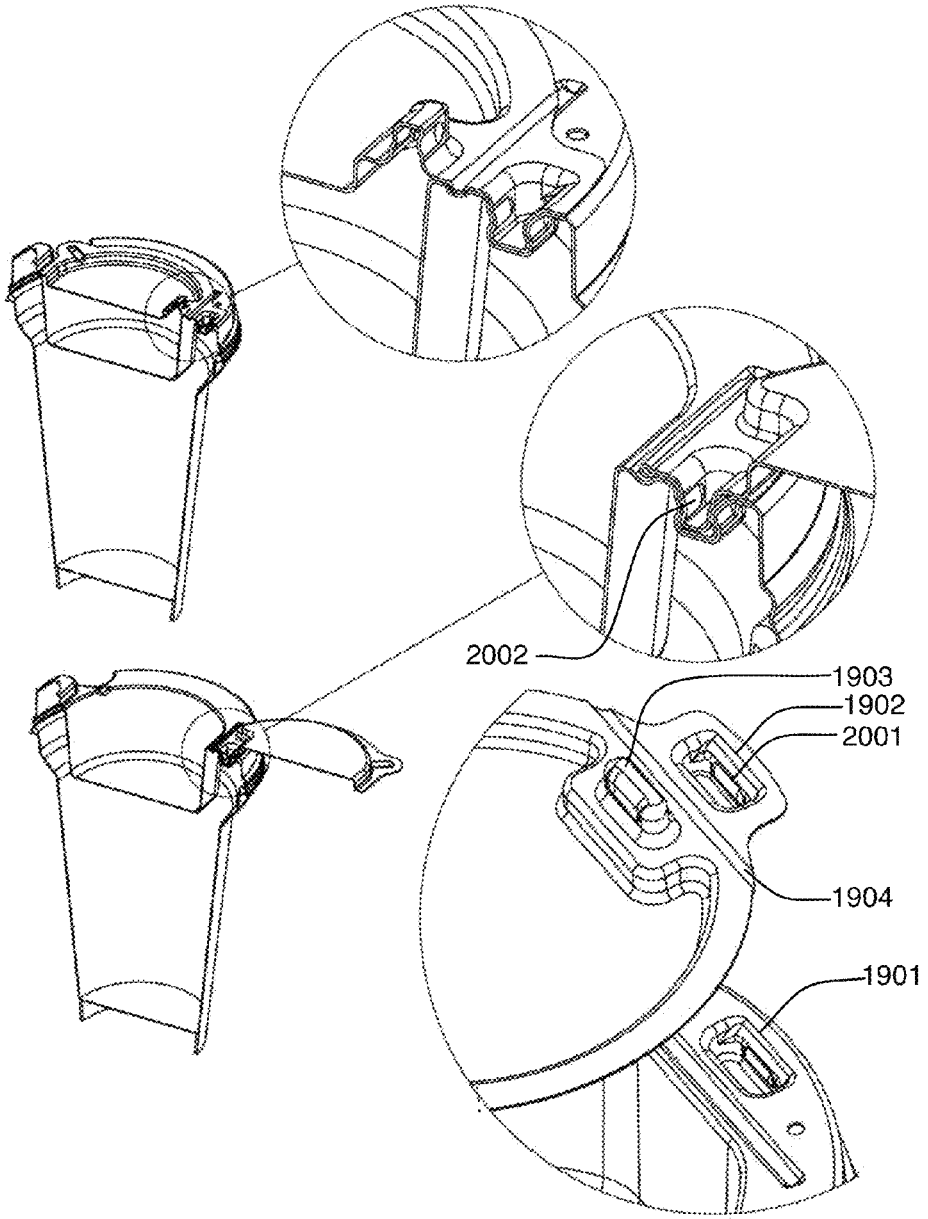
FIG. 20 illustrates a close up of the hinge lid/cover coupling element of FIG. 19.

FIG. 20 illustrates a close up of the hinge lid/cover coupling element of FIG. 19. As shown, bump 2001 in a female indentation may snap against bump 2002 in a corresponding male extension to hold hinge lid/cover to the cup lid and/or hold the hinge lid/cover in the open position. By constructing the two female indentations of slightly different size and by constructing the two male extensions of corresponding slightly smaller size, all four elements may fit within one another. Alternatively, multiple indentations in the cup lid may be utilized to hold the hinge lid/cover to the cup lid in a non-rotational manner and hold the hinge lid/cover to the cup lid in a specified area.

Figure 21:
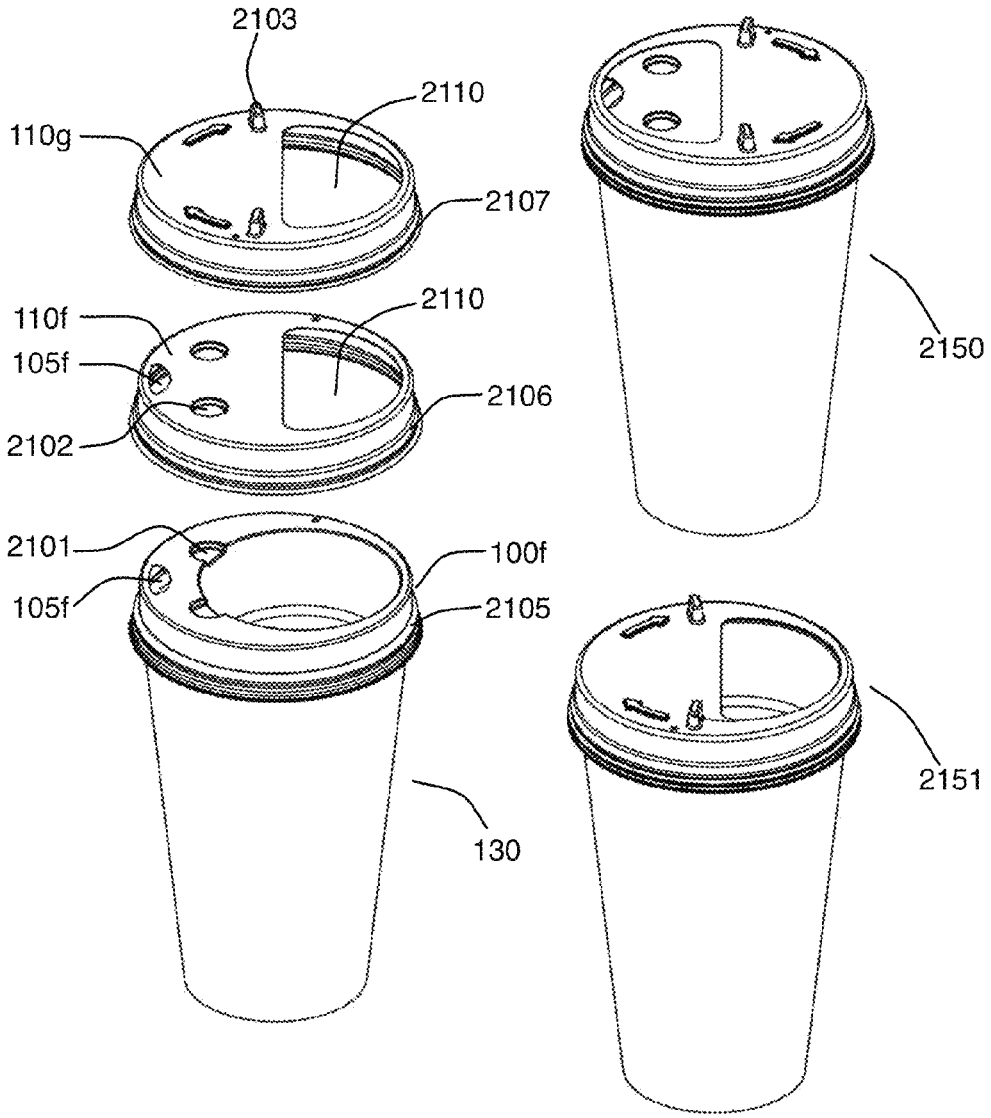
FIG. 21 illustrates a rotational cover with a closeable embodiment of the invention with a large opening to enable access to the contents of the container with fingers.

FIG. 21 illustrates a rotational lid with a closeable embodiment of the invention with large opening 2110 to enable access to the contents of the container with fingers, for example. As shown, cup lid 100*f* includes sip/gulp hole 105*f* and interlocking female indentations 2101. Cover 110*f* includes a corresponding sip/gulp hole 105*f* and male extensions 2102 that couple with female indentations 2101. This interlocking arrangement keeps large opening 2110 in cup lid 100*f* from rotating with respect to cup lid 100*f*. Alternatively, more than one coupling ridge may be used to couple covers 110*g*, 110*f* to cup lid 100*f*. Rotational lid 110*g* couples with cover 110*f* via ridge 2107 and 2106 that couples with ridge 2105 on cup lid 100*f*. Rotational lid 110*g* may be rotated for example using grasp tab or post 2103 to close container 101*a* as shown in closed arrangement 2150 or rotated further to open container 101*a* for access as shown in open arrangement 2151. Any number of vacuum release air holes may be employed on any embodiment described herein if desired.

Figure 22:
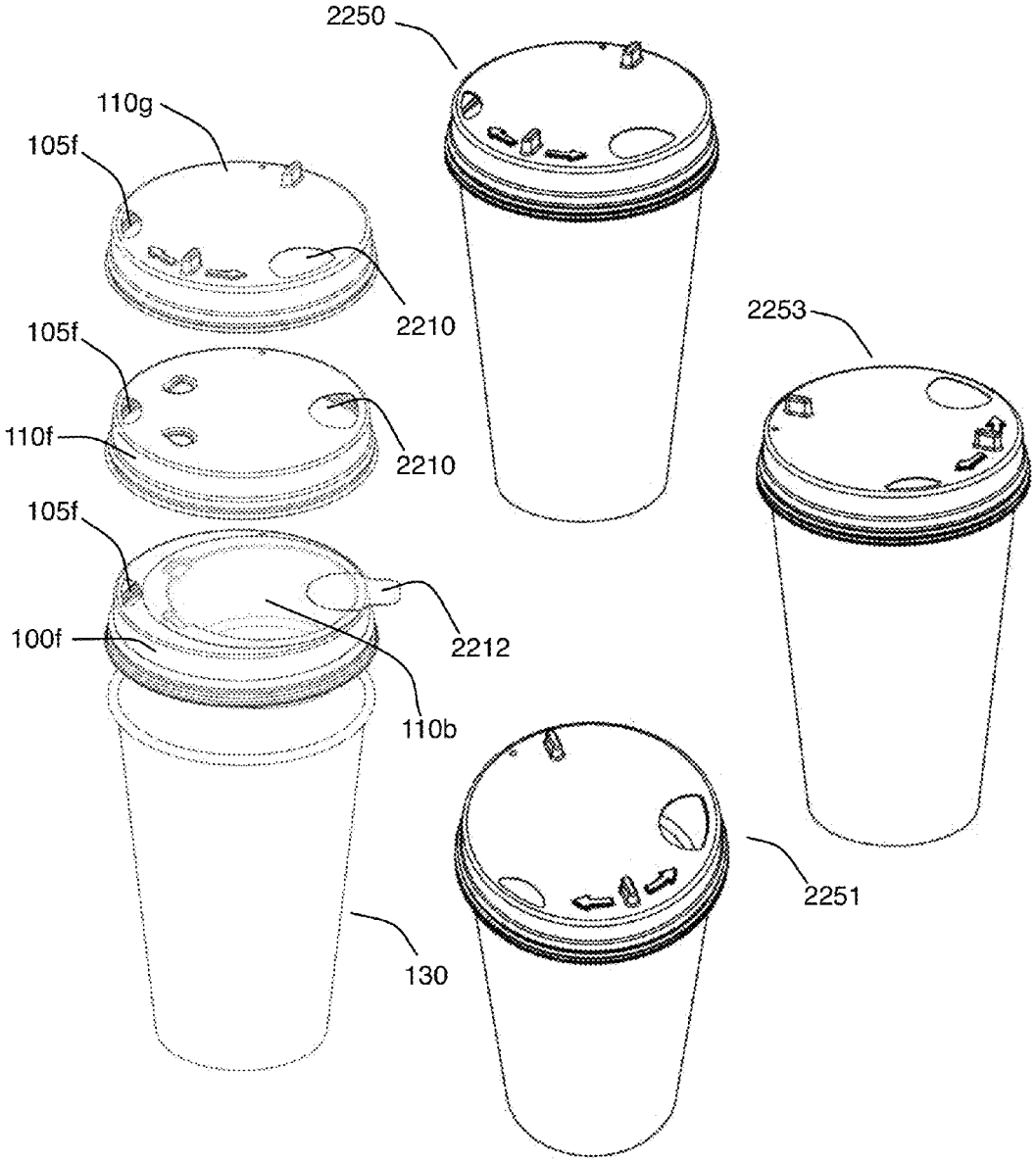
FIG. 22 illustrates a rotational cover with a closeable embodiment of the invention with an optional seal-on/peel-off cover, and a medium-size opening to enable access of the contents of the container by lifting and pouring the contents into the mouth.

FIG. 22 illustrates a rotational cover with a closeable embodiment of the invention with medium size opening 2210, to enable access to the contents of the container 101*a* (FIG. 1) by lifting and pouring the contents into the mouth. Opening 2210 may be sized large enough for example to enable nuts or other small food items to pass through opening 2210. First open arrangement 2250 shows sip/gulp hole 105*f* aligned over the corresponding sip/gulp holes in the cover 110*f* and cover 100*f* shown respectively beneath the rotational cover 110*g* in the figure. Second open arrangement 2251 shows medium size opening 2210 (for nuts for example) aligned over the corresponding hole in the cover 110*f* when the rotational cover 110*g* is rotated to align cover holes 2210. Although not shown for brevity, there may be rotational stop elements as part of the configuration that stop the rotational cover at specific locations (to align holes) configured to allow access to either the sip/gulp hole or snack/nut hole. Closed arrangement 2253 is shown with neither sip/gulp hole 105*f* nor hole 2210 aligned over holes in the additional cover and/or lid. This prevents access to the contents of the cup or cup lid. This embodiment is arranged similarly to the embodiment shown in FIG. 21, albeit with a smaller opening 2210. Additionally, less rotation is required to open and close the hole openings shown in FIG. 22 versus FIG. 21. In addition, optional seal-on/peel-off cover 110*b* may be provided to cover or otherwise enclose the contents of the cup lid cavity. If provided, seal-on/peel-off cover 110*b* may include a pull tab 2212 with optional score line so that only a portion of the seal-on/peel-off cover 110*b* is opened via the tab. If seal-on/peel-off cover 110*b* is utilized on the cup lid 100*f*, then the middle cover 110*f* is optional. Alternatively, if no score line for the tab is provided, the tab may open the entire container of the cup lid as desired. The embodiment shown may be utilized for a beer/nut combination, for example, or any other combination of items that may be accessed through sip/gulp hole 105*f* and hole 2210.

Figure 23:
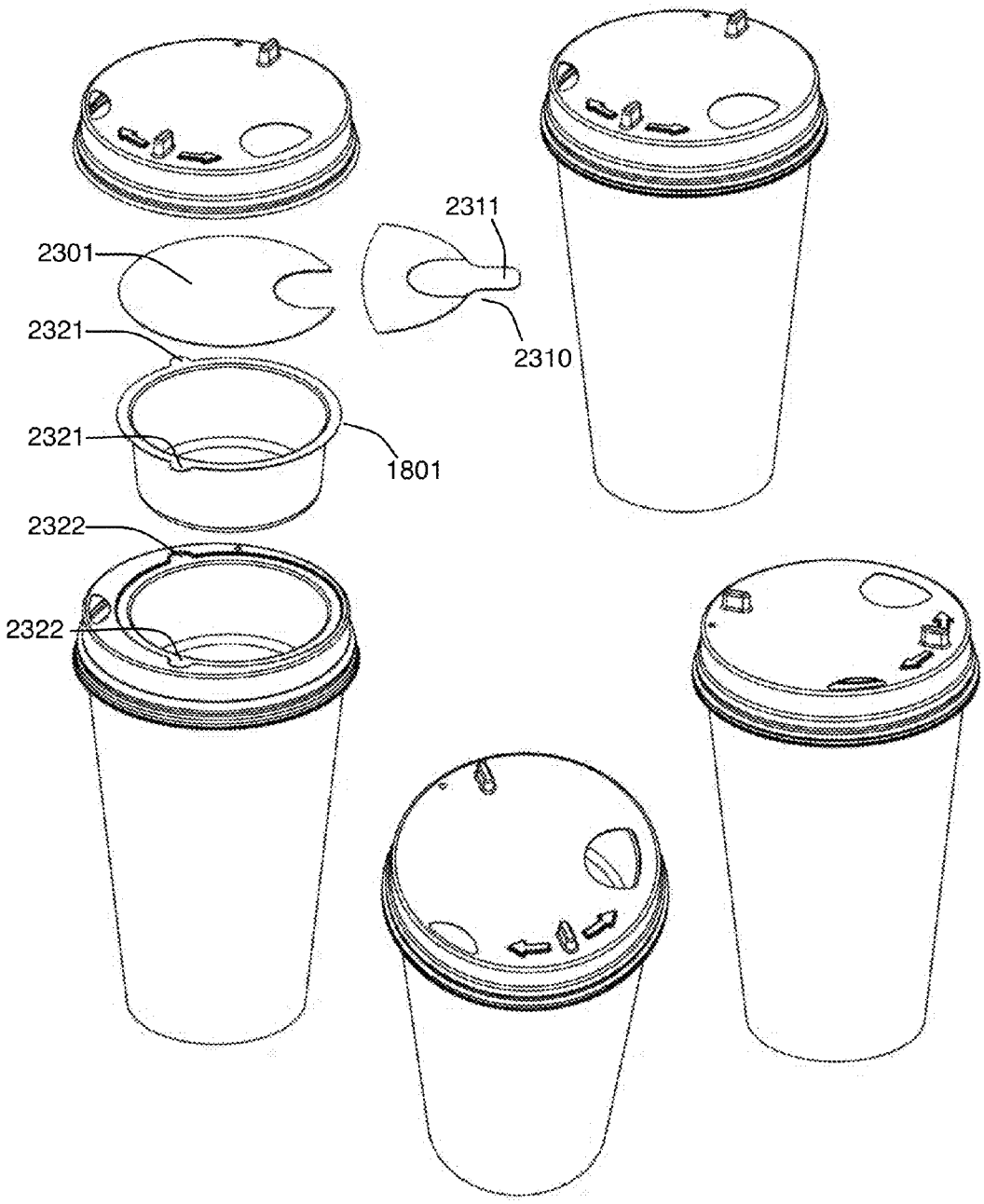
FIG. 23 illustrates a rotational cover with a closeable embodiment of the invention with a medium-size opening to enable access to the contents of the container by lifting and pouring the contents into the mouth of a user, wherein the container may be in the form of an independent drop-in/removable seal-on/peel-off unit, which may be optionally scored and may be foil or any singular or plural combination of materials.

FIG. 23 illustrates a rotational cover with a closeable embodiment of the invention with a medium-size opening to enable access to the contents of the container by lifting and pouring the contents into the mouth, wherein both contents and container may be in the form of a sealed drop-in/removable unit, optionally with a scored seal-on/peel-off cover made from foil or any other material or combination of materials. One or more embodiments of the invention may include one or more alignment tabs 2321 that fit within alignment slots 2322 to keep the independent drop-in/removable container 1801 from rotating.

Embodiments of the invention may utilize seal-on/peel-off cover 2301 and press-on friction covers (not shown but which are known to close a container that has been opened by pressing the cover onto an open container) alone or in combination as desired for the intended application. As shown, seal-on/peel-off cover 2301 may include a score line 2310 and tab 2311, wherein once tab 2311 is removed along the score line, the contents of container 1801 may be accessed. A portion of the closed cover is shown with reference characters 2310 and 2311, while the full cover albeit with the open portion is shown to the left of the partial view. In one or more embodiments of the invention the entire cover of container 1801 may be removed via a tab or in any other manner.

Figure 24:
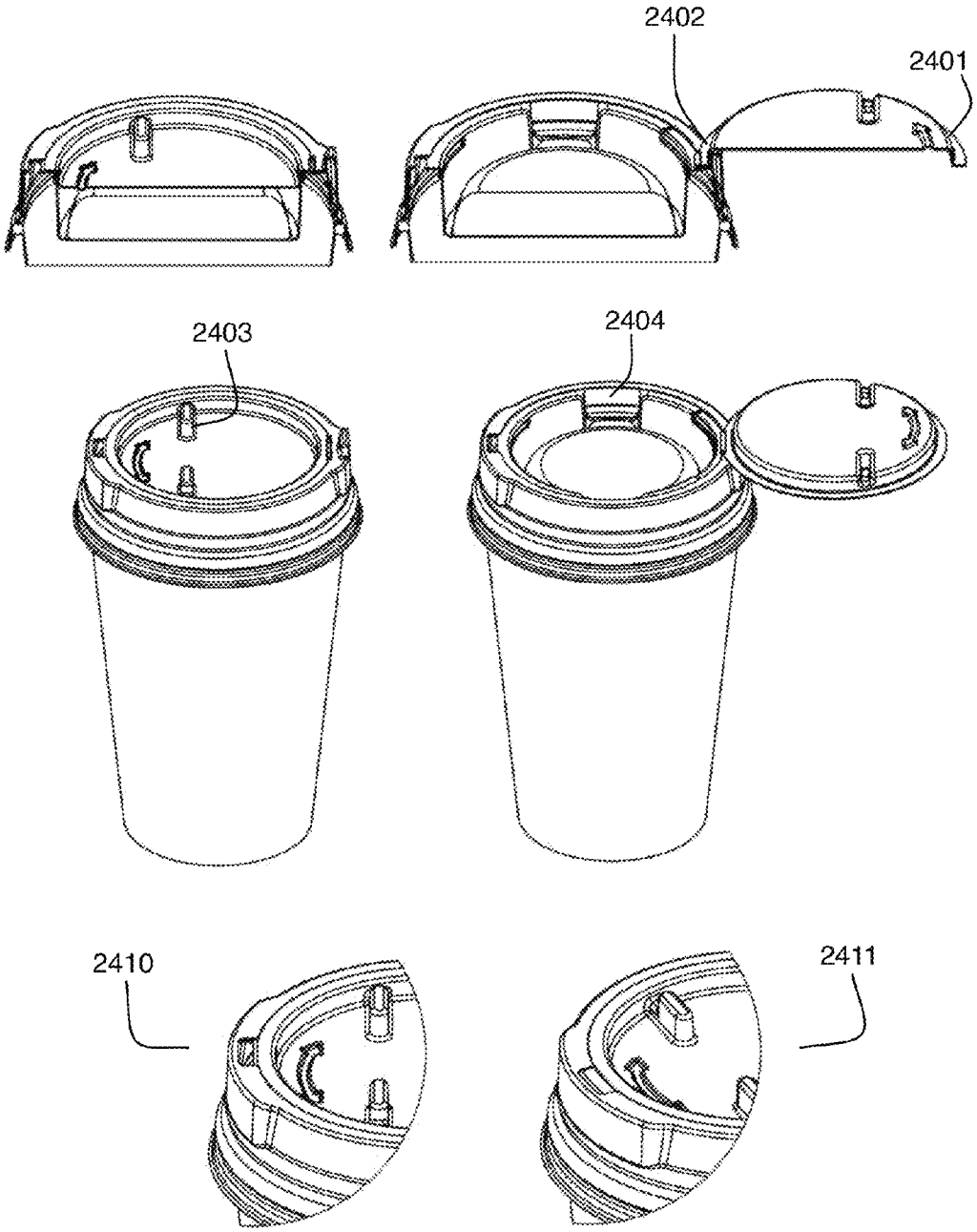
FIG. 24 illustrates a rotational/hinge lid/cover configured, for example, to hold a cookie or other item, and configured with posts, for example grab posts, and optional snap open and closed elements.

FIG. 24 illustrates a rotational/hinge lid/cover configured, for example, to hold a cookie or other item, and configured with grasp tabs or posts and optional snap open element 2402 and snap close element 2401. These may be configured as optional bumps that enable the hinge lid to snap open and shut respectively. Without bumps, the hinge lid may stay secure in the closed position via press-on friction systems of engagement, for example. Grasp tabs 2403 enable the hinge lid/cover to be opened and optional cutouts 2404, for example, enable easy extraction of a food item from within the cup lid cavity. As shown, a cookie, for example, is held within the cup lid. The top of the cup lid rotates to open position 2410 and closed position 2411. Embodiments may hold one or more cookie(s), doughnut(s) or muffin(s) for example. The hinge may be formed in any manner including double score lines or through use of any other element.

Figure 25:
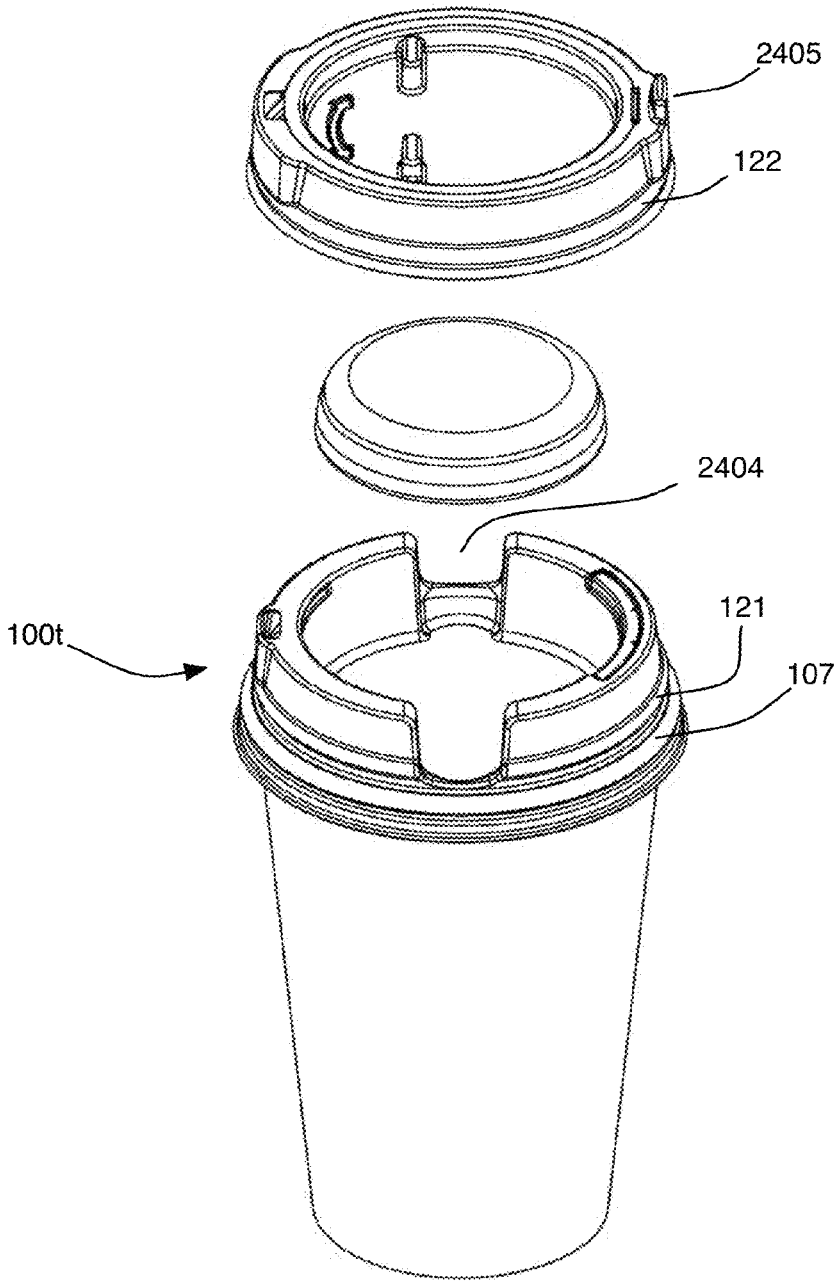
FIG. 25 illustrates the embodiment of FIG. 24 with the cover off and showing a food item and optional cut-outs for lifting the food item, for example.

FIG. 25 illustrates the embodiment of FIG. 24 with the cover off and showing a food item, for example the cookie shown between the cover and the cup lid and optional indented cutouts 2404 for lifting the food item. The hinge lid/cover may have a longer vertical sidewall and clip to the lower ridge 107 that attaches to the cup rim, as well as ridge 121. Optional vacuum release air holes may be located anywhere in embodiments of the invention, as shown on the right side of the cup lid, 100*t* for example. 2405 shows an optional raised male post that includes an optional small raised bump on the inside wall that faces the cup lid cavity. This male post and bump ridge allow the hinge lid/cover to click into place while in the open position.

Figure 26:
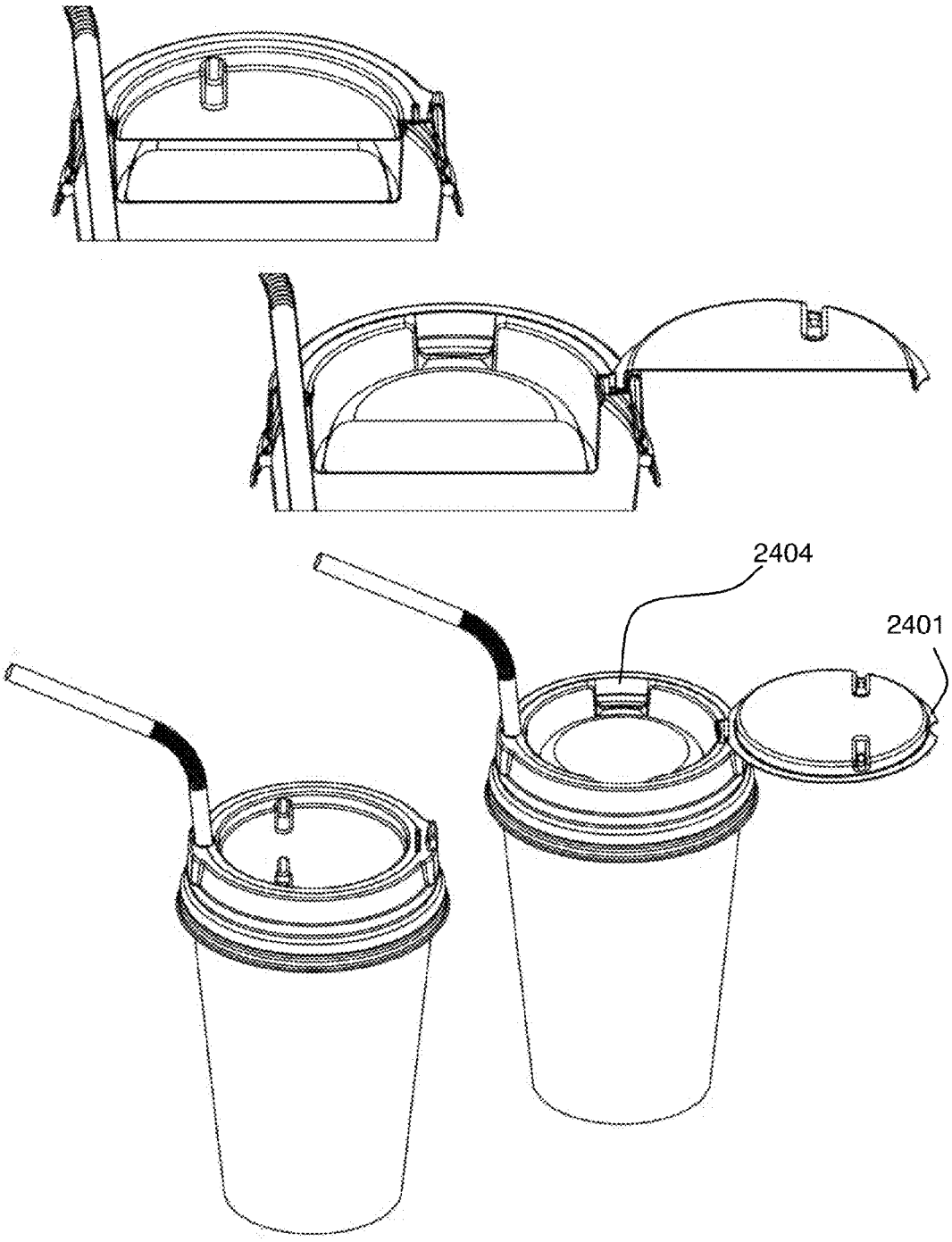
FIG. 26 illustrates an embodiment, for example as shown in FIGS. 24 and 25, with a straw hole.

FIG. 26 illustrates an embodiment, for example, as shown in FIGS. 24 and 25, with a straw hole and top cover that is non-rotational in one or more embodiments. Bump(s) may be located at 2401 to enable the hinge lid to click shut, for example.

Figure 27:
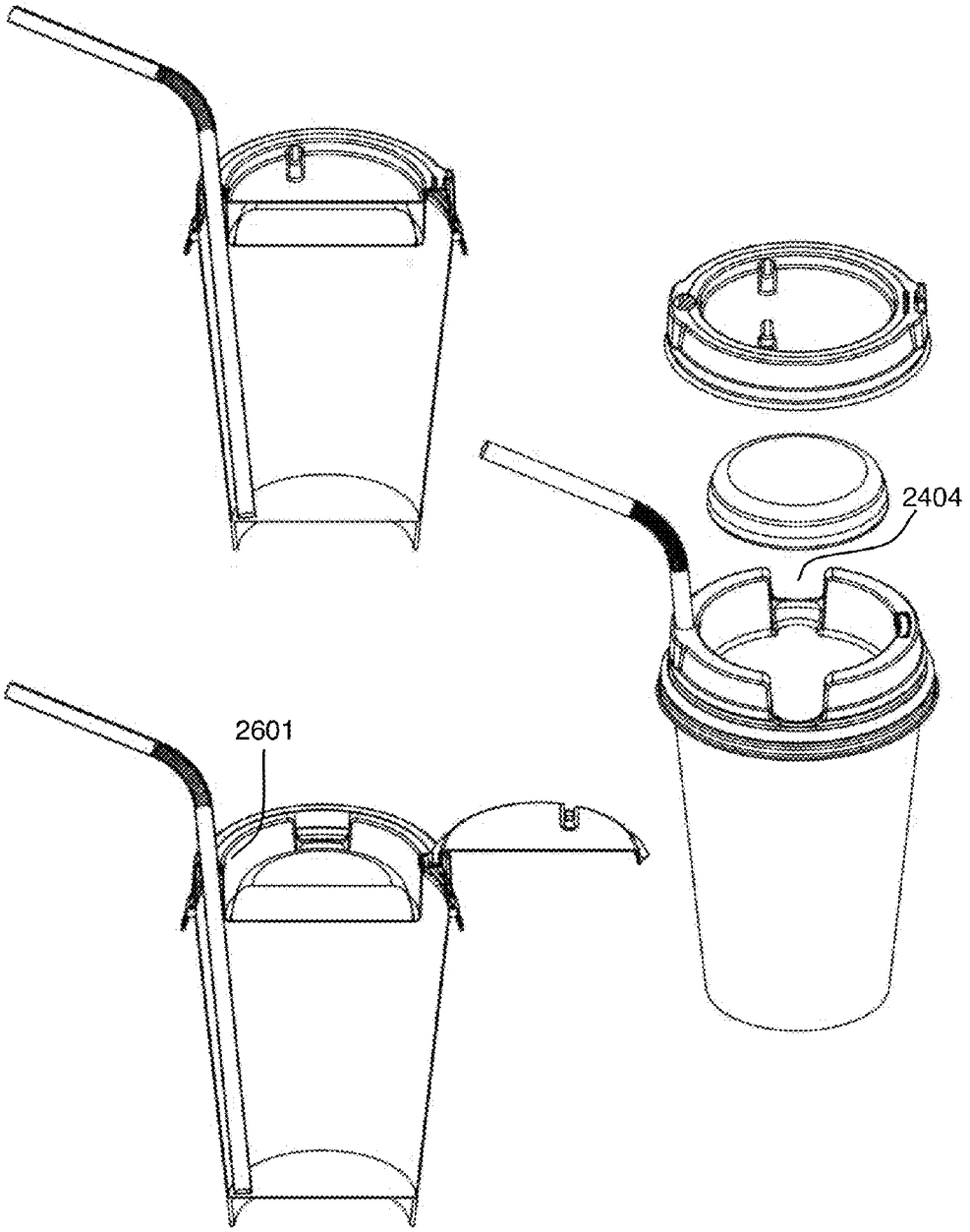
FIG. 27 illustrates the embodiment of FIG. 26 in further detail.

FIG. 27 illustrates the embodiment of FIG. 26 in further detail.

Figure 28:
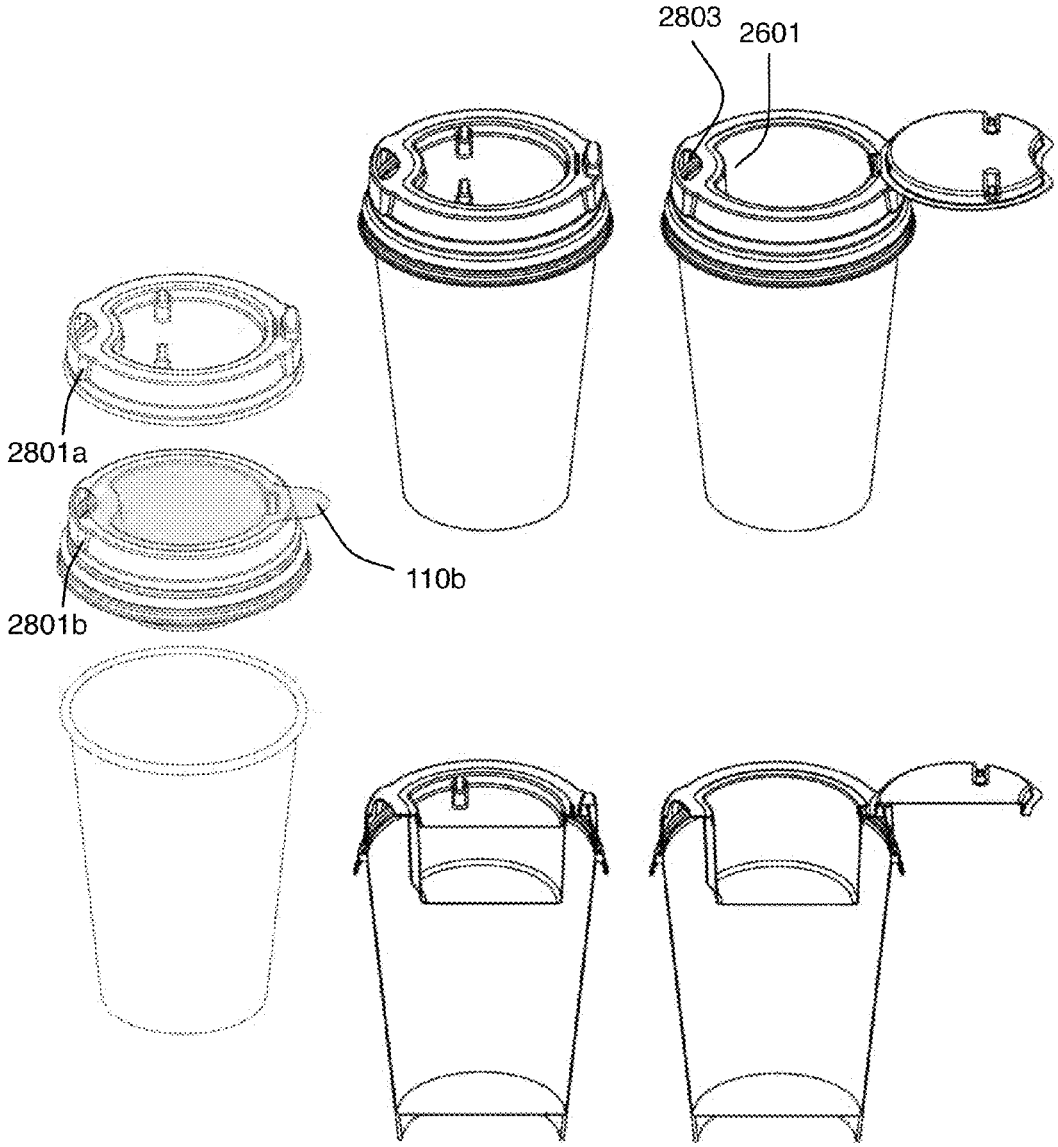
FIG. 28 illustrates an embodiment with an optional seal-on/peel-off cover and non-rotational hinge lid/cover that may be configured to click open or closed for example.

FIG. 28 illustrates an embodiment with an optional seal-on/peel-off cover 110*b* and non-rotational cover that may be configured to click open, for example. Sip/gulp size opening 2803 is shown along with non-rotational element(s) 2801*a* and 2801*b* and optional seal-on/peel-off cover 110*b*.

Figure 29:
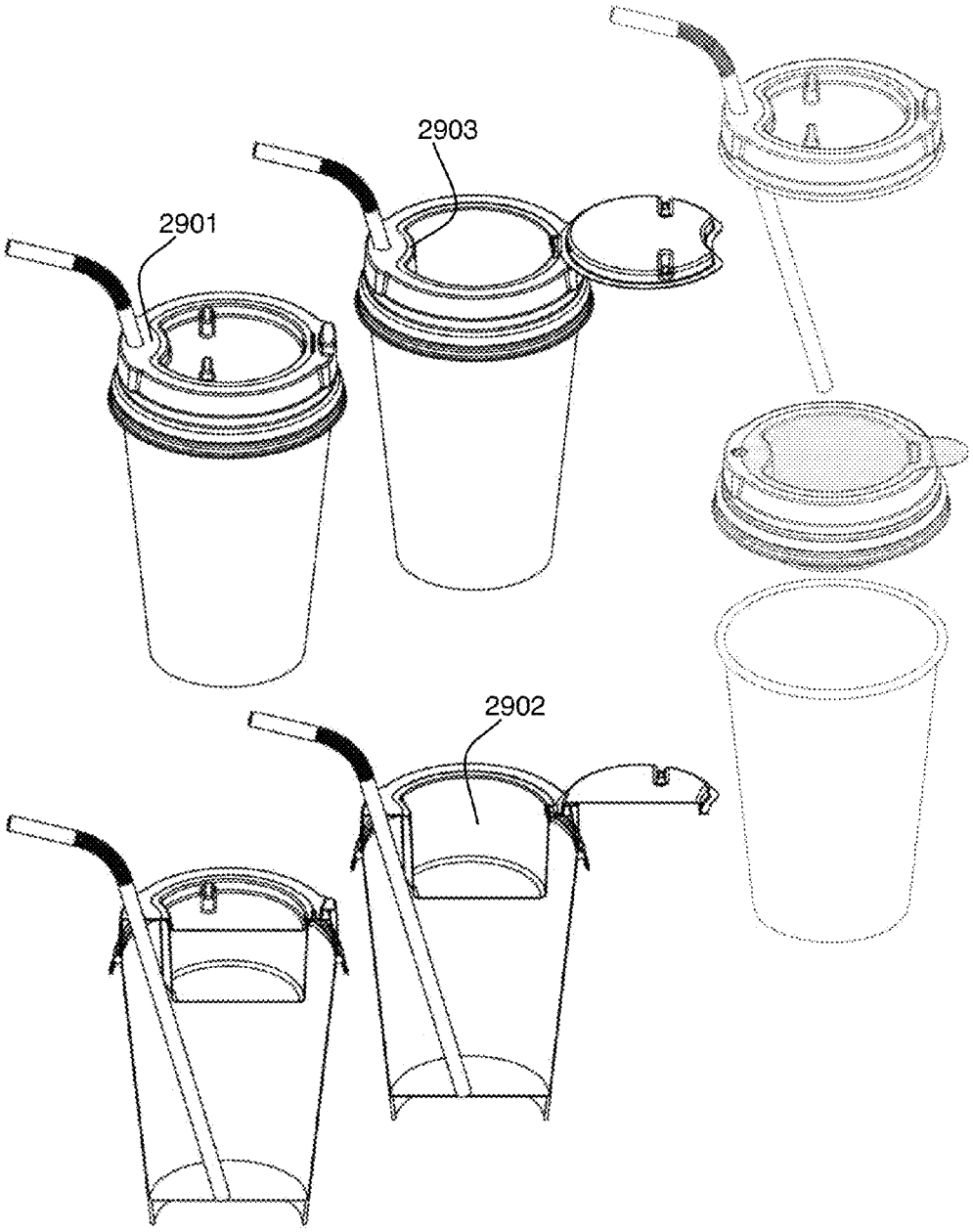
FIG. 29 illustrates an embodiment of FIG. 28 with a straw hole.

FIG. 29 illustrates an embodiment of FIG. 28 with a straw hole at enlarged area 2901. In one or more embodiments of the invention, the container volume is as deep at 2902 as desired for the particular food item(s) that are to be held. The crescent-shaped inward indentation 2903 in the vertical sidewall of the cup lid container provides ample room for a straw to move freely within the lower main cup cavity without being constricted by the vertical side walls of the lower main cup and cup lid cavity.

Figure 30:
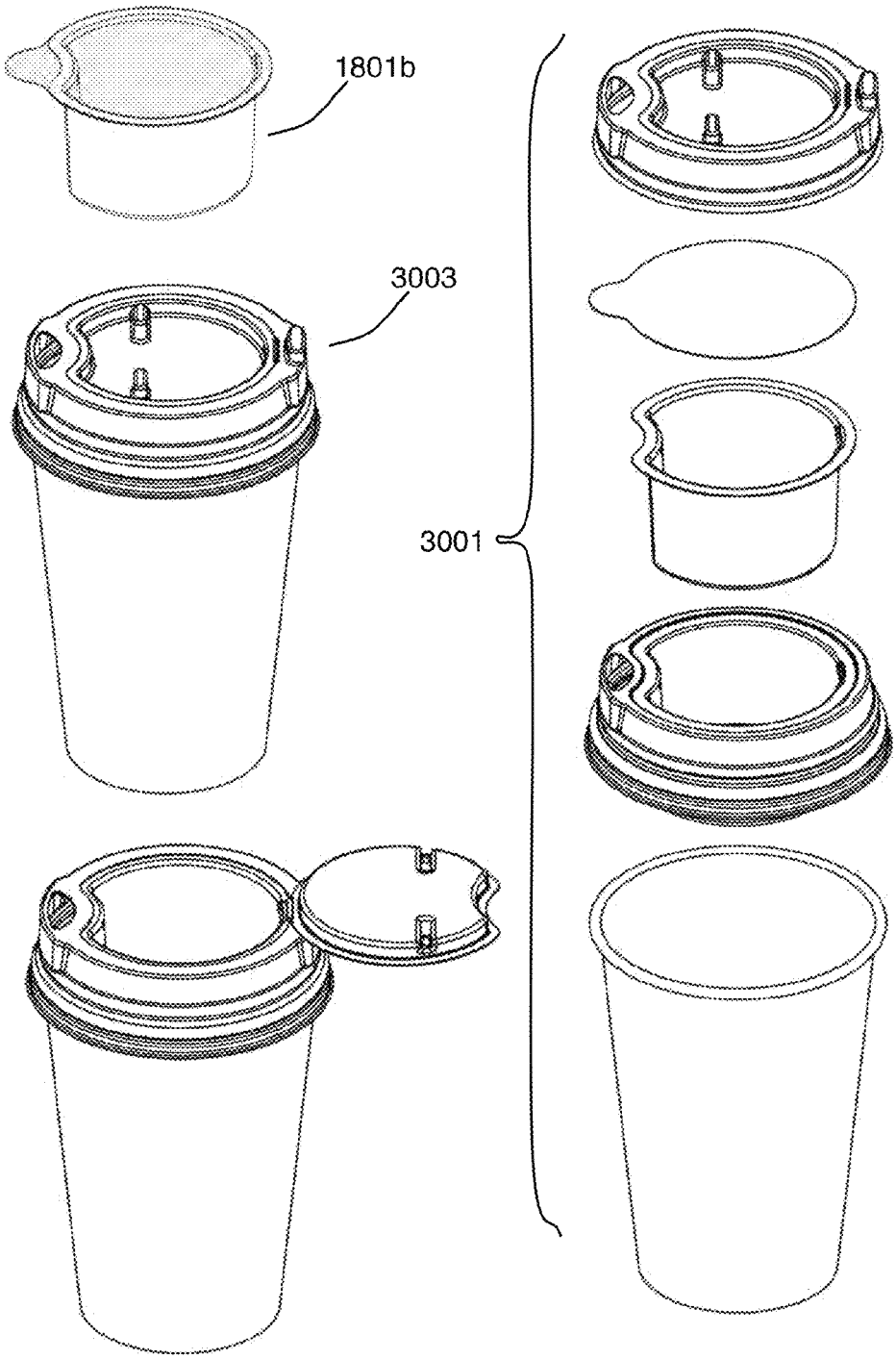
FIG. 30 illustrates an embodiment related to FIG. 28 configured for an independent drop-in/removable container.

FIG. 30 illustrates an embodiment configured for independent drop-in/removable container 1801*b*. As shown on the right side of the figure, exploded view 3001 shows the hinge lid/cover, seal-on/peel-off cover, container, cup lid and cup vertically oriented from top to bottom along with integrated view 3003.

Figure 31:
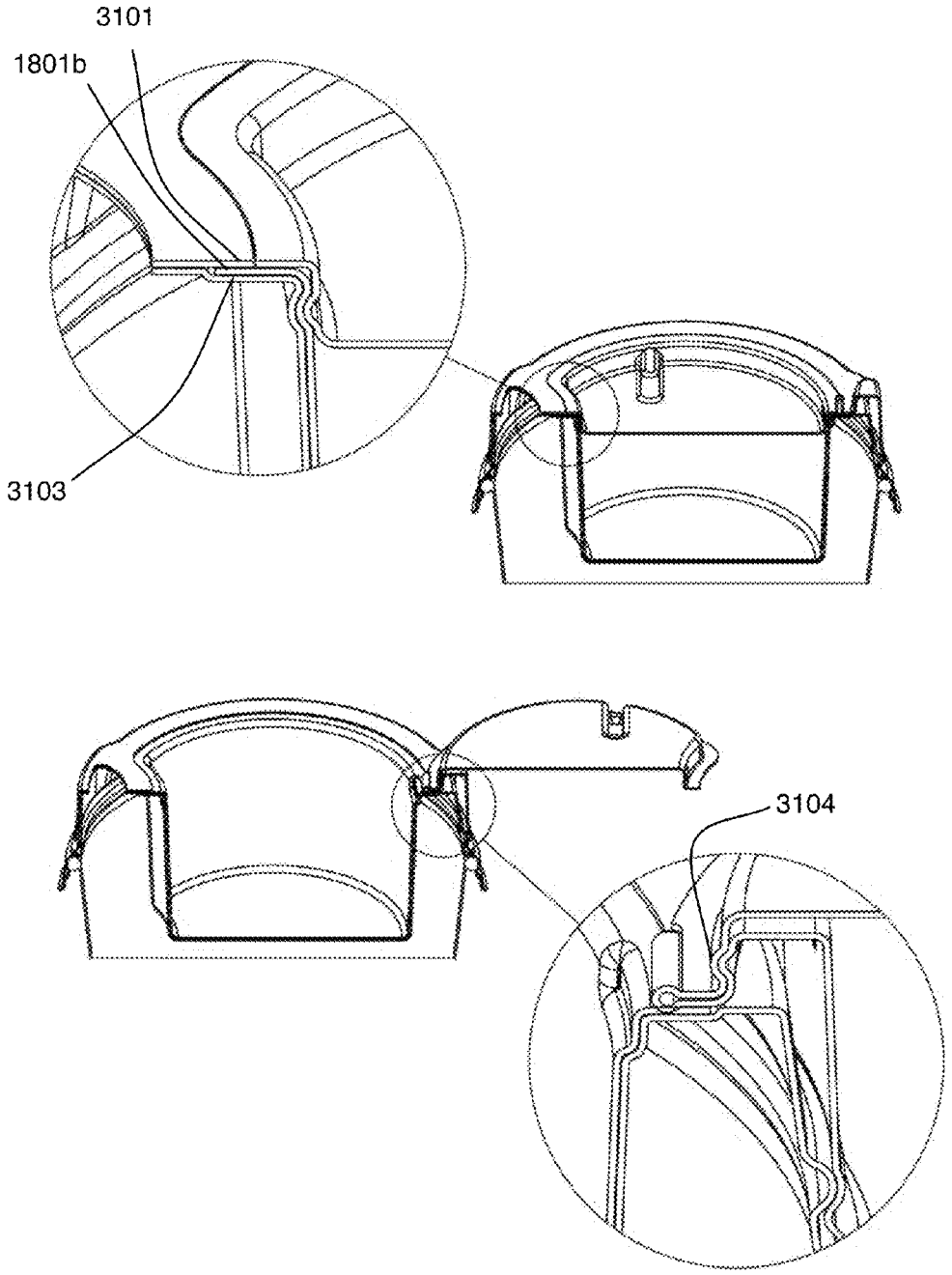
FIG. 31 illustrates an embodiment of FIG. 30 in further detail.

FIG. 31 illustrates an embodiment of FIG. 30 in further detail. As shown, the independent drop-in/removable container 1801*b* is held in place by being sandwiched between the bottom cup lid 3103 and the top hinge lid/cover 3101. Top hinge lid/cover 3101 overlaps the rim edges of the independent drop-in/removable container 1801*b* such that the container cannot exit the cavity, for example. Also shown in great detail is bump 3104 that enables the hinge lid to snap open, for example.

Figure 32:
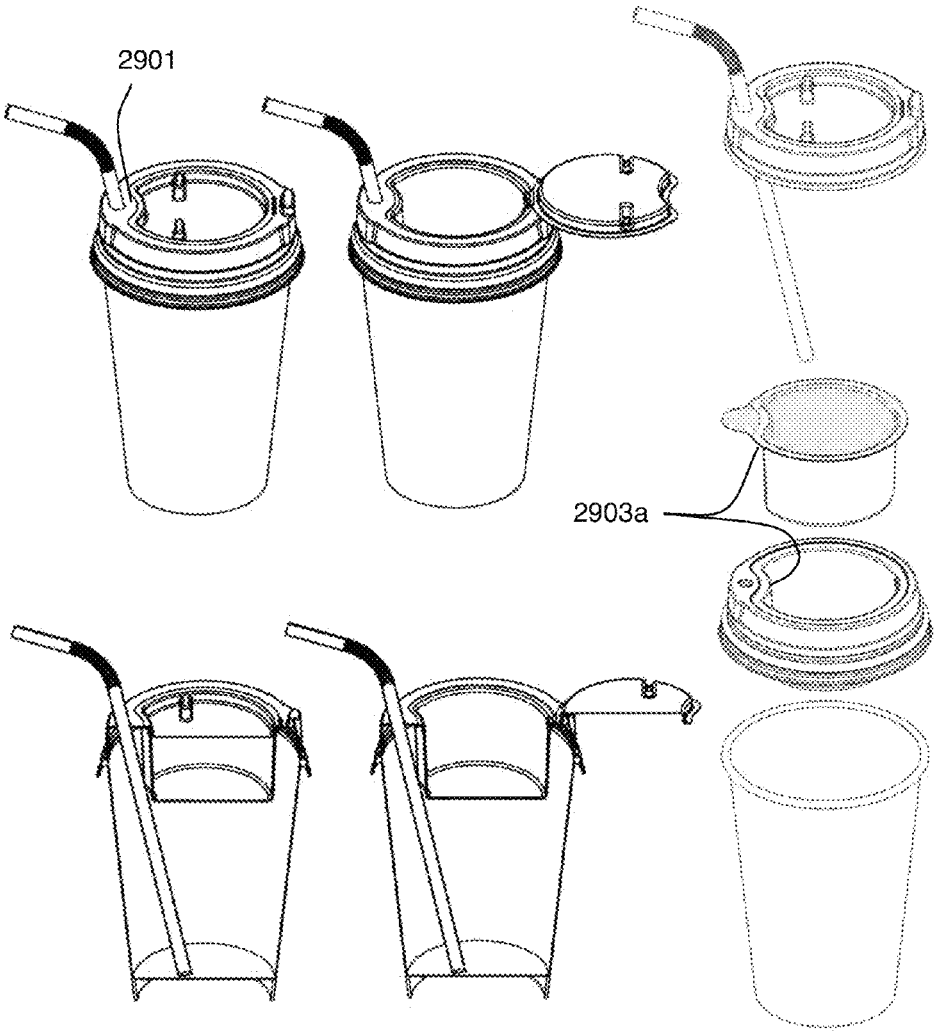
FIG. 32 illustrates an embodiment of FIG. 30 with a straw hole.

FIG. 32 illustrates an embodiment of FIG. 30 with a straw hole. The crescent-shaped inward indentation 2903*a* in the vertical sidewalls of the independent drop-in container and the cup lid container provide ample room for a straw to move freely within the lower main cup cavity without being constricted by the vertical side walls of the main cup and the vertical sidewalls of the inwardly located adjacent containers.

Figure 33:
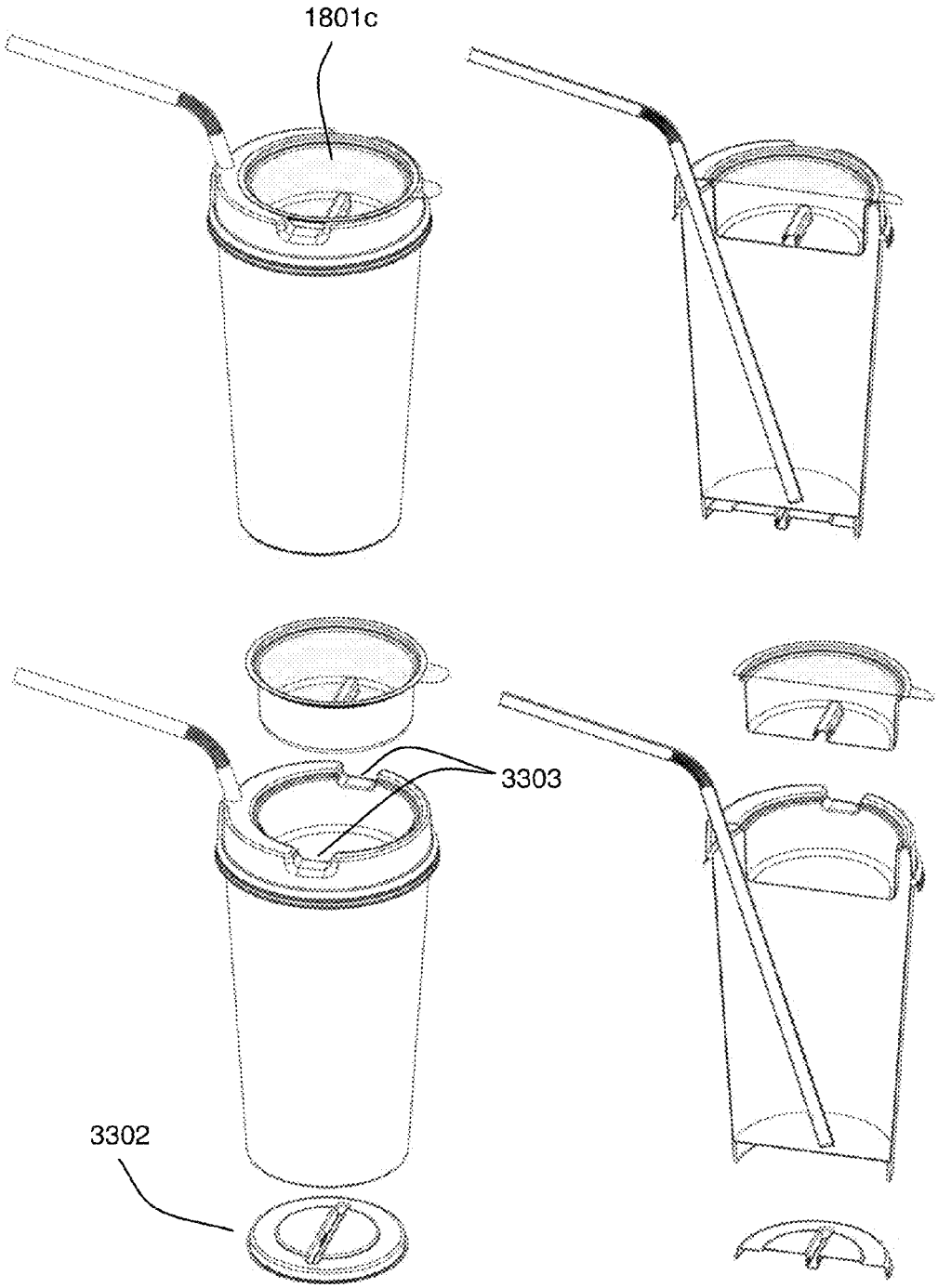
FIG. 33 illustrates an embodiment having a round-off center volume to hold an optional cup/arm rest independent drop-in/removable container and a straw hole and optional container cover configured to fit under the bottom of the large cup and also on top of the cup/armrest independent drop-in removable container as well.

FIG. 33 illustrates an embodiment having a round-off center volume to hold an optional cup/armrest independent drop-in/removable container 1801*c* and a straw hole and optional container cover 3302 configured to fit under the bottom of the large cup and also on top of the cup/armrest independent drop-in/removable container as well. A seal-on/peel-off cover may optionally be applied directly to the cup lid with cavity in place of using a cup/armrest independent drop-in removable container. Recesses 3303 may be of any depth, and may be optionally employed to enable container 1801 to be removed from the cup lid. These are shown at the bottom left configuration as two diagonally opposed slots. The upper right portion of the figure shows the optional drop-in container with seal-on/peel-off cover configured within the cup lid cavity in cutaway view. Although not shown for brevity, the optional drop-in container may have a medium-sized (for nuts and candy) score line (laser or any other method) in the seal-on/peel-off cover. The score line aligns with the removal tab located at the outside edge of the cover. When the drop-in container is removed from the lid cavity and the tab with medium-sized cover portion is removed, then the container may be lifted to the mouth, and a small amount of the contents may be shaken into the mouth, while the majority of the contents are retained within the container by the remaining cover material.

Figure 34:
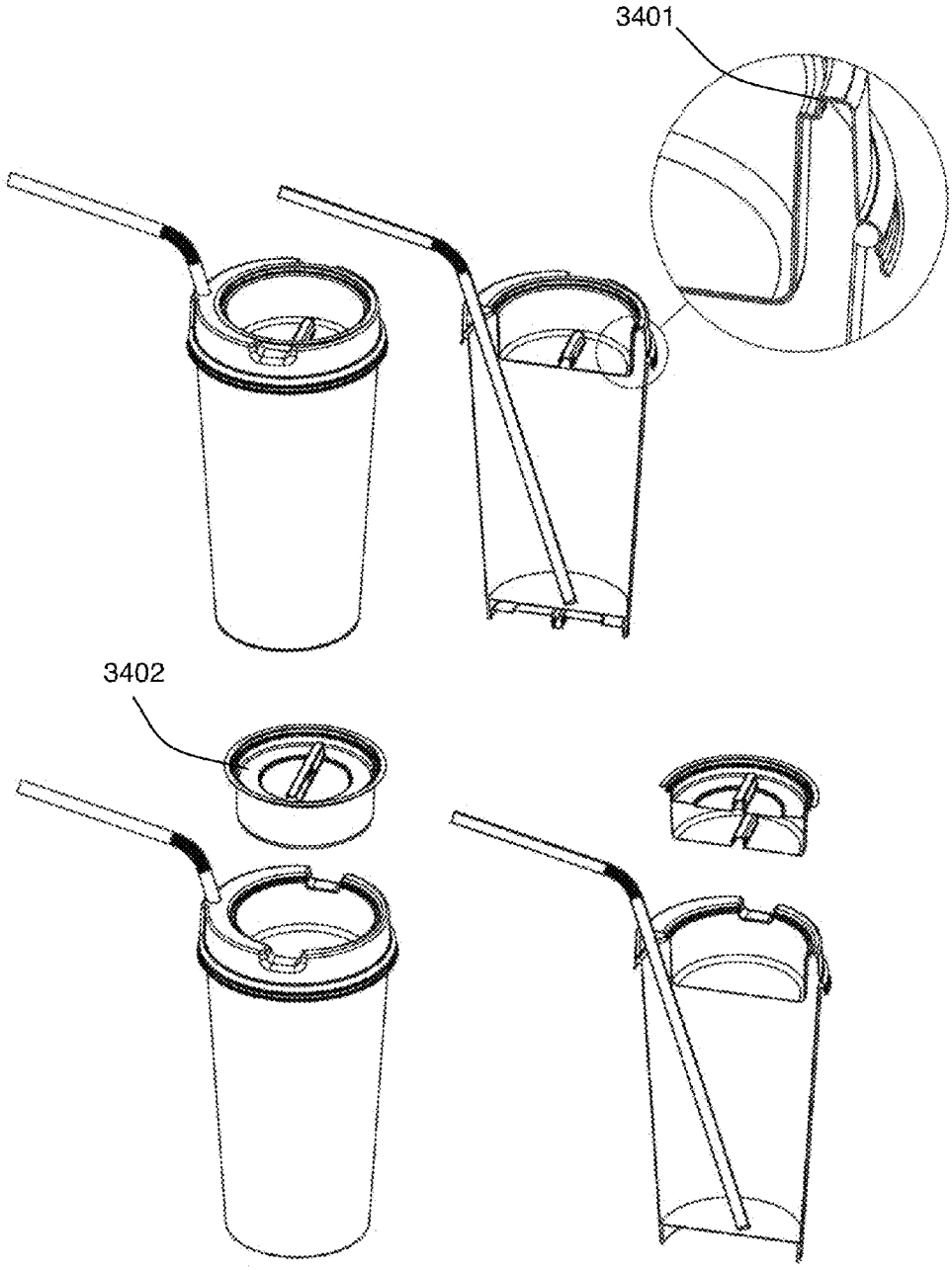
FIG. 34 illustrates the embodiment of FIG. 33 in greater detail.

FIG. 34 illustrates the embodiment of FIG. 33 in greater detail. As shown in the closed orientation, lid 3402 is situated on top of the cup/armrest independent drop-in/removable container to enable the container to be closed and taken home, for example. The diameter of the cup/armrest independent drop-in/removable container is configured to have a diameter as shown at 3401 that enables the armrest independent drop-in/removable container to fit within the hole of an armrest that is part of a seat in a theater or stadium, for example. Cover 3402 may be held to the bottom of the large cup and top of the independent drop-in container via friction or in any other manner for example. Cover 3402 may also be held to the bottom of the independent drop-in/removable container via male-female counterparts as shown, for example or in any other manner.

Figure 35:
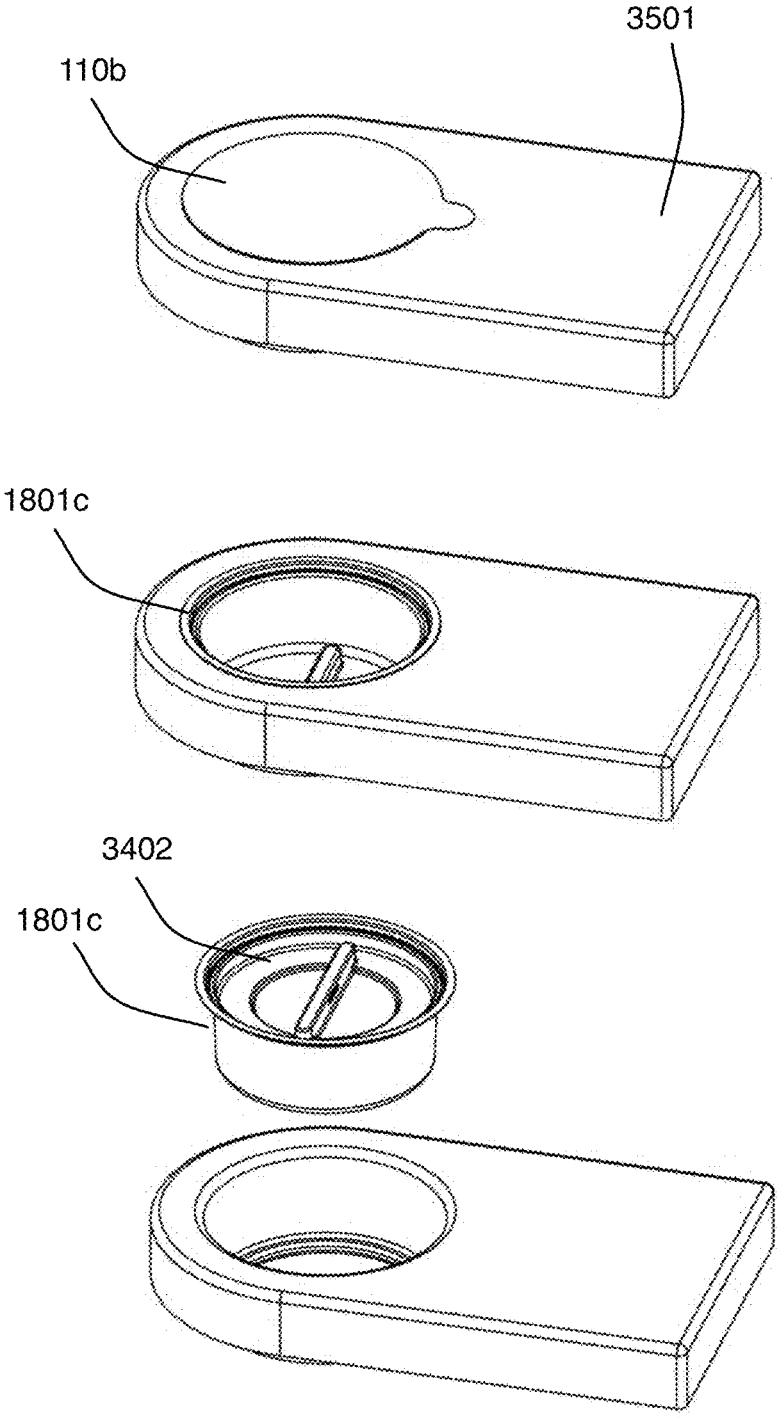
FIG. 35 illustrates the cup/arm rest independent drop-in/removable container in an armrest hole and shown in the bottom portion of the figure above the arm rest.

FIG. 35 illustrates the cup/armrest independent drop-in/removable container in an armrest hole and shown in the bottom portion of the figure above the armrest. Cup/armrest independent drop-in/removable container with seal-on/peel-off cover 110*b* is shown in armrest 3501. Container 1801*c* is shown without the seal-on/peel-off cover while in the hole of the armrest in the middle configuration. Container 1801*c* may be closed with cover 3402 and removed from the armrest and taken home, for example.

Figure 36:
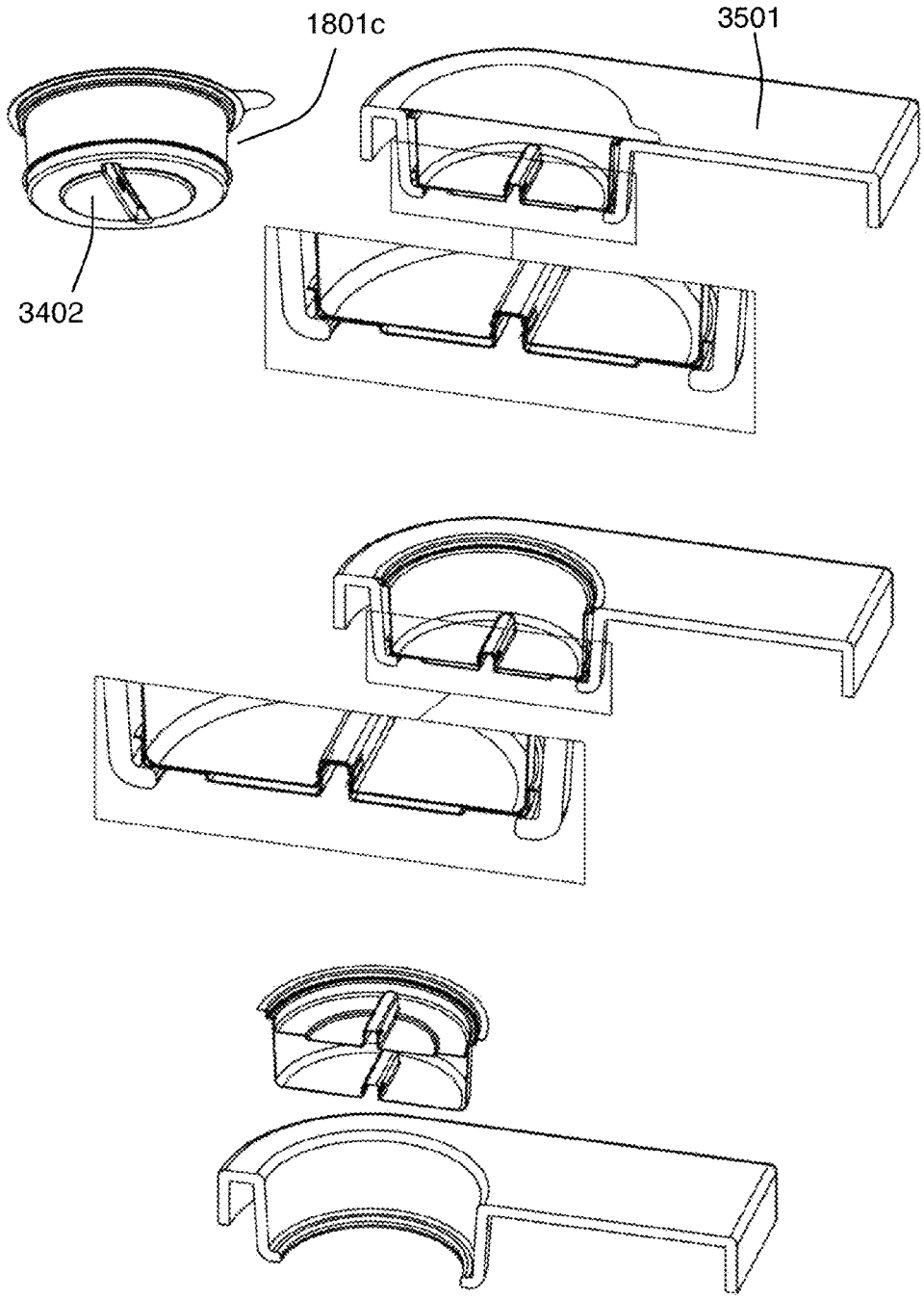
FIG. 36 illustrates a lower perspective view of the cup/armrest independent drop-in/removable container with container press-on friction cover also configured to fit the bottom of the cup/armrest independent drop-in/removable container on the bottom and top of the container.

FIG. 36 illustrates a lower perspective view of the cup/armrest independent drop-in/removable container 1801*c* with container cover 3402 also configured to fit the bottom of the cup/armrest independent drop-in/removable container on the bottom and top of the container. Cover 3402 may also be held to the bottom of the cup/armrest independent container via male/female counterparts as shown, for example, or by friction or any other mechanism or method.

Any embodiment of cup described herein may be made or include any material including but not limited to paper, plastic, hard molded plastic, ceramic, metal, stainless steel, and may utilize any type of optional seal such as silicon for example between the cup and the cup lid. Additionally, if the cup and cup lid are made of hard non-flexible plastic, for example, the secondary lid, which covers the integrated cavity, may be made entirely from molded silicon of various hardness values. Embodiments employing hard plastic may utilize an insulative double wall construction in the vertical sidewalls and/or bottom of the lower main cup as desired per application. Reusable or disposable embodiments may be constructed in one or more embodiments through selection of materials targeted at the particular use, as one skilled in the art will appreciate.

Embodiments of the invention may be utilized with the BOTTOMS-UP™ draft beer dispensing system that fills beers from the bottom of the cup, or with any other dispensing system. Embodiments of the invention may be utilized with INSULAIR™ insulated cups or any other insulated cup.

Figure 37:
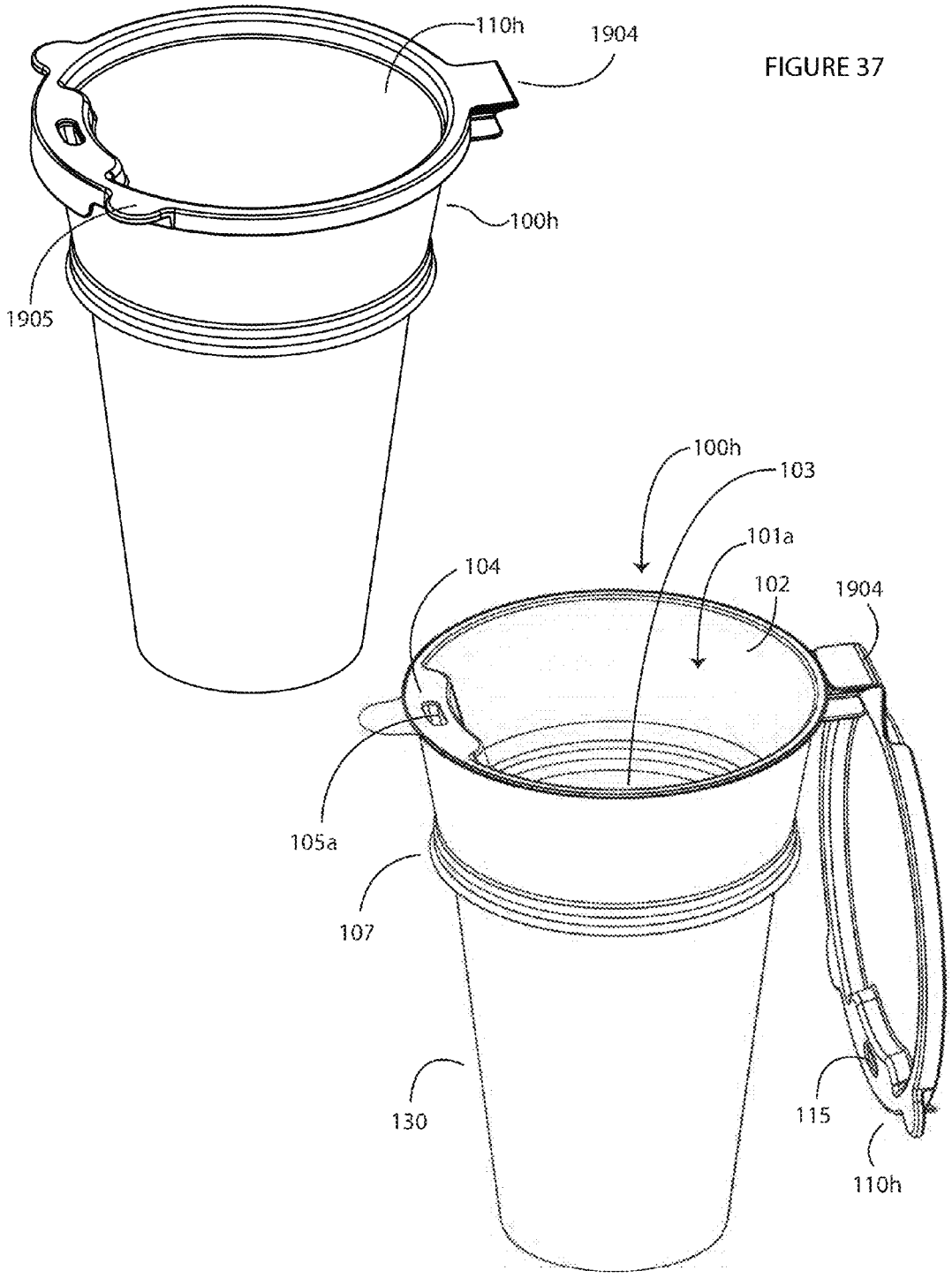
FIG. 37 illustrates an embodiment of the snap-on hinge cover attached to the lid/container and cup in closed and open configurations.
Figure 44:
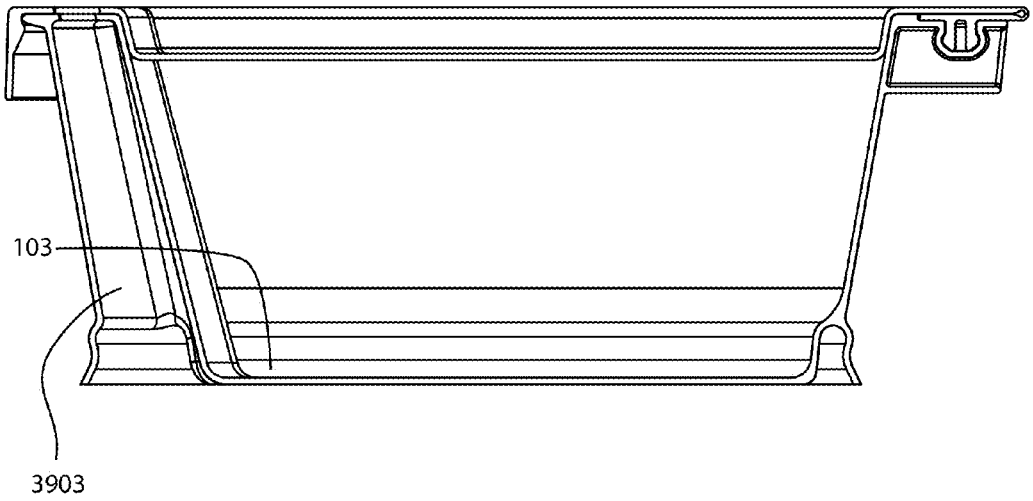
FIG. 44 illustrates cutaway views of the hinge cover and lid/container of FIG. 37.
Figure 44:
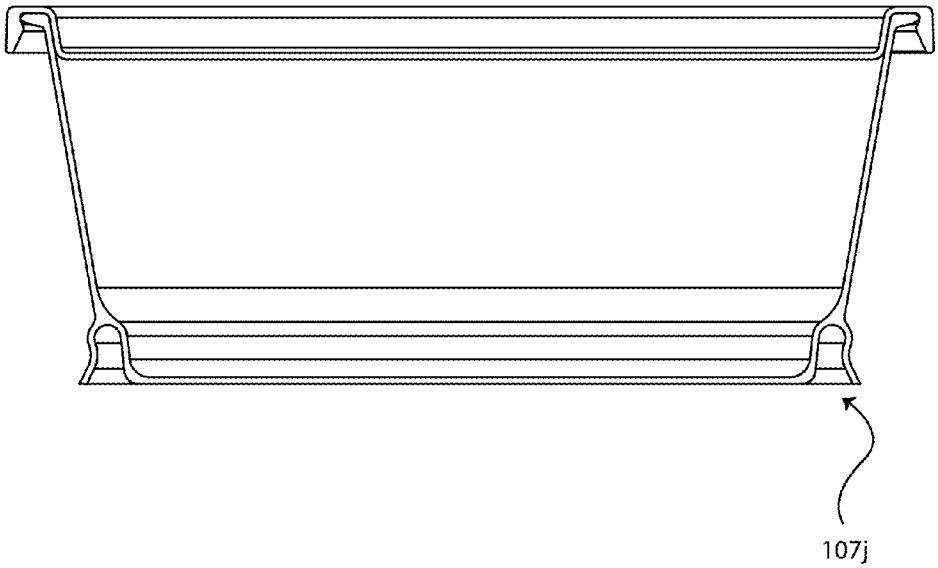

FIG. 37 illustrates an embodiment of the snap on hinge cover, lid/container and cup in closed and open configurations in the upper left and lower right, respectively. As shown, cover 110*h* may include grasp/lift tabs 1905 as is also the case in the embodiment shown in FIG. 19, 19A for example. In the embodiment shown, the score-line hinge 1904 is located on the outer portion of the cover 110*h*, shown to the right outside portion of cover 110*h* in the upper left configuration. Being located on the outer portion means the score-line part of the hinge is located outside of the circular diameter that forms the rim of cover 110*h* and in one or more embodiments at or outside of the opening of the cup, i.e., away from the centerline of the conical section forming the cup. The hinge score-line may also be located proximal to the outer diameter of cover 110*h*. The lower lip bumper/cushion which is an integrated feature of the top cover and is shown as a relatively short one-piece sectional attachment to the left of grasp/lift tab 1905 in the upper figure, may also be made as a continuous, elongated, circular configuration which proceeds all the way around the bottom edge of the cover's vertical lip to where there is a cutout in the clip-on vertical lip edge near the diagonally opposed hinge. This design provides a continuous elongated circular lower lip bumper, which may provide for easier stacking and conveying of covers during manufacturing, processing, assembly and shipping. In the lower right configuration, lid/container cavity 101*a* is exposed when hinge cover 110*h* is opened and rotated to 180 degrees in some embodiments, or to at least 270 degrees as shown, with respect to the closed configuration shown in the upper left. As shown, hole 105*a* enables second liquid or solid to be accessed without disengaging lid/container 100*h*. In one or more embodiments, horizontal area 104 may house hole 105*a*, or the hole may be raised as is shown in FIG. 19 (see elements 105*e*, 105*e*1 and 105*e*2). If raised, then cover 110*h* may utilize a corresponding raise area or a cutout that allows cover 110*h* to remain relatively flat for example. Other elements shown are as described with respect to the other embodiments previously described, including wall 102, container bottom 103, coupling element 107, cover hole 115 and the single score-line, double score-line or trough element of hinge 1904, for example. The embodiment as shown at the lower right includes an optional seal-on/peel-off layer that covers cavity 101*a* which includes a removable laser or die-scored tab shown adjacent to sip hole 105*a*, but which may be oriented at any location along the outer rim of the lid/container. Coupling element 107 may use single wall exterior friction to attach to cup 130 in previous embodiments, or coupling element 107*j* may use double wall, i.e., interior and exterior wall friction, (facilitated via injection molding), as shown in FIG. 44 as element 107*j* that attaches to cup 130.

Figure 38:
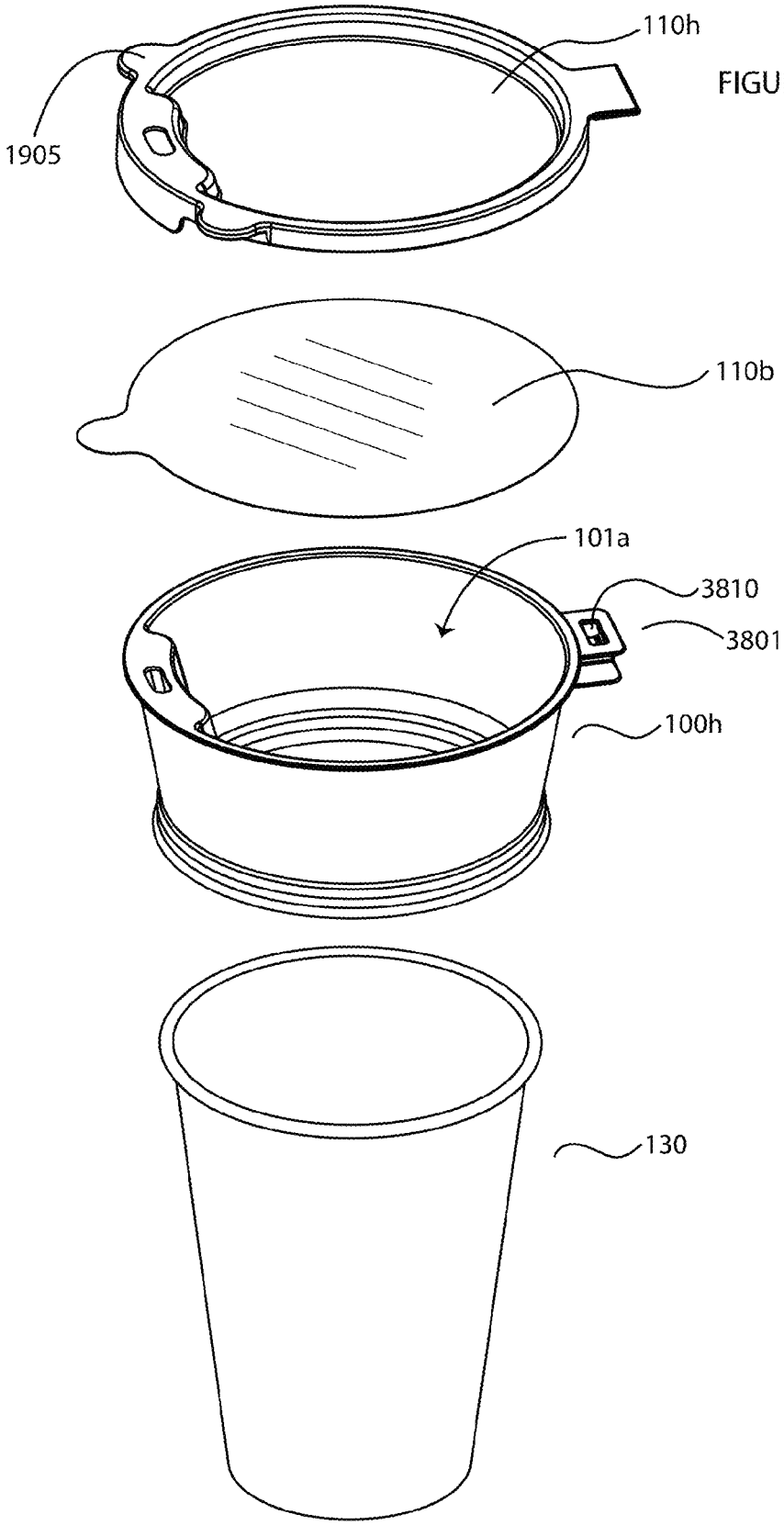
FIG. 38 illustrates an exploded view of the embodiment of FIG. 37.

FIG. 38 illustrates an exploded view of the embodiment of FIG. 37. As shown, seal-on/peel-off layer 110*b* may be utilized to enclose the contents of cavity 101*a*. The seal-on/peel-off layer may be thin enough for the tab to fold and sandwich between the top cover and lid/container when the top cover is in the closed position. The seal-on/peel-off layer is optional and if the lid/container comes with the seal-on/peel-off layer attached with a food or liquid in the container, the seal-on/peel-off layer may be removed by a third party, such as a salesperson, or any other person, and the separate clip on top cover may then be attached. In effect the end-consumer may not know that a seal-on/peel-off layer was attached just moments prior to being presented with the apparatus. The outer peripheral edge clip-on assembly 3801 provides a female indentation 3810 in which to snap corresponding male protrusion(s) on cover 110*h*. Other embodiments may utilize one-piece construction to attach the top cover to the lid/container with no snap on element.

FIG. 39 illustrates a top and bottom perspective view of the embodiment of FIG. 37. As shown in the upper left, crescent shaped inward indentation or fluid transfer tunnel 3903 enables liquid to be accessed via hole 105*a* and/or cover hole 115.

Figure 40:
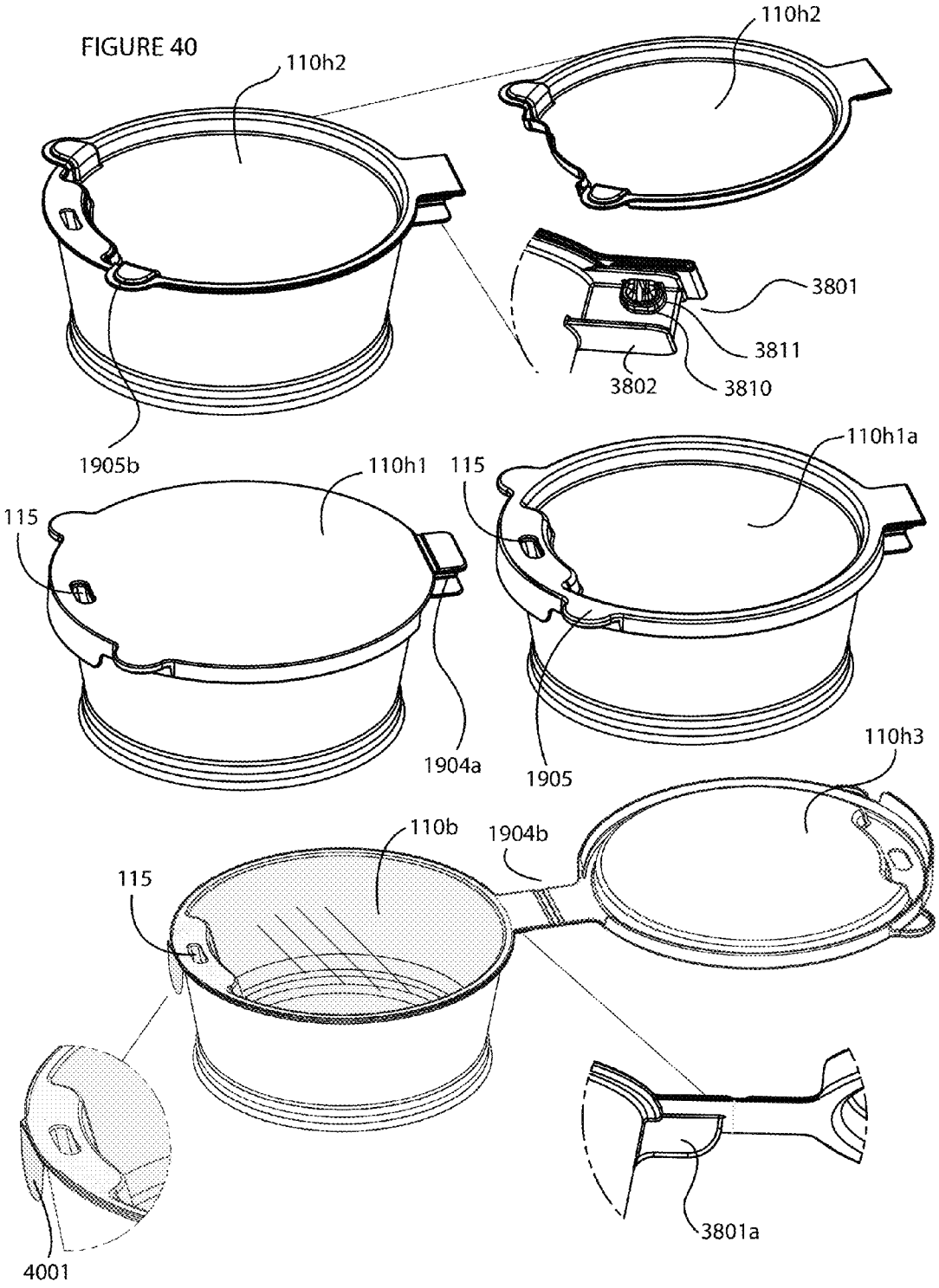
FIG. 40 illustrates four embodiments of the hinge cover and lid/container along with the optional seal-on/peel off layer.

FIG. 40 illustrates four embodiments of the hinge cover along with the optional seal-on/peel-off layer. Covers may be recessed, so as to remain out of the way of the user's nose when drinking, flat, or recessed with a cutout at the mouth or upper lip area location as shown to the upper left and right in a perspective as cover **110*h*2. The cutout at the mouth or upper lip area eliminates one layer of plastic, which may prevent liquid from getting trapped between two layers of plastic and leaking down into the lid/container or down the side of the drink cup. When there is a cutout at the mouth or upper lip area in the top cover, additionally there is no lower lip bumper/cushion in one or more embodiments of the invention. The recessed cover with the mouthpiece cutout utilizes a downward press-on friction fit against the interior wall of the lid/container in one or more embodiments; thus, this cover has no lip or external wall surface clip system extending down from the outside circular edge of the cover rim. Covers may be attached to the lid/container through clip-on methods, or may come attached to the lid/container as the result of a bridge and one piece construction. The three types of hinges illustrated in the various embodiments may be interchanged and utilized on other embodiments of the cover as desired. In the upper left area, grasp/lift tabs 1905*b* may be utilized that may not extend over corresponding flat portions of cup lid 100*h*. At the lower right of the upper left corner image is a magnified view of a portion of the cover and the outer peripheral edge clip-on assembly 3801 having female indentation 3810 and male protrusion(s) 3811 and bottom portion 3802 that provides a flat area enable manual coupling of male protrusion(s) 3811 into female indentation 3810 by providing a flat area to press against while inserting the male protrusion(s). Also shown in the middle left area is cover 110*h*1, with the second type of hinge, namely a top horizontal surface mid-way score-line clip-on hinge 1904*a* coupled with a flat embodiment of the cover. To the right are shown grasp/lift tabs 1905 that may extend outward from the main body of cover 110*h*, for example. There are sip holes 115 through the top horizontal surface of the recessed and flat covers that both clip-on and attach as a one piece construction; however the recessed cover that has a cutout opening at the mouth location as shown in the upper left has no sip hole cutout due to the fact that there is no plastic to put a hole through at this location. In addition, optional seal-on/peel-off layer 110*b* is shown in the bottom embodiment with one-piece construction wherein one-piece hinge bridge and score-line 1904*b* is part of cup lid/container 100*h* and cover 110*h*. The lower left area shows a close up of the seal-on/peel-off layer 110*b*, for example, having a bent tab 4001 as occurs when cover 110*h*3 is closed against the lid/container 100*h*. The top horizontal surface mid-way score-line clip-on hinge 1904*a* generally only opens to a horizontal position. The outer peripheral edge score-line clip-on hinge 1904 and one piece score-line hinge 1904*b* both may open to a vertical orientation, which additionally places the lid in an outwardly located position, which means cover 110*h*** does not interfere with the user's fingers or hand as the user holds the cup. The three hinge types described above are shown from a bottom perspective in the following figure.

Figure 41:
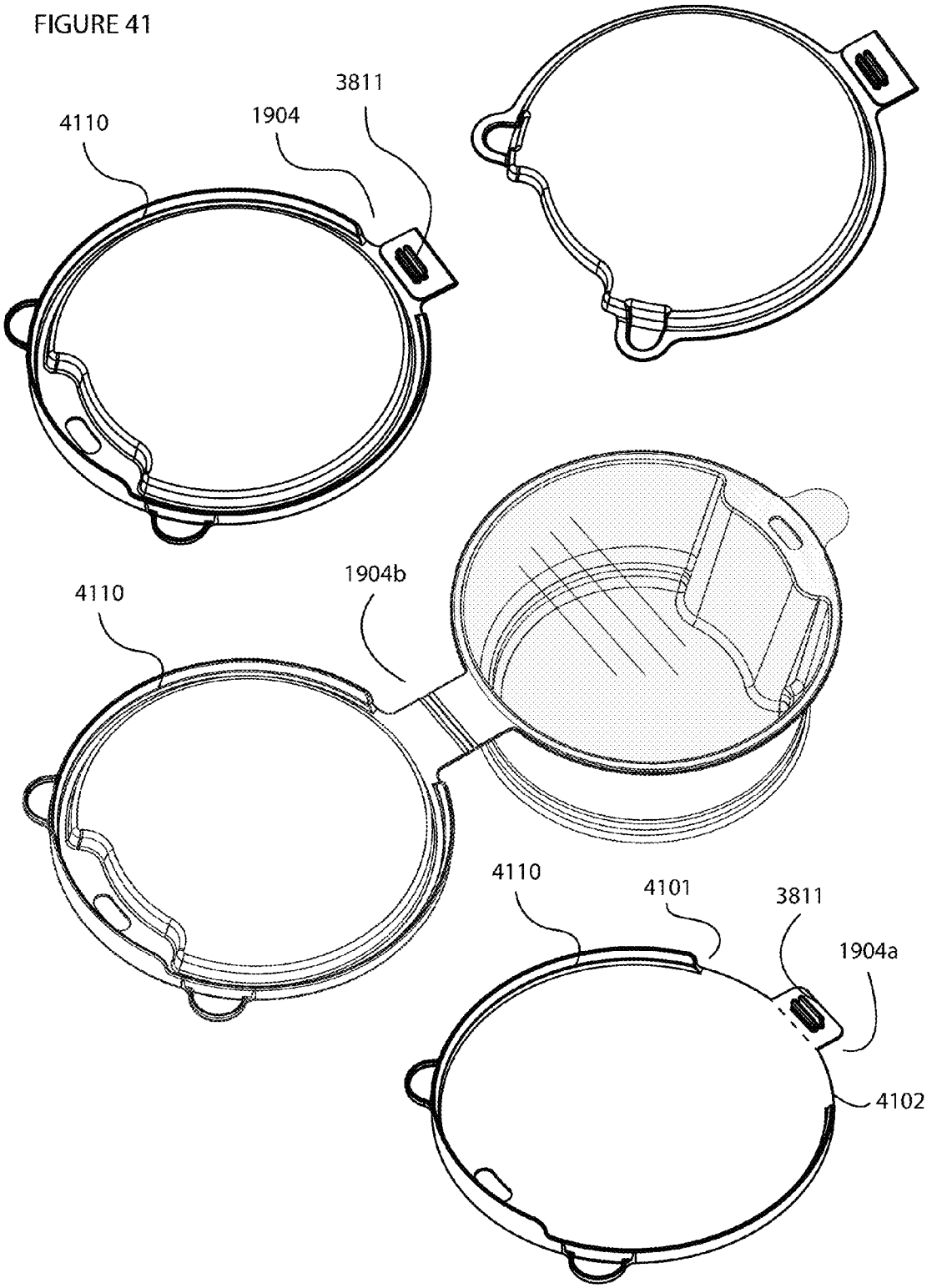
FIG. 41 illustrates a bottom perspective view of the four embodiments of hinge covers along with the optional seal-on/peal-off layer of FIG. 40.

FIG. 41 illustrates a bottom perspective view of the three embodiments of hinge covers of FIG. 40. As shown in the upper left area, score-line hinge 1904 folds near the outermost location of the hinge. This enables 270 or more degrees of rotation about the hinge as is shown in the bottom right area of FIG. 37. Score-line hinge **1904*b* also enables at least 270 degrees of rotation in the one-piece construction embodiment. The area in the bottom right shows an embodiment of hinge 1904*a* that folds near the inner portion of male protrusion(s) 3811 with respect to the center of the cover. This enables up to 180 degrees of rotation. The corner edges 4101 and 4102 show the top horizontal surface mid-way score-line clip on hinge cover utilizes a larger cutout opening in the cover's downward clip-on lip edge at the hinge location such that the cover overhanging lip edge does not interfere with the lip of the lower lid/container opening while closing. The three covers on the lower portion of the page show clip ridge/bump 4110 which secures covers 110*h*1, 110*h*1*a*, 110*h*3** to the lower lid/container rim by projecting inward after passing the lid/container rim during the process of being pressed closed.

Figure 42:
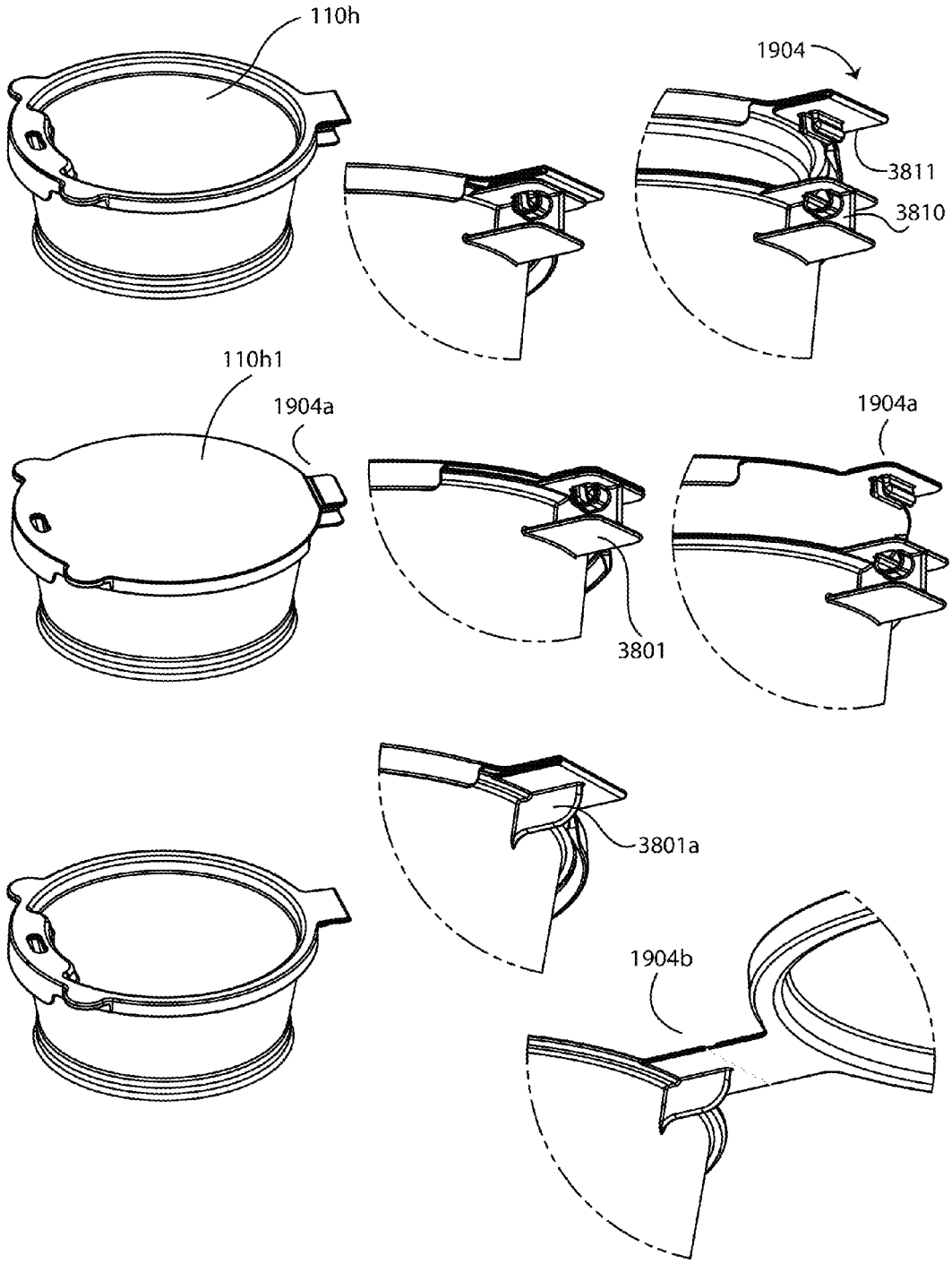
FIG. 42 illustrates a close-up perspective view of the three hinge cover embodiments of FIG. 40.

FIG. 42 illustrates a close-up perspective view of the three embodiments of hinge covers of FIG. 40. The embodiment shown in the top area includes the outer score-line hinge 1904 showing male protrusion(s) 3811 expanded over female indentation 3810 in the upper right before interconnecting or otherwise snapping the two elements together to form the embodiment shown in the upper middle area and upper left area. The flat embodiment of cover **110*h*1 is shown with score-line hinge embodiment 1904*a*** in the middle area while the one-piece construction embodiment is shown in lower perspective view in the bottom area of the figure.

Figure 43:
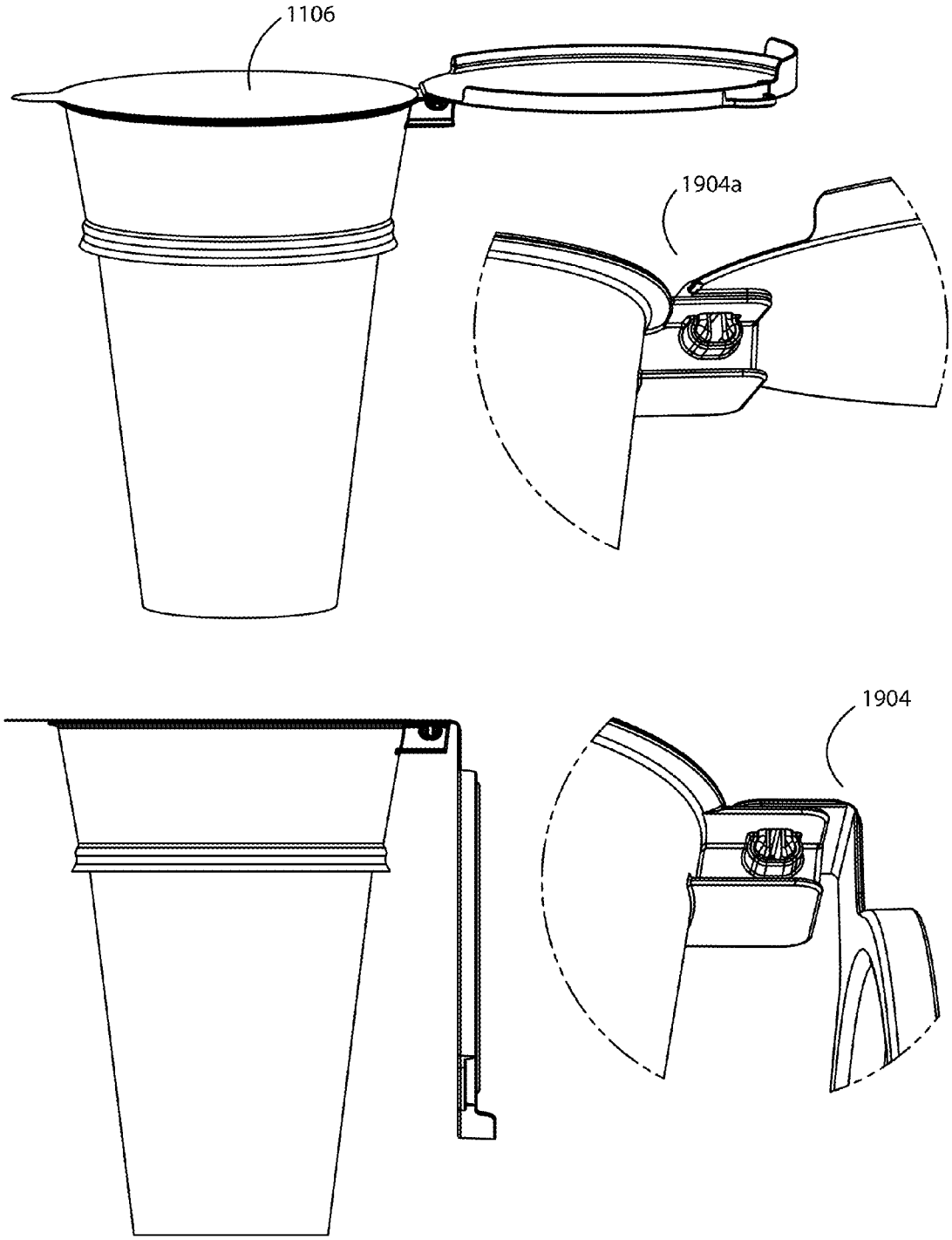
FIG. 43 illustrates two embodiments of the hinge for two-piece snap-on embodiments of the hinge cover and lid/container of FIG. 40.

FIG. 43 illustrates two embodiments of the hinge for two-piece embodiments of the hinge covers of FIG. 40. As shown in the upper area, seal-on/peel-off layer **110*b*may be included if desired and, for example, based on the contents to be held in the cavity. The close-ups on the right side show the 180 degree embodiment of score-line hinge 1904*a* and the at least 270 degree embodiment score-line hinge 1904 and score-line hinge 1904*b*. The lower left image shows the top cover in the 270** position, which leaves ample room for the user's fingers and hand while holding the cup. In one or more embodiments of the invention, the at least one wall may include a hinge base with a snap element that couples with a corresponding snap element on the cover. In at least one embodiment of the invention, the hinge base may include a snap element that couples with two male snap elements on the cover. By way of one or more embodiments the hinge base may include a flat portion parallel to a plane defined by the cover when the cover is closed, wherein the hinge base provides a support against which to snap the cover to the hinge base. In at least one embodiment of the invention, the at least one wall may include a hinge support that lies in a plane that is orthogonal to an axis in which said hinge rotates.

FIG. 44 illustrates cutaway views of the hinge covers and lid/container of FIG. 37. The top image shows the fluid transfer tunnel 3903 as a two wall construction which may be achieved through the process of injection molding.

Figure 45:
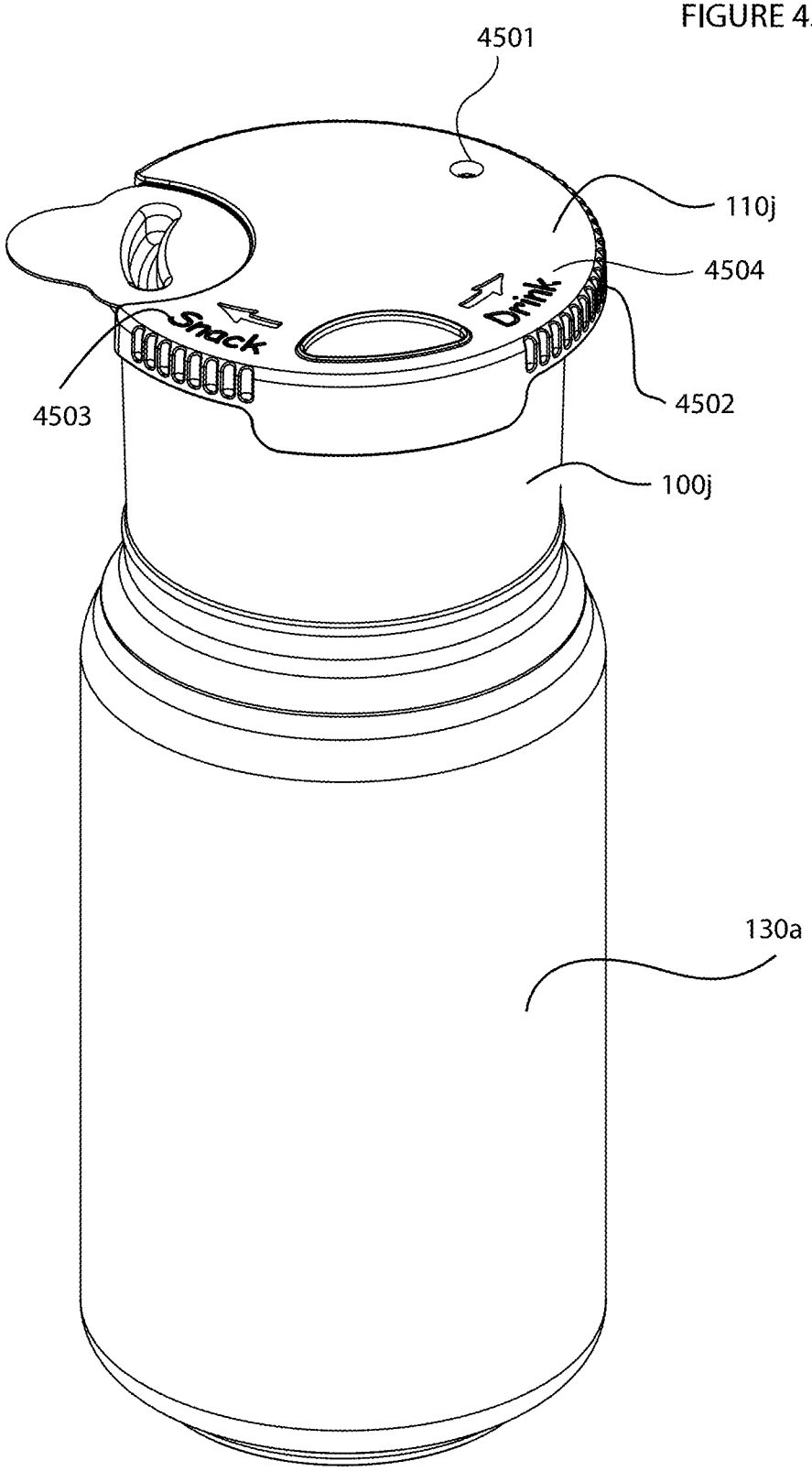
FIG. 45 illustrates a rotational cover with a closeable embodiment of the invention having a rotational trough and stop post, with an optional seal-on/peel-off cover, opening to enable access of the contents of the container by lifting and pouring the contents into the mouth.
Figure 46:
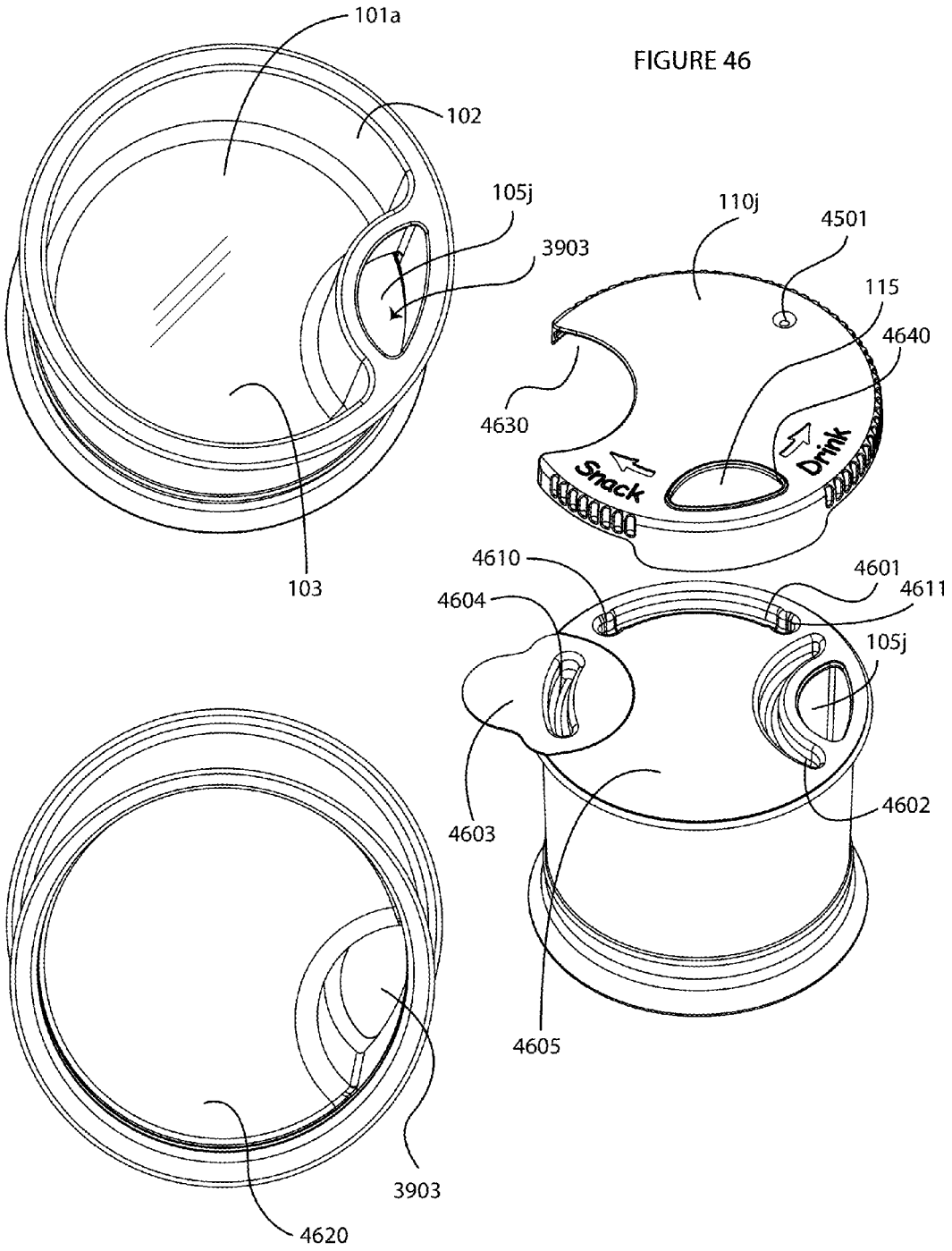
FIG. 46 illustrates top and bottom perspective views of the embodiment of FIG. 45.

FIG. 45 illustrates rotational cover **110*j* that implements a closeable embodiment of the invention along with cover 110*j* having a rotational click-stop post 4501 (see FIG. 46 for rotational trough 4601 and vertical wall click-stop bumps 4610 and 4611). The right side of the embodiment shows an optional laser or die scored seal-on/peel-off tab 4603, also shown on the left side of the embodiment (see also FIG. 46), and opening 115 to enable access of the contents of the can/cup by lifting and pouring the contents into the mouth when cover 110*j* is in one counterclockwise click-stop rotational setting, while enabling access to the contents of the lid/container 100*j* via a crescent shaped cutout through the outer circular rim of cover 110*j* at a second clockwise click-stop rotational setting. Access to the contents of the can 130*a* or a cup (not shown), is restricted or otherwise disabled by turning cover 110*j* to the clockwise click-stop rotational setting while access to the top lid/container is restricted or otherwise disabled by turning cover 110*j* to the counterclockwise click-stop rotational setting. The lid/container may optionally be divided or segmented into additional compartments thus adding additional click-stop rotational settings. There may be more than two click-stop rotational settings in other embodiments of the invention. Rotation or turning of cover 110*j* is aided by vertical bumps or ridges 4502 that may be inward or outward oriented and information indicators 4503 and 4504** for example. Indicators 4503 and 4504 may be recessed for added non-detectable comfort in relation to the user's lips or mouth. There may be a small raised tactile type ridge 4640 that surrounds the outer edge or a portion thereof of sip/gulp hole 115. The tactile ridge may operate as a sensory hole locating system for the lips.

FIG. 46 illustrates top and bottom perspective views of the embodiment of FIG. 45. As shown in the upper left, cavity 101*a* is bounded by wall 102 and bottom 103 along with the wall that forms the fluid transfer tunnel 3903 for opening or hole 105*j*. The upper right area shows cover 110*j* with stop post 4501, sip/gulp hole 115 and cutout 4630 (cut through the outer circular rim of cover 110*j*) above the embodiment of the invention configured to hold the first solid or liquid. The lower right area shows seal-on/peel-off layer 4605 rotational click-stop trough 4601, vertical wall trough click-stop bumps 4610 and 4611, alignment trough 4602, alignment trough 4604, (for example range limited to less than 360 degrees of rotation in one embodiment), tab 4603, and sip gulp hole 105*j* through the seal-on/peel-off layer 4605. The rotational trough 4601 for rotational click-stop post 4501 also acts as an alignment trough (along with alignment trough 4603 and 4604) for the seal-on/peel-off layer 4605. Aligning the seal-on/peel-off layer over the lid/container 100*j* facilitates easier and more accurate heat sealing of the of the layer to the lid/container during manufacturing or if the seal-on/peel-off layer is not sealed on and is reusable and made from hard plastic the alignment troughs facilitate replacement of the layer after filing the lid/container with items of the user's choice. The bottom side of the lid/container is shown in the lower left as bottom 4620 while element 3903 shows both vertical side walls and the top horizontal surface wall adjacent to the sip/gulp hole 115 that together form the fluid transfer tunnel. Layer 4605 may be constructed from hard plastic and press fit onto cup/lid 110*j* rather than being heat sealed or using adhesive, therefore layer 4605 may be removed and replaced for reuse if desired. Furthermore, in the above scenario, the seal-on/peel-off layer 4605 would come without laser or die score tab 4603. In effect, the end user could fill the lid/container 100*j* with nuts or items of their choice and reseal the lid/container with the press-fit layer 4605.

Figure 47:
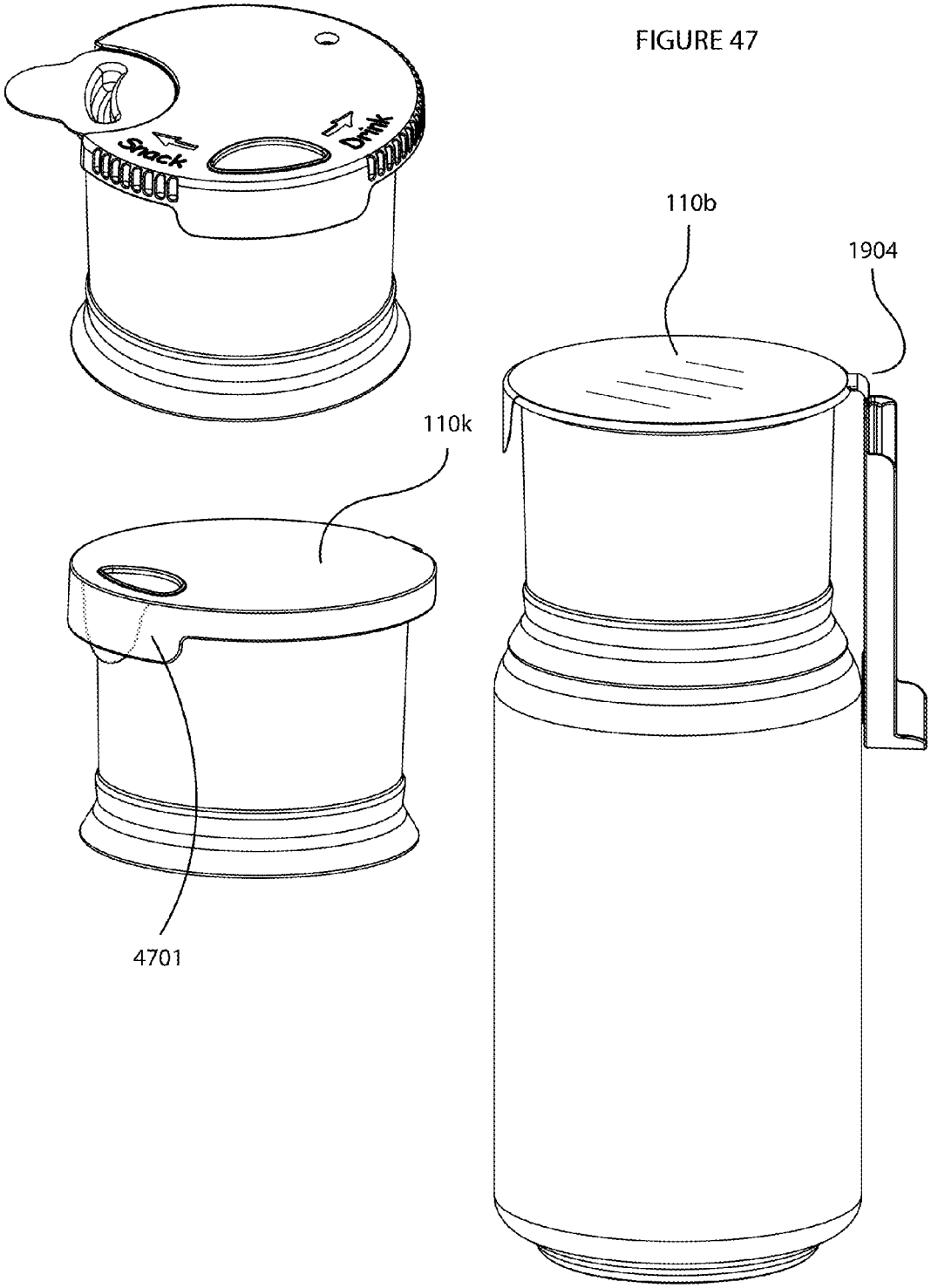
FIG. 47 illustrates a top perspective view of the embodiment of FIG. 45 along with a hinge lid cover embodiment.

FIG. 47 illustrates a top perspective view of the embodiment of FIG. 45 along with a one-piece hinge cover embodiment 110*k* below, showing lip bumper/cushion 4701 which may be continuous for stacking and manufacturing. Cover 110*k* may open as shown in the right via a one-piece connecting bridge and score-line hinge 1904 to expose seal-on/peel-off layer 110*b*.

Figure 48:
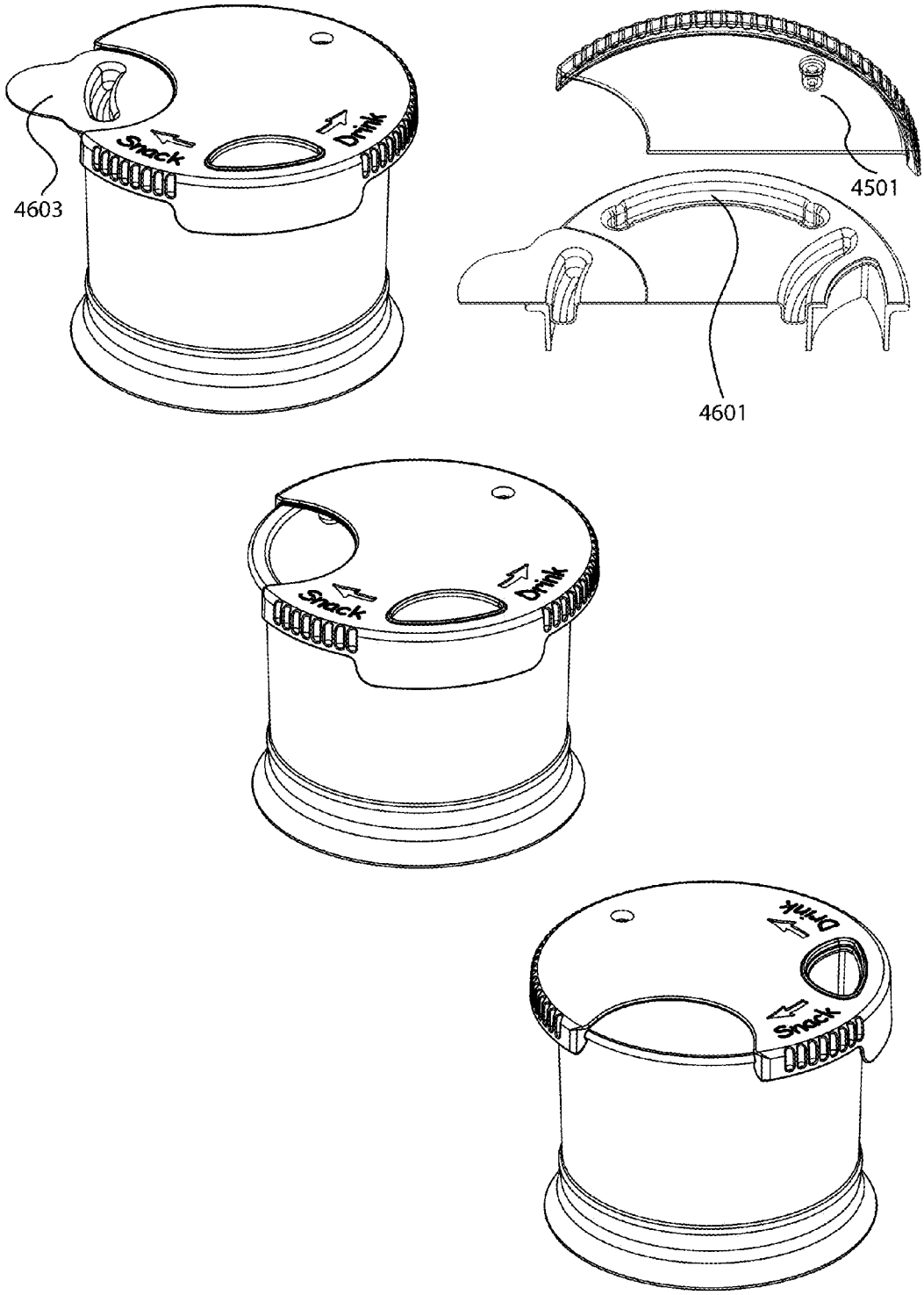
FIG. 48 illustrates a top perspective view of the closeable embodiment of FIG. 45 at three rotational values.

FIG. 48 illustrates a top perspective view of the closeable embodiment of FIG. 45 at three rotational values. Namely as rotational stop post 4501 travels in rotational limited trough 4601 it is allowed to travel through a limited clockwise and counterclockwise rotational range and then clicks into place when in the desired position via the click-stop bumps 4610 and 4611 located in the vertical wall of the trough. After removing tab 4603, contents of the lid/container are available as shown in the middle area. The lower left area shows a second rotational setting that enables contents of the can/cup below to be accessed.

Figure 49:
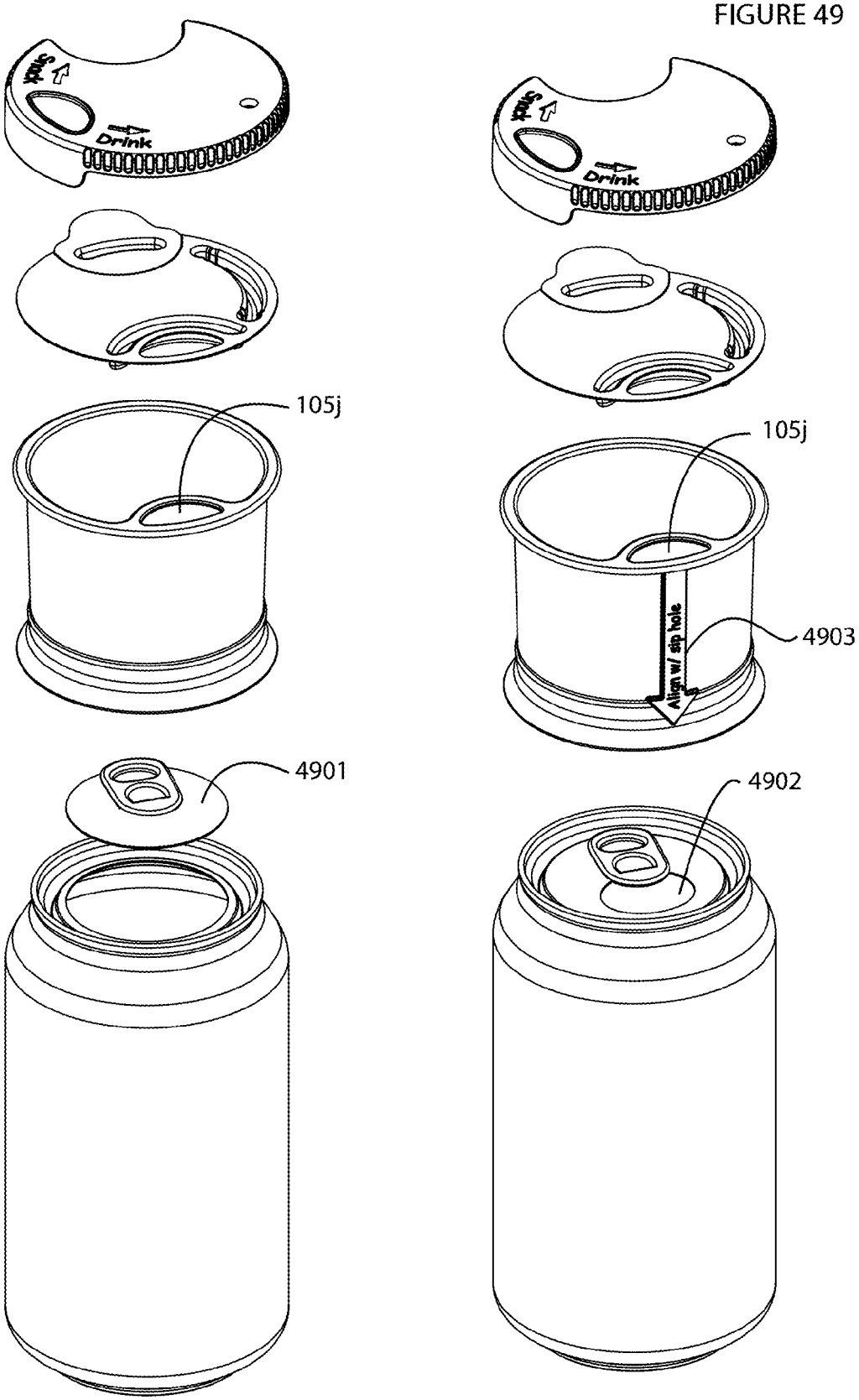
FIG. 49 illustrates embodiments of the invention for wide mouth cans or cups and standard cans.

FIG. 49 illustrates embodiments of the invention for full aperture wide mouth cans or cups on the left and standard cans on the right. By removing the full aperture can lid 4901, embodiments of the invention may be fastened to the top of the can in any manner without any regard given to the orientation of the top lid/container in relation to access of the contents of the can. This embodiment may thus be utilized with cups, for example. The embodiment on the right may include a standard size aperture or opening and an indicator 4903 that indicates the optimal orientation of the top container in relation to the can opening. The indicator 4903 is used to align the fluid transfer tunnel 3903 and hole 105*j* with the opening in the can 4902 below.

Figure 50:
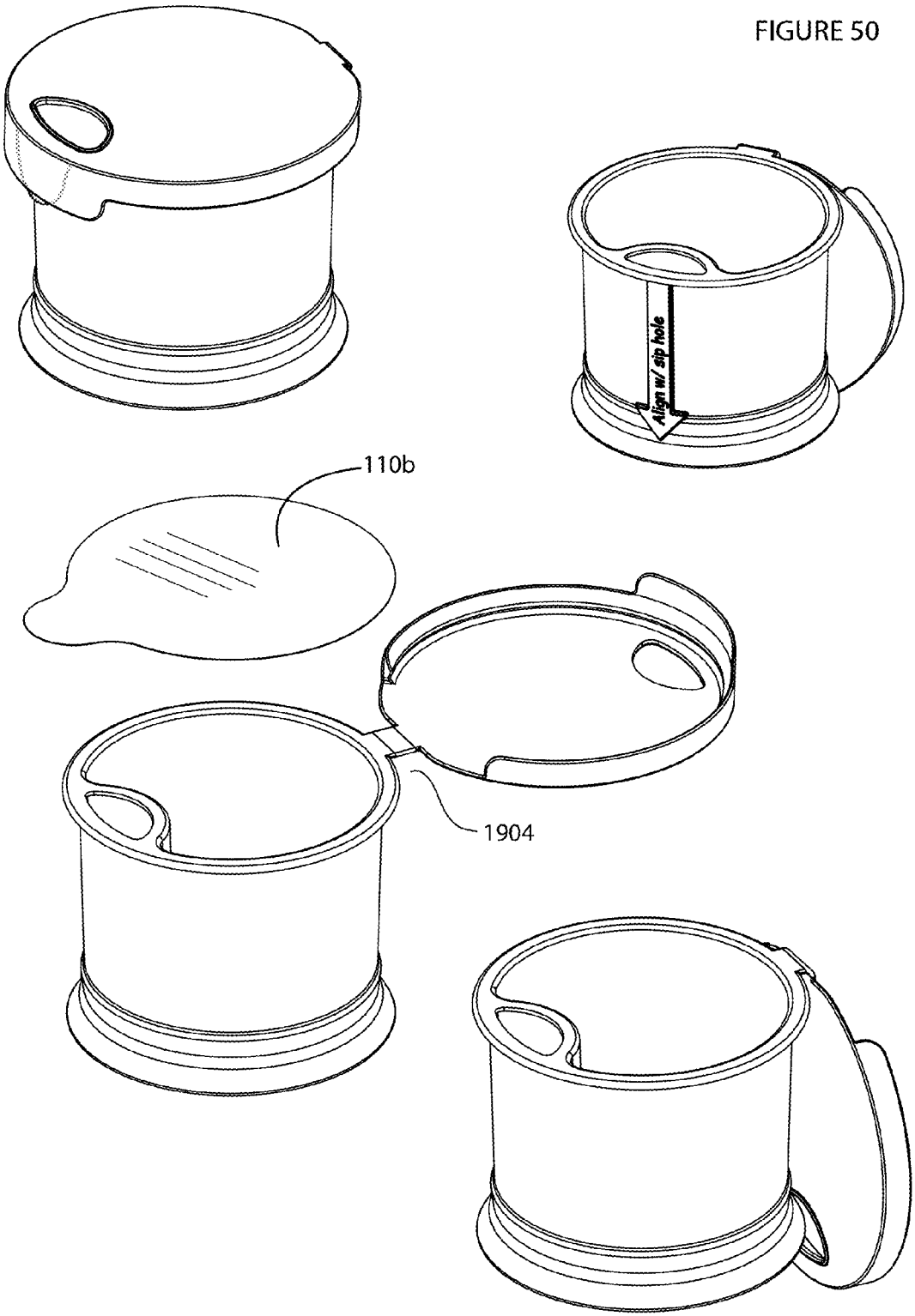
FIG. 50 illustrates a top perspective view of the hinge lid embodiment of FIG. 47 showing a seal-on/peel-off cover.

FIG. 50 illustrates a top perspective view of the one-piece hinge lid embodiment of FIG. 47 showing a seal-on/peel-off cover 110*b*, one piece connecting bridge and score-line hinge 1904. Any type of hinge described herein may be utilized in place of the hinge shown in keeping with the spirit of the invention. In one or more embodiments of the invention, the cover may include a vertical area orthogonal to a plane on which said hole lies, wherein the vertical area is or includes a lower lip bumper.

Figure 51:
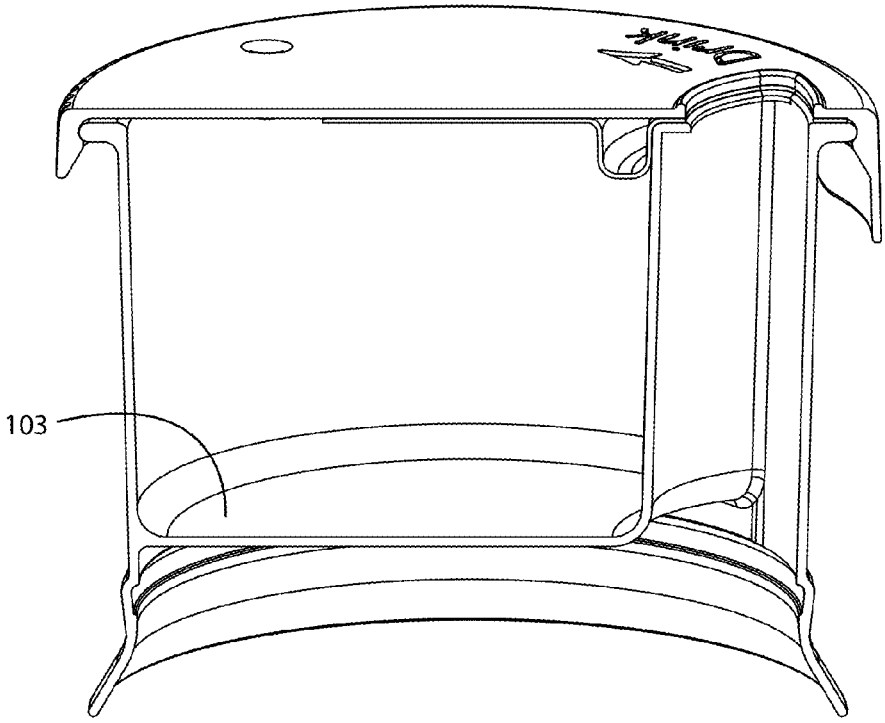
FIG. 51 illustrates cutaway views of the closeable rotational embodiment of FIG. 45.
Figure 51:
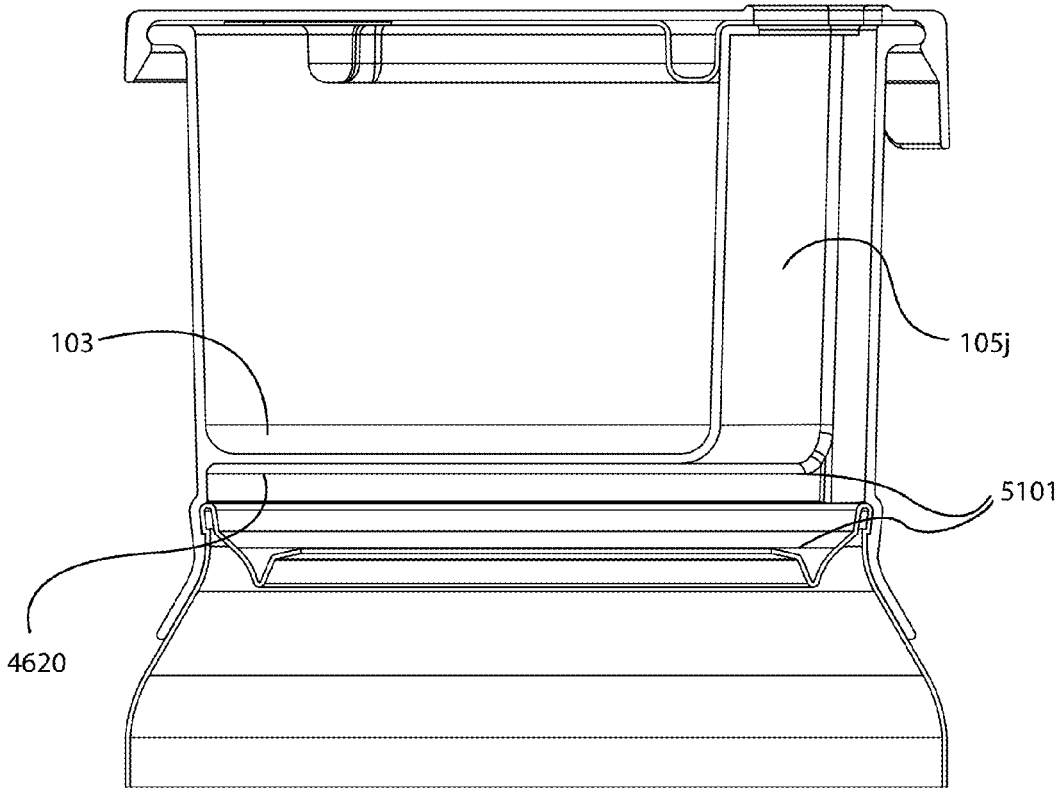

FIG. 51 illustrates cutaway views of the closeable rotational embodiment of FIG. 45. As shown bottom 103 separates the contents of the lid/container from the contents of the can that may touch the bottom of the embodiment at bottom 4620, which defines one side of the embodiment that enables liquid for example from the can or cup below to travel up to hole 105j, through a fluid transfer gap 5101. In one or more embodiments of the invention, the at least one wall may include the vertical sidewall having an integrated upward vertical extension located above the coupling element which couples to the rim of the top of the cup or can. As such, in one or more embodiment a fluid transfer ma be created between the bottom outer horizontal wall of the lid container and a top outer horizontal wall of the cup or can.

While the invention herein disclosed has been described by means of specific embodiments and applications thereof, numerous modifications and variations could be made thereto by those skilled in the art without departing from the scope of the invention set forth in the claims. Various configurations of the invention have been shown, each containing individual embodiments. For the sake of brevity and avoidance of repetition, not all embodiments have been mentioned in every configuration. The embodiments described herein may implement or combine any features from any other embodiment, and as such, any new configuration/embodiment combination which arises from embodiments herein is in keeping with the spirit of the invention.

What is claimed is:

1. A lid with integrated container that couples with a cup or can comprising:

a lid container comprising at least one wall having a top portion and a bottom portion;

wherein said bottom portion of said lid container comprises a substantially flat horizontal wall;

wherein said at least one wall defines at least one cavity configured to store a first solid or a liquid separate from a second solid or liquid stored in a cup or can, wherein said cup or can comprises an annular opening that lies in a plane on top of said cup or can near a rim of said cup or can, wherein said at least one wall comprises an outer portion proximal to an outer wall of said cup or can, and, wherein said bottom portion of said lid container is configured to contact said first solid or liquid on one side and said second solid or liquid on an opposing side of said at least one wall;

a coupling element configured to couple said at least one wall of said lid container to said rim on top of said cup or can;

wherein said at least one wall of said lid container is configured to enable access to said first solid or liquid and said second solid or liquid without disengagement of said coupling element from said cup or can;

wherein said at least one wall comprises a hole configured to enable access to said second solid or liquid stored in said cup or can at said outer portion of said at least one wall proximal to said outer wall of said cup or can, wherein said hole is not located within said lid container where said first solid or liquid is stored, wherein said at least one wall and said hole define a fluid transfer tunnel between said cup or can and said hole, and, wherein said outer portion of said at least one wall comprises a vertical sidewall located above said coupling element which couples to said rim of said top of said cup or can such that a fluid transfer gap is created between said horizontal wall of said bottom portion of said lid container and a top horizontal wall of said cup or can;

wherein said hole is located proximally to a first horizontal area on said at least one wall;

a cover;

wherein said cover comprises a top horizontal surface and a vertical area orthogonal to said top horizontal surface and orthogonal to a plane on which said hole lies, wherein said vertical area is an overhanging lower lip bumper and wherein said lower lip bumper is an integrated feature of said cover; and, a hinge that couples with said at least one wall at said outer portion of said at least one wall to enable said cover to rotate at least 180 degrees away from a closed position;

wherein said cover comprises a second hole on said top horizontal surface, wherein said cover is coupled with said hinge, wherein said hinge is coupled with said lid container and wherein said cover is configured to enclose said lid container, and wherein said cover comprises a second horizontal section that surrounds said second hole, wherein said hole and said second hole align to provide access to said second solid or liquid stored in said cup or can when said cover is in said closed position.

2. The lid with integrated container of claim 1, wherein said first horizontal area covers at least a portion of said fluid transfer tunnel.

3. The lid with integrated container of claim 1, wherein said cover is configured to fixedly snap closed.

4. The lid with integrated container of claim 1, wherein said cover comprises a snap close element in a vertical wall of said cover and a vertical wall of said container that are configured to securely hold said cover closed.

5. The lid with integrated container of claim 1 wherein said cover comprises a clamshell, seal-on/peel-off, or internal wall friction, wherein said lid container comprises paper, plastic, hard molded plastic, ceramic, metal, or silicon.

6. The lid with integrated container of claim 1, wherein said at least one wall comprises a thermochromic plastic configured to change color based on a temperature of said first solid or liquid and/or wherein said cover or said lid container comprises graphic symbols, arrows or lettering or both graphic symbols and lettering of visual or tactile form or logos, advertisements, puzzles, bar codes, promotions, trivia or information.

7. The lid with integrated container of claim 1, wherein said hole is configured as a sip hole or gulp hole with raised side walls, wherein said sip hole or gulp hole is configured to be utilized as a straw, and wherein said straw comprises a top horizontal wall comprising said sip hole or gulp hole.

8. The lid with integrated container of claim 1, wherein said hinge is configured as an axle, tooth and hook, pivot, trough, score line or double score line.

9. The lid with integrated container of claim 1, wherein said cover comprises at least one post and/or tab configured to lift said cover.

10. The lid with integrated container of claim 1, wherein said cover comprises at least one tab and wherein said lid container comprises recessed cut-outs configured to reside under said at least one tab.

11. The lid with integrated container of claim 1, further comprising said cup or can and wherein said cup or can is configured with a fill/volume mark and wherein said fill/volume mark is configured in, on, or out of, a vertical sidewall in said cup or can as a printed or tactile mark or indentation in said cup, or can or any combination thereof and wherein said cup or can comprises one or more of paper, plastic, hard molded plastic, ceramic, or metal.

12. The lid with integrated container of claim 1, wherein said cover is recessed vertically downward into said cavity to provide an area for a nose of a user when said user drinks.

13. The lid with integrated container of claim 1, wherein said cover is flat.

14. The lid with integrated container of claim 1, wherein said cover and said lid container are separate pieces configured to pivot at said hinge.

15. The lid with integrated container of claim 1, wherein said cover and said at least one wall are two separate pieces that couple at said hinge.

16. The lid with integrated container of claim 1, wherein said cover and said at least one wall are two separate pieces that snap together near said hinge.

17. The lid with integrated container of claim 1, wherein said cover and said at least one wall are two separate pieces that snap together near said hinge and wherein said at least one wall comprises a hinge base having a snap element that couples with a corresponding snap element on said cover.

18. The lid with integrated container of claim 1, wherein said cover and said at least one wall are two separate pieces that snap together near said hinge and wherein said at least one wall comprises a hinge base having a snap element that couples with two male snap elements on said cover.

19. The lid with integrated container of claim 1, wherein said cover and said at least one wall are two separate pieces that snap together near said hinge and wherein said at least one wall comprises a hinge base comprising a flat portion parallel to a plane defined by said cover when said cover is closed, wherein said hinge base provides a support against which to snap said cover to said hinge base.

20. The lid with integrated container of claim 1, wherein said cover and said lid container are a single piece configured to pivot at said hinge.

21. The lid with integrated container of claim 1, wherein said hinge is located at an outermost distance away from a centerline of said cup or can and wherein said hinge folds so that said cover rotates past 180 degrees from a closed orientation to an open position.

22. The lid with integrated container of claim 1, wherein said hinge is located nearer to a centerline of said cup or can with respect to an outermost distance away from said centerline of said cup or can and wherein said hinge folds back onto itself so that said cover rotates up to 180 degrees from a closed orientation to an open position.

23. The lid with integrated container of claim 1, wherein said cover and said at least one wall are one piece on each side of said hinge.

24. The lid with integrated container of claim 1, wherein said cover and said at least one wall are one piece on each side of said hinge and wherein said at least one wall comprises a hinge support that lies in a plane that is orthogonal to an axis in which said hinge rotates.

25. The lid with integrated container of claim 1, wherein said coupling element comprises double wall attachment to said rim via inner and outer friction.

26. A lid with integrated container that couples with a cup or can comprising:

a lid container comprising at least one wall having a top portion and a bottom portion;

wherein said bottom portion of said lid container comprises a substantially flat horizontal wall;

wherein said at least one wall defines at least one cavity configured to store a first solid or a liquid separate from a second solid or liquid stored in a cup or can, wherein said cup or can comprises an annular opening that lies in a plane on top of said cup or can near a rim of said cup or can, wherein said at least one wall comprises an outer portion proximal to an outer wall of said cup or can, and, wherein said bottom portion of said lid container is configured to contact said first solid or liquid on one side and said second solid or liquid on an opposing side of said at least one wall;

a coupling element configured to couple said at least one wall of said lid container to said rim on top of said cup or can;

wherein said at least one wall of said lid container is configured to enable access to said first solid or liquid and said second solid or liquid without disengagement of said coupling element from said cup or can;

wherein said at least one wall comprises a hole configured to enable access to said second solid or liquid stored in said cup or can at said outer portion of said at least one wall proximal to said outer wall of said cup or can, wherein said hole is not located within said lid container where said first solid or liquid is stored, wherein said at least one wall and said hole define a fluid transfer tunnel between said cup or can and said hole, and, wherein said outer portion of said at least one wall comprises a vertical sidewall located above said coupling element which couples to said rim of said top of said cup or can such that a fluid transfer gap is created between said horizontal wall of said bottom portion of said lid container and a top horizontal wall of said cup or can;

wherein said hole is located proximally to a first horizontal area on said at least one wall;

a cover;

wherein said cover comprises a top horizontal surface and a vertical area orthogonal to said top horizontal surface and orthogonal to a plane on which said hole lies, wherein said vertical area is an overhanging lower lip bumper and wherein said lower lip bumper is an integrated feature of said cover; and, a hinge that couples with said at least one wall at said outer portion of said at least one wall to enable said cover to rotate at least 180 degrees away from a closed position;

wherein said cover comprises a second hole on said top horizontal surface, wherein said cover is coupled with said hinge, wherein said hinge is coupled with said lid container and wherein said cover is configured to enclose said lid container, and wherein said cover comprises a second horizontal section that surrounds said second hole wherein said hole and said second hole align to provide access to said second solid or liquid stored in said cup or can when said cover is in said closed position; and, wherein said cover is configured to fixedly snap closed, and, wherein said hole is configured as a sip hole or gulp hole with raised side walls, wherein said sip hole or gulp hole is configured to be utilized as a straw, and wherein said straw comprises a top horizontal wall comprising said sip hole or gulp hole.

27. The lid with integrated container of claim 26, wherein said first horizontal area covers at least a portion of said fluid transfer tunnel.

* * * * *